US012808365B2

(12) United States Patent
Yao et al.

(10) Patent No.: US 12,808,365 B2
(45) Date of Patent: Nov. 24, 2026

(54) HYDRAULIC END OF FRACTURING PUMP

(71) Applicant: YANTAI JEREH OILFIELD SERVICES GROUP CO., LTD., Yantai (CN)

(72) Inventors: Junlei Yao, Yantai (CN); Yibo Jiang, Yantai (CN); Feng Wang, Yantai (CN); Lianpan Duan, Yantai (CN); Yudong Ding, Yantai (CN); Maoqin Li, Yantai (CN)

(73) Assignee: Yantai Jereh Oilfield Services Group Co., Ltd., Yantai (CN)

( * ) Notice: Subject to any disclaimer, the term of this patent is extended or adjusted under 35 U.S.C. 154(b) by 0 days.

(21) Appl. No.: 19/259,667

(22) Filed: Jul. 3, 2025

(65) Prior Publication Data

US 2026/0132785 A1 May 14, 2026

Related U.S. Application Data

(63) Continuation-in-part of application No. PCT/CN2023/070785, filed on Jan. 5, 2023.

(30) Foreign Application Priority Data

May 14, 2024 (CN) ..... 202410598120.X
May 14, 2024 (CN) ..... 202421047248.9

(51) Int. Cl.
*F04B 39/12* (2006.01)
*F04B 39/04* (2006.01)
(Continued)

(52) U.S. Cl.
CPC ..... *F04B 39/125* (2013.01); *F04B 39/041* (2013.01); *F04B 53/007* (2013.01);
(Continued)

(58) Field of Classification Search
CPC ..... F04B 53/16; F04B 53/164; F04B 53/18
See application file for complete search history.

(56) References Cited

U.S. PATENT DOCUMENTS 11,041,570 B1 6/2021 Buckley et al.
2018/0298893 A1 10/2018 Buckley
(Continued)

FOREIGN PATENT DOCUMENTS

CN 204511860 U 7/2015
CN 204921346 U 12/2015
(Continued)

OTHER PUBLICATIONS

International Search Report issued in PCT Application No. PCT /CN2023/070785 dated Aug. 26, 2023 (5 pages).
(Continued)

*Primary Examiner* — Jonathan R Matthias
(74) *Attorney, Agent, or Firm* — Crowell & Moring LLP

(57) ABSTRACT

A hydraulic end and a fracturing pump. The hydraulic end includes a body and a functional device. The functional device includes at least one of a base plate, an end cover assembly, and a packing assembly, and the functional device is detachably fixedly connected to the body. The above hydraulic end can solve the problem of relatively high production costs caused by replacement of an entire hydraulic end body in case of failures such as leakage caused by wear of a packing or cracking of an end cover under a force.

16 Claims, 41 Drawing Sheets

(51) Int. Cl.

| | |
|---|---|
| ***F04B 53/00*** | (2006.01) |
| ***F04B 53/10*** | (2006.01) |
| ***F04B 53/16*** | (2006.01) |
| ***F04B 53/18*** | (2006.01) |

(52) U.S. Cl.
CPC ..... *F04B 53/1035* (2013.01); *F04B 53/1087* (2013.01); *F04B 53/164* (2013.01); *F04B 53/18* (2013.01)

(56) References Cited

U.S. PATENT DOCUMENTS

| | | | | |
|---|---|---|---|---|
| 2019/0011051 | A1 | 1/2019 | Yeung | |
| 2021/0071768 | A1 | 3/2021 | Buckley | |
| 2022/0282719 | A1* | 9/2022 | Barnhouse | F04B 53/168 |
| 2022/0341415 | A1 | 10/2022 | Deng et al. | |
| 2022/0403839 | A1* | 12/2022 | Mullins | F04B 15/02 |
| 2022/0412346 | A1* | 12/2022 | Nowell | F04B 53/007 |
| 2023/0047066 | A1* | 2/2023 | Barnett | F04B 39/122 |
| 2023/0323969 | A1 | 10/2023 | Wei et al. | |
| 2023/0332687 | A1* | 10/2023 | Baumann | F04B 27/0442 |

FOREIGN PATENT DOCUMENTS

| | | | |
|---|---|---|---|
| CN | 205089589 | U | 3/2016 |
| CN | 208474056 | U | 2/2019 |
| CN | 111692064 | A | 9/2020 |
| CN | 111692065 | A | 9/2020 |
| CN | 213627511 | U | 7/2021 |
| CN | 216111233 | U | 3/2022 |
| CN | 216894768 | U | 7/2022 |
| CN | 222377336 | U | 1/2025 |

OTHER PUBLICATIONS

Written Opinion issued in PCT Application No. PCT/CN2023/070785 dated Aug. 26, 2023 with English translation (6 pages).
International Preliminary Report on Patentability issued in PCT Application No. PCT/CN2023/070785 dated Jul. 3, 2025 with English translation (4 pages).
Chinese Office Action issued in Application No. 202410598120.X dated Oct. 1, 2026, with English translation (17 pages).
Chinese Office Action issued in Application No. 202410598120.X dated Sep. 28, 2026, with English translation (8 pages).

* cited by examiner

HYDRAULIC END OF FRACTURING PUMP

CROSS-REFERENCE TO RELATED APPLICATIONS

This application is based on and claims the benefit of priority to PCT International Patent Application No. PCT/CN2023/070785, filed on Jan. 5, 2023, and also based on and claims the benefit of priority to Chinese Patent Application No. 202410598120.X, filed on May 14, 2024, and also based on and claims the benefit of priority to Chinese Patent Application No. 202421047248.9U, filed on May 14, 2024, each of which are hereby fully incorporated by reference herein in their entireties.

TECHNICAL FIELD

The present application belongs to the technical field of oil and gas production, and in particular, to a hydraulic end and a fracturing pump.

BACKGROUND

A fracturing pump is a commonly used production increase equipment in the field of oil and gas production. It usually includes a power end, a hydraulic end, and a gear reduction system. The power end is configured to: connect the reduction system to the hydraulic end to convert rotating mechanical energy transmitted by the reduction system into reciprocating mechanical energy, and drive the hydraulic end to perform liquid absorption and discharging actions. The hydraulic end usually includes a hydraulic end body and a plunger. The plunger cooperates with the hydraulic end body. At present, the hydraulic end body is usually formed by integral forging. During the operation of the fracturing pump, high-pressure liquid can be formed in the hydraulic end. During the flow of the high-pressure liquid, a large force will be exerted on the cross-intersection area of the fluid cavity of the hydraulic end and the connection area between the lower valve cavity and the cross-intersection area of the fluid cavity. With the increase of the service time, if failures occur, the entire hydraulic end body needs to be replaced, resulting in relatively high production costs.

SUMMARY

Embodiments of the present application aim to provide a hydraulic end and a fracturing pump, to solve the problem of relatively high production costs caused by replacement of an entire hydraulic end body in case of failures such as leakage caused by wear of a packing or cracking of an end cover under a force. The present disclosure can solve the problems of cavitation inside the hydraulic end.

In a first aspect, the embodiments of the present application disclose a hydraulic end, including a body and a functional device. The functional device includes at least one of a base plate, an end cover assembly, and a packing assembly, and the functional device is detachably fixedly connected to the body.

In a second aspect, the embodiments of the present application provide a fracturing pump, including a reduction system, a power end, and the above hydraulic end. The reduction system is connected to the hydraulic end through the power end.

The embodiments of the present application disclose a hydraulic end, including a body and a functional device. The functional device includes at least one of a base plate, an end cover assembly, and a packing assembly, and the functional device forms a fixed connection relationship with the body in a detachable manner. Thus, in a working process of the hydraulic end, if a failure such as leakage caused by wear of a packing or cracking of an end cover under a force occurs, and when the technical solution of separately forming the corresponding functional device and the body is used, only the corresponding damaged component may be replaced, instead of replacing the entire hydraulic end body. This can reduce the production costs.

BRIEF DESCRIPTION OF THE DRAWINGS

The accompanying drawings described here are used to provide a further understanding of the present application and form a part of the present application. The illustrative embodiments and their explanations of the present application are used to explain the present application and do not constitute an improper limitation on the present application. In the accompanying drawings.

DESCRIPTIONS OF SOME REFERENCE NUMERALS

Figure 1:
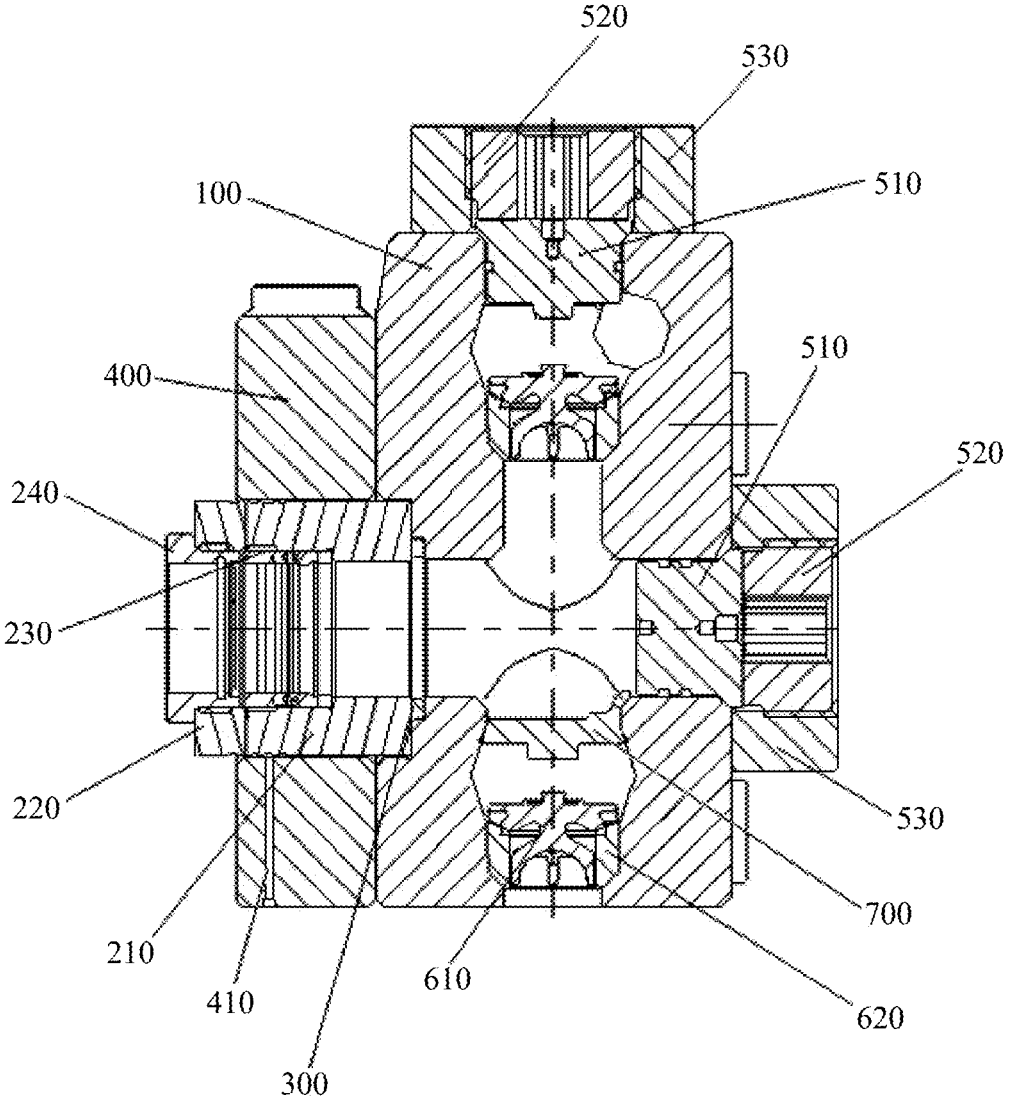
FIG. 1 is a schematic structural diagram of a hydraulic end according to an embodiment of the present application.
Figure 2:
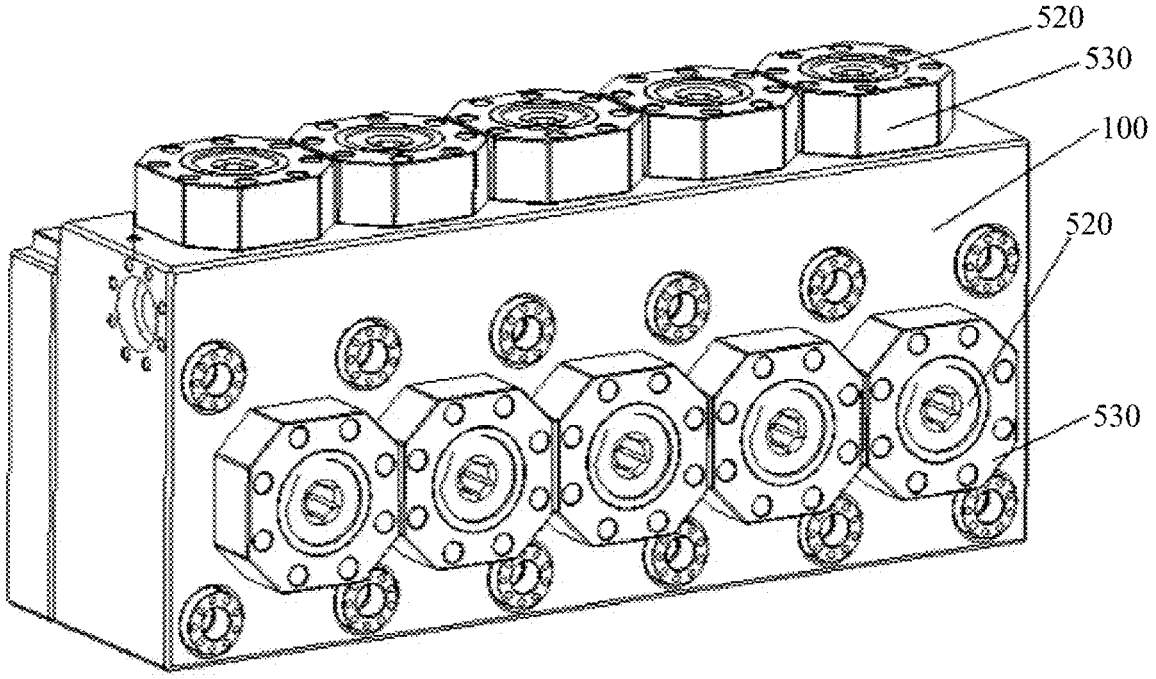
FIG. 2 is a schematic structural diagram of a hydraulic end according to an embodiment of the present application in another direction.
Figure 3:
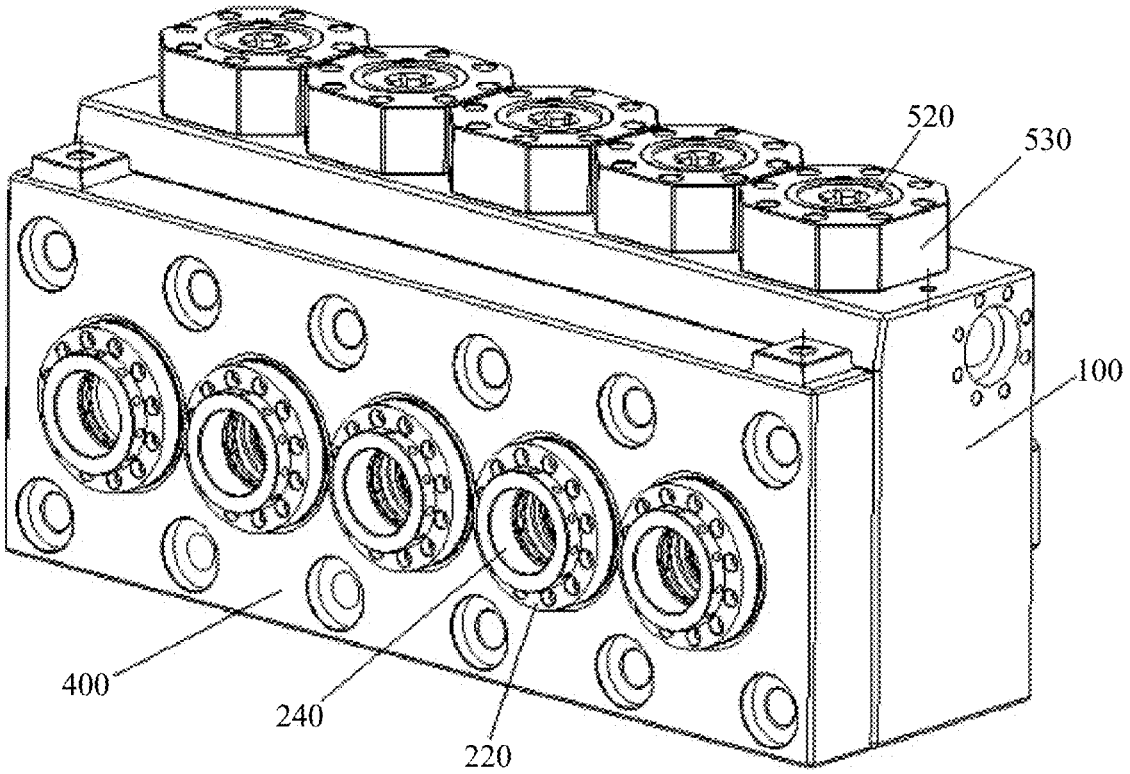
FIG. 3 is a schematic structural diagram of a hydraulic end according to an embodiment of the present application in still another direction.
Figure 4:
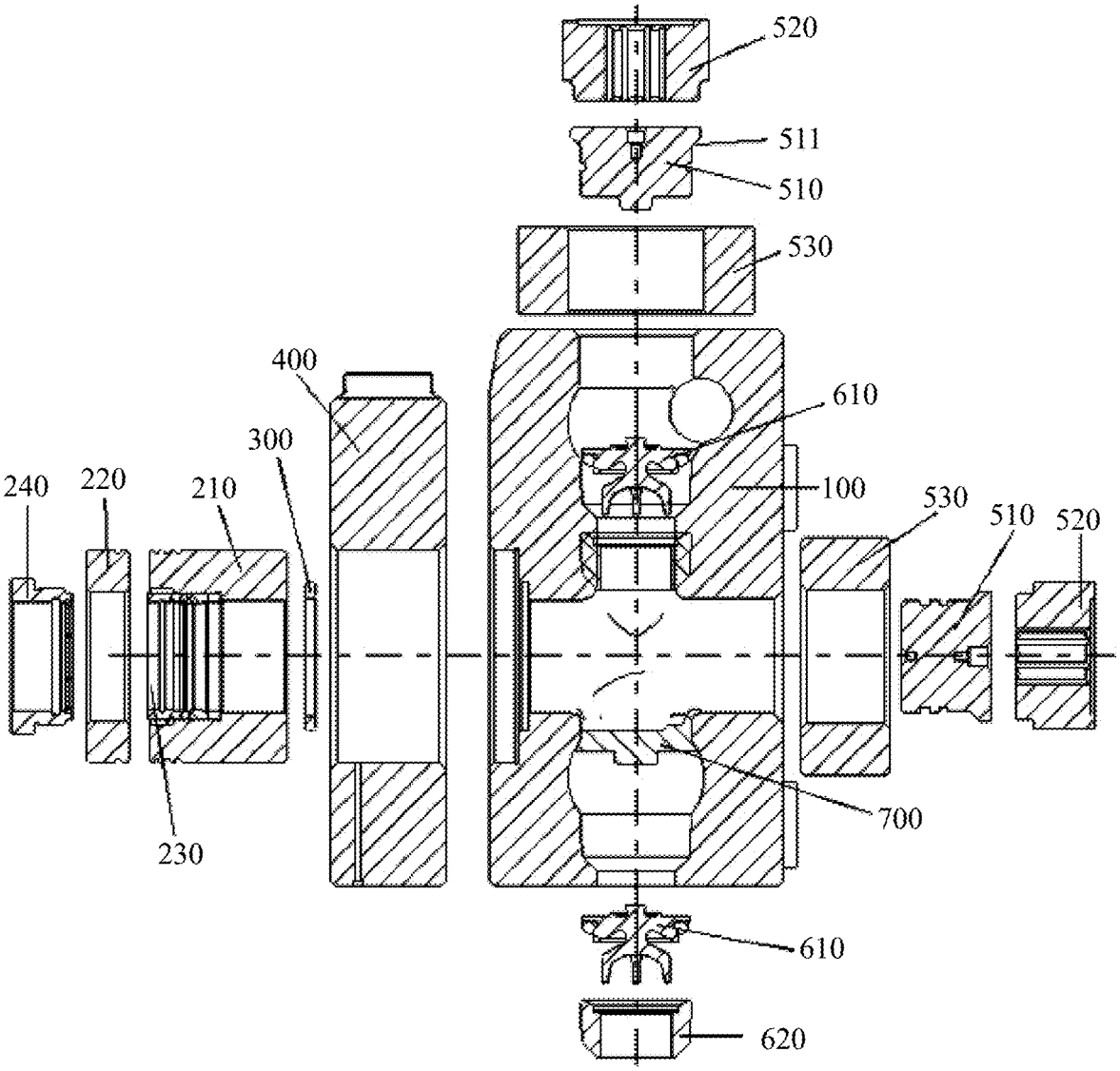
FIG. 4 is a schematic structural exploded diagram of a hydraulic end according to an embodiment of the present application.
Figure 5:
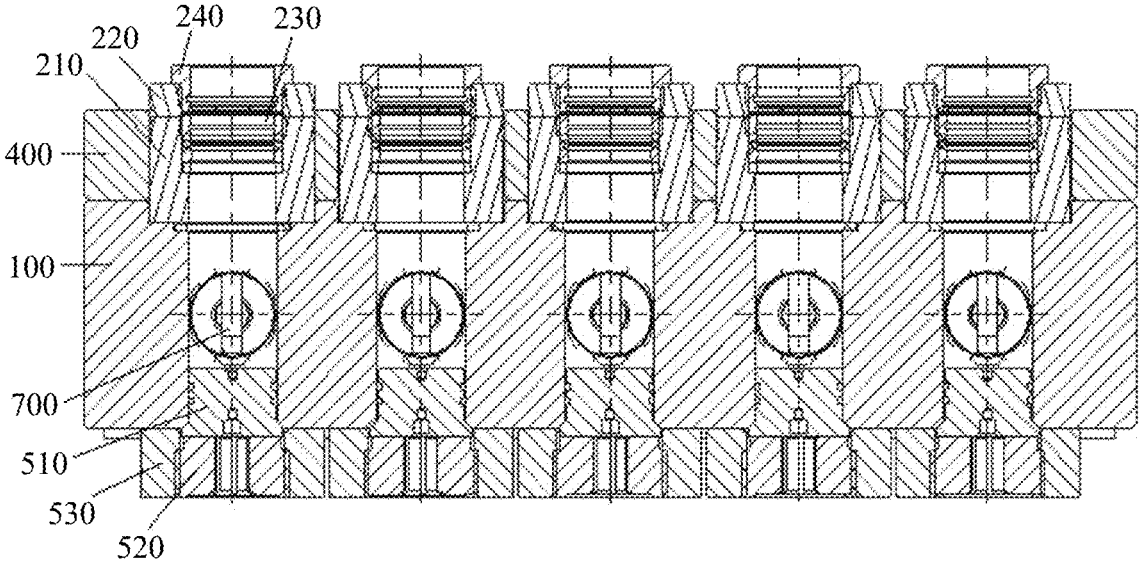
FIG. 5 is a schematic cross-sectional diagram of a hydraulic end according to an embodiment of the present application.
Figure 6:
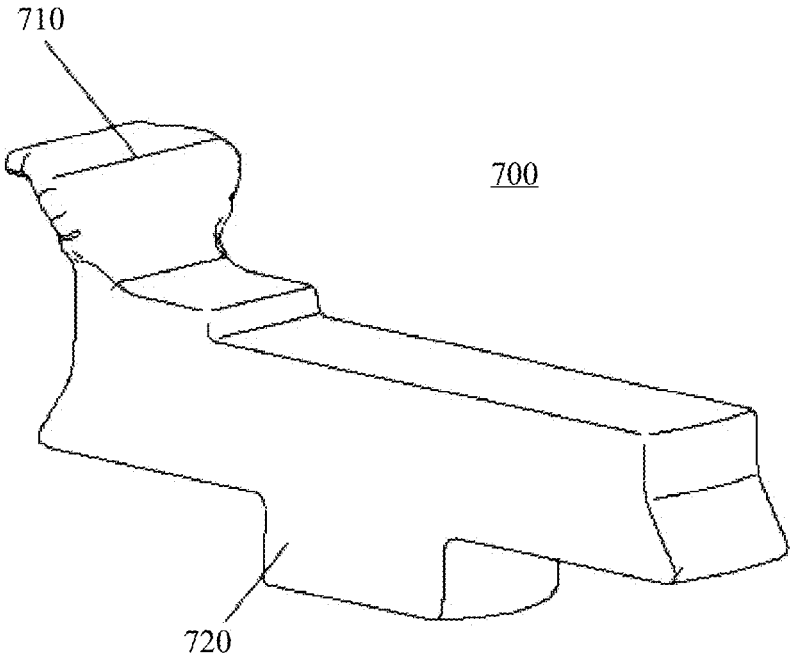
FIG. 6 is a schematic structural diagram of a protective support in a hydraulic end according to an embodiment of the present application.

100: body;

210: packing box; 220: packing box pressing cap; 230: packing; 240: packing pressing cap;

300: sealing ring;

400: base plate; 410: lubrication channel;

510: end cover; 511: matching surface; 520: end cover pressing cap; 530: end cover pressing cap box;

610: valve; 620: valve seat;

700: protective support; 710: blocking part; and 720: limiting pin;

90-01: hydraulic end□

90-1: hydraulic end body□ 90-11: valve box□ 90-111: intersecting cavity□ 90-112: the first valve cavity□ 90-1121: spherical surface□ 90-113: end cover opening□ 90-114: plunger cavity□ 90-1141: receiving groove□ 90-115: the first positioning hole□ 90-116: positioning groove□ 90-12: back plate□ 90-13: positioning member□ 90-14: lubrication channel□

90-2: packing assembly□ 90-21: packing body□ 90-22: the first pressing member□ 90-221: the second fixing hole□ 90-222: the second positioning hole□ 90-223: the first mounting hole□ 90-224: positioning protrusion□ 90-23: the second pressing member□ 90-231: the second mounting hole□ 90-24: the first oil ring□ 90-241: the first lip□ 90-25: the second oil ring□ 90-251: the second lip□

90-3: the first valve assembly□

90-31: valve support□

90-311: support body□ 90-3111: the first end surface□ 90-3112: the second end surface□ 90-3113: groove□ 90-3114: boss□ 90-3115: through hole□

90-312: leg portion□ 90-3121: the first leg□ 90-31211: the fourth contact surface□ 90-31212: the arc groove□ 90-3122: the second leg□ 90-31221: arc surface□

90-313: protective portion□ 90-3131: the first protective segment□ 90-31311: the first contact surface□ 90-31312: the second contact surface□ 90-3132: the second protective segment□ 90-31321: the third contact surface;

90-32: valve sleeve□ 90-33: valve member□ 90-34: the elastic member□

90-4: the second valve assembly□

90-5: the end cover assembly□

90-51: end cover body□ 90-511: annular groove□ 90-512: concave arc surface□ 90-513: conical inclined surface□ 90-514: the protrusion□ 90-515: the threaded hole□ 90-52: end cover pressing cap□

90-6: plunger□ 90-61: convex arc surface□

90-7: upper cover assembly□

90-02: power end□

90-03: reduction device.

It will be understood that some terms may be used interchangeably to describe the same structure. As non-limiting examples, the gear reduction system may be alternatively referred to as the reduction device; the valve box may be alternatively referred to as the body or the valve box body; the base plate may be alternatively referred to as the back plate; the lower valve assembly may be alternatively referred to as the first valve assembly; the upper valve assembly may be alternatively referred to as the second valve assembly; the valve support may be alternatively referred to as the spring support or the protective support; the valve seat may be alternatively referred to as the valve sleeve; the packing may be alternatively referred to as the packing body; the packing box pressing cap may be alternatively referred to as the first pressing member; the packing pressing cap may be alternatively referred to as the second pressing member; the end cover may be alternatively referred to as the pressing cover or the end cover body; the end cover pressing cap may be alternatively referred to as the pressing cap; the end cover pressing cap box may be alternatively referred to as the pressing cap fixing seat; the upper cover assembly may be alternatively referred to as the outlet end over assembly; the sealing ring may be alternatively referred to as the sealing gasket ring; and the intersecting cavity may be alternatively referred to as the intersecting plunger cavity.

DETAILED DESCRIPTION

The technical solutions in embodiments of the present application are clearly and completely described in the following with reference to the accompanying drawings in the embodiments of the present application. Apparently, the described embodiments are merely some rather than all the embodiments of the present application. All other embodiments obtained by a person of ordinary skill in the art based on the embodiments of the present application without making creative efforts shall fall within the protection scope of the present application.

This specification and claims of the present application, and terms "first" and "second" are used to distinguish similar objects, but are unnecessarily used to describe a specific sequence or order. It should be understood that data used like this is interchangeable where appropriate, so that the embodiments of the present application can be implemented in an order other than those illustrated or described here. Furthermore, objects distinguished by "first", "second", and the like are usually of the same class and do not limit the number of objects. For example, the first object can be one or multiple. In addition, "and/or" used in this specification and the claims represents at least one of the connected objects. Symbol "/" usually represents an "or" relationship between front and back associated objects.

An electronic device according to an embodiment of the present application will be described in detail below through specific embodiments and their application scenarios in combination with the accompanying drawings. Although different embodiments and features are described with reference to different figures, some same or similar features, may be described with reference to different figures/embodiments. A person of ordinary skill in the art will understand what features discussed with reference to different figures are the same or similar and how the features discussed in different embodiments/figures may be combined together to achieve desired functions.

Some example embodiments are described with reference to FIGS. 1-6:

As shown in FIG. 1 to FIG. 6, the embodiments of the present application disclose a hydraulic end. The hydraulic end can be applied into a fracturing pump. The hydraulic end includes a body 100 and a functional device.

The body 100 is a main body structure of the hydraulic end, and can determine parameters such as a specific structure and a size of a main body according to an actual situation. Specifically, the body 100 is provided with an inner cavity having a plurality of openings, so that the inner cavity can be communicated to the outside of the body 100 through the plurality of openings. Corresponding devices can be mounted in both the foregoing inner cavity and the openings according to an actual situation. In addition, the body 100 may be provided with a pluralit **111111111

The functional device is a device for corresponding functions on the hydraulic end. The functional device may include at least one of a base plate 400, an end cover assembly, and a packing assembly. The foregoing specific functional devices are all devices in the hydraulic end and are respectively configured to provide different functions. Moreover, in the embodiments of the present application, the functional device is detachably fixedly connected to the body 100 in a detachable manner, so that the functional device and the body 100 can be separately processed and formed by separate molding, and then the functional device is correspondingly fixedly connected to the body 100 in a detachable connection manner, to form the hydraulic end. Thus, in a case of a failure such as leakage caused by wear of a packing 230 or cracking of an end cover 510 under a force, and when the technical solution of separately forming the corresponding functional device and the body 100, only the corresponding damaged component can be replaced, instead of replacing the entire hydraulic end body 100. This can reduce the production costs.

Specifically, a size and other parameters of the functional device can be correspondingly determined according to parameters of the body 100, and are not limited here. Moreover, the functional device may alternatively be formed using a material with relatively high structural strength, such as metal. However, a material that meets a requirement for the structural strength of the functional device can be selected according to an actual situation, and may not necessarily be the same as a material of the body 100. This can save the costs to an extent. In addition, the functional device can be processed and formed by batch casting. This can further reduce the processing costs of the functional device.

The embodiments of the present application disclose a hydraulic end, including a body 100 and a functional device. The functional device includes at least one of a base plate 400, an end cover assembly, and a packing assembly, and the functional device forms a fixed connection relationship with the body 100 in a detachable manner. Thus, in a working process of the hydraulic end, if a failure such as leakage caused by wear of a packing 230 or cracking of an end cover 510 under a force occurs, and when the technical solution of separately forming the corresponding functional device and the body 100 is used, only the corresponding damaged component may be replaced, instead of replacing the entire hydraulic end body 100. This can reduce the production costs.

As mentioned above, the body 100 is provided with an inner cavity. Specifically, the inner cavity may include an accommodating chamber. Optionally, the functional device includes a packing assembly, and the accommodating chamber is configured to accommodate the packing assembly. Specifically, the packing assembly includes a packing box 210, a packing box pressing cap 220, a packing 230, and a packing pressing cap 240. In the packing assembly, a component directly mounted into the accommodating chamber is the packing box 210, namely, the packing box 210 is accommodated in the accommodating chamber. To form a fixed relationship between the packing box 210 and the body 100, the packing box pressing cap 220 is fixedly connected to the body 100, to limit the packing box 210 in the accommodating chamber in an axial direction of the accommodating chamber.

Specifically, an opening is provided in one end of the accommodating chamber. The packing box 210 can be mounted into the accommodating chamber from the opening in one end of the accommodating chamber. The packing box pressing cap 220 arranged on an outer side of the packing box 210 can be used to provide a limiting effect for the packing box 210 in the axial direction of the accommodating chamber, so that the packing box 210 can be fixed in the accommodating chamber. The packing box pressing cap 220 can specifically form a fixed connection relationship with the body 100 in a detachable manner, so that after the packing box 210 or the packing 230 mounted on the packing box 210 or the like is worn, the packing box pressing cap 220 can be removed from the body 100 to replace the packing box 210 mounted in the accommodating chamber. Specifically, the packing box pressing cap 220 can form the detachable fixed connection relationship with the body 100 through a bolt, to ensure a relatively stable fixed connection relationship between them and lower the difficulty of forming the fixed connection relationship.

As described above, the packing 230 is mounted in the packing box 210. Specifically, the packing box 210 is provided with a packing chamber. The packing chamber is configured to accommodating the packing 230. By forming a fixed connection relationship between the packing pressing cap 240 and the packing box pressing cap 220, the packing 230 is limited in the axial direction of the accommodating chamber to form the relatively fixed relationship between the packing 230 and the packing box 210.

Similarly, the packing chamber is also a chamber with an opening in one end, and is formed in the packing box 210, and the packing 230 can be mounted into the packing chamber through the opening in one end of the packing chamber. Furthermore, the packing pressing cap 240 arranged on the outer side of the packing 230 is used to provide a limiting effect for the packing 230 in the axial direction of the accommodating chamber, so that the packing 230 and the packing box 210 form the relatively fixed relationship. More specifically, the packing box pressing cap 220 may be provided with an internal thread, and the packing pressing cap 240 may be provided with an external thread, to form a fixed connection relationship between them through threaded connection. This connection mode is simple and reliable.

As mentioned above, the packing box 210 may be fixed in the accommodating chamber by the packing box pressing cap 220. To ensure that the packing box 210 can form a sealing fit relationship with the body 100 (specifically a chamber wall of the accommodating chamber of the body 100). Optionally, a plurality of annular slots are provided in an outer circumference of the packing box 210, and rubber sealing rings 300 can be arranged in the annular slots.

To improve the reliability of sealing between the packing box 210 and the body 100, and reduce the replacement frequency of the sealing rings 300, in another embodiment of the present application, the hydraulic end includes a sealing ring 300, and the sealing ring 300 is formed using a rigid material. Specifically, a metal material can be used to form the sealing ring 300. Of course, the sealing ring 300 is of a ring-shaped structure. Correspondingly, when the foregoing sealing ring 300 is used to provide a sealing relationship between the packing box 210 and the body 100, the sealing ring 300 can be clamped between the packing box 210 and the body 100 in the axial direction of the accommodating chamber, thereby sealing the packing box 210 and the body 100 by the sealing ring 300. More specifically, in the process of using the packing box pressing cap 220 to fix the packing box 210 and the body 100, the sealing ring 300 can be clamped between the packing box 210 and the body 100, and the sealing ring 300 has a deformation under a force, thereby enhancing the sealing effect between the packing box 210 and the body 100.

Still further, a ring-shaped protrusion can be arranged on an end surface of the packing box 210 facing the sealing ring 300, and the ring-shaped protrusion can form a ring-shaped sealing fit relationship with the sealing ring 300. This can reduce a contact area between the packing box 210 and the sealing ring 300, thereby increasing a contact surface pressure between them and achieving the purpose of high-pressure sealing. Specifically, the ring-shaped protrusion can be formed along with the processing of the packing box 210, and a cross section of a surface of the ring-shaped protrusion can be rectangular or in another other shape. In a specific embodiment of the present application, the cross section of the surface of the ring-shaped protrusion is of a circular arc structure, which can further reduce the contact area between the ring-shaped protrusion and the sealing ring 300 and increase the contact surface pressure.

As mentioned above, the functional device may include the base plate 400, and the hydraulic end is provided with an inner cavity. The inner cavity may include the above accommodating chamber. Based on this, at least a portion of the accommodating chamber is arranged on the base plate 400. Meanwhile, a fixed connection relationship can be formed between the base plate 400 and the body 100 of the hydraulic end in a detachable manner, so that as the working time of the hydraulic end increases, the base plate 400 can be removed from the body 100 and replaced with a new base plate 400 to solve the problem of damage or wear of the base plate 400, thereby avoiding the replacement of the entire hydraulic end and saving the production costs.

Specifically, the base plate 400 may be formed using a hard material such as metal. A material that meets a requirement can be selected according to a need of the base plate 400 to form the base plate 400, and it is not necessary to use the same material as the body 100 to form the base plate 400. Specifically, the base plate 400 may be formed by batch casting. This can further reduce the production costs. More specifically, the base plate 400 can form a detachable fixed connection relationship with the body 100 through a bolt. This connection mode is simple and reliable.

Generally, during the working of the hydraulic end, lubrication needs to be provided to the packing 230. For example, lubrication grease for lubrication can be directly conveyed from an outer end of the packing 230 to the packing 230. Based on the base plate 400 being detachably mounted on the body 100, optionally, the base plate 400 is further provided with a lubrication channel 410. Furthermore, A through hole is provided in the packing box 210, so that the lubrication channel 410 can be communicated to the packing chamber through the through hole, and it can further ensure that the lubrication grease can be conveyed to a position of the packing 230 to provide lubrication for the packing 230.

Specifically, the lubrication channel 410 can be of a finely porous structure to minimize the adverse effect on the structural strength of the base plate 400. Correspondingly, the through hole may alternatively be a through hole with a small diameter, to ensure that the packing box 210 still has good structural strength. Meanwhile, an annular channel may be provided in an outer circumference of the packing box 210, to ensure that the lubrication channel 410 can be communicated to the through hole all the time, thereby ensuring that the lubrication grease can be conveyed into the packing chamber through the through hole to provide the lubrication for the packing 230.

Still further, a number of the through holes may be multiple, and the plurality of through holes can be uniformly spaced apart around the axial direction of the accommodating chamber on the packing box 210. On the one hand, this can improve the conveying efficiency of the lubrication grease, and on the other hand, this can further improve the uniformity of the lubrication grease on the packing 230.

As mentioned above, the functional device may include the end cover assembly, and the hydraulic end may be provided with an inner cavity and an opening. The opening on the hydraulic end includes an end cover opening, and the end cover assembly is mounted at the end cover opening. In detail, the end cover assembly includes an end cover 510, an end cover pressing cap 520, and an end cover pressing cap box 530, and at least a portion of the end cover 510 is accommodated in the end cover opening to limit a motion range of an upper valve (i.e., a valve 610 located above the hydraulic end). Correspondingly, to achieve a fixing purpose for the end cover 510 and the body 100, the end cover pressing cap box 530 is fixed to the body 100, and the end cover pressing cap 520 is fixedly connected to the end cover pressing cap box 530, thereby achieving fixedly limiting the end cover 510 in the end cover opening in the axial direction of the end cover opening.

Specifically, at least a portion of the end cover 510 can extend into the end cover opening from an end opening of the end cover opening. By mutual cooperation, the end cover pressing cap 520 and the end cover pressing cap box 530 are located on an outer side of the end cover 510, so that it can ensure that the end cover 510 can be limited in the end cover opening to prevent the end cover 510 from being loosened from the end cover opening.

The end cover pressing cap box 530 forms a fixed connection relationship with the body 100 in a detachable manner, and the end cover pressing cap 520 also forms a fixed connection relationship with the end cover pressing cap box 530 in a detachable manner. Therefore, when any component of the end cover assembly is worn, the end cover assembly can be removed from the body 100 and replaced with a new end cover assembly, instead of replacing the entire hydraulic end.

Specifically, the end cover 510, the end cover pressing cap 520, and end cover pressing cap box 530 can all be formed using hard material such as metals. Furthermore, to save the costs, they may alternatively be made of materials different from that of the body 100, as long as they meet their respective parameter requirements. Correspondingly, the end cover 510, the end cover pressing cap 520, and the end cover pressing cap box 530 may all be formed by forging. This can further reduce the production costs of the entire hydraulic end. In addition, the end cover pressing cap box 530 may form the detachably fixed connection relationship with the body 100 by using a bolt, and the end cover pressing cap 520 may form the detachably fixed connection relationship with the end cover pressing cap box 530 in a threaded connection manner. This can ensure a good relative fixing effect between components and a low difficulty in forming the connection relationship.

As mentioned above, at least a portion of the end cover 510 is accommodated in the end cover opening, so that the end cover 510 is mounted as a "plug" in the end cover opening. Furthermore, due to an axial compression force, provided by the end cover pressing cap 520 in the axial direction of the end cover opening, on the end cover 510, there is a mutual compression relationship between the end cover 510 and the body 100. Based on this, to improve concentrated stress between the end cover and the body, optionally, an outer wall surface of the end cover 510 around the axial direction of the end cover opening and an inner wall surface of the end cover opening in the axial direction of the end cover opening each include a matching surface 511, and the matching surfaces 511 are both of circular-truncated side surface structures. In a case of using the aforementioned technical solution, a contact area between the end cover 510 and the inner wall surface of the end cover opening is larger, which can greatly improve the concentrated stress between the end cover and the body, and prolong the service lives of the end cover assembly and the body 100.

As mentioned above, the body 100 can be provided with a plurality of groups of inner cavities and a plurality of groups of openings corresponding to the plurality of groups of inner cavities, and each opening is provided with a corresponding functional device. In detail, a number of the end cover opening may be multiple, and the plurality of end cover openings are correspondingly provided with end cover assemblies. In this case, the end cover pressing cap box 530 can be of an octagonal prism structure. This can reduce a space occupied by the plurality of end cover pressing cap boxes 530 in an arrangement direction of the end cover openings. Therefore, a size of each end cover pressing cap box 530 can be appropriately increased in a limited space, thereby improving the structural stability of the end cover pressing cap box and the reliability of limiting the end cover 510.

As mentioned above, the hydraulic end is provided with the inner cavity. More specifically, the body 100 is provided with the inner cavity, and the inner cavity includes a valve chamber. As the name suggests, the valve chamber is configured to accommodate a valve. In the hydraulic end disclosed in this embodiment of the present application, an inner wall of the valve chamber is a spherical or arc-shaped surface. This can prevent formation of a local small eddy and a dead zone, thereby preventing sediments and local resistance, improving the stability of the hydraulic end, and prolonging the service life of the hydraulic end.

In addition, the inner cavity of the hydraulic end further includes a high-pressure cavity, and the high-pressure cavity is communicated to the valve chamber. In the present application, the high-pressure cavity can be biased on one side of an axial line of the valve chamber, to minimize the impact of the valve chamber on a discharging and flowing diameter of the high-pressure cavity, thereby reducing pressure fluctuations of the high-pressure cavity caused by opening and closing of the upper valve.

The inner cavity of the hydraulic end further includes a cross intersection line region. In addition, the inner cavity of the body 100 further includes the above valve chamber. The valve chamber includes an upper valve chamber and a lower valve chamber. The cross intersection line region is located between the upper valve chamber and the lower valve chamber and communicates the upper valve chamber with the lower valve chamber. In addition, the cross intersection line region is further communicated to a plunger chamber of the fracturing pump. An axial direction of the plunger chamber is perpendicular to an axial direction of the valve chamber, and the plunger chamber and the valve chamber are respectively located in two directions of the cross intersection line region.

In the hydraulic end disclosed in this embodiment of the present application, a cross section of an outlet part, communicated to the upper valve chamber, in the cross intersection line region is elliptical, and the axial direction of the plunger chamber and the axial direction of the upper valve chamber are both perpendicular to a long axis of the outlet part. Namely, when liquid flows from the cross intersection line region to the upper valve chamber, a region where the liquid first passes is the foregoing outlet part, and an arc corresponding to the long axis of the foregoing outlet part is located on left and right sides of the cross intersection line region. This can relieve the concentrated stress at the position corresponding to the cross intersection line region and enhance the fatigue strength of the body 100.

Still further, a cross section of an inner cavity part, adjacent to the outlet part, of the cross intersection line region can be circular; and the outlet part and the inner cavity part are smoothly transitioned. Thus, it ensures that the cross intersection line region can still provide a large flowing area for the liquid. Correspondingly, a cross section of the inlet part, communicated to the lower valve chamber, in the cross intersection line region may be of an elliptical structure too, and a long axis of the inlet part can be perpendicular to the axial directions of the plunger chamber and the lower valve chamber, to ensure that the fatigue strength of the region, connected to the lower valve chamber, in the cross intersection line region is relatively high.

In addition, in the present application, in an axial direction of a valve seat 620, the valve seat 620 can be fully embedded into the valve chamber of the body 100. This can minimum wear of the valve seat 620 during the working of the hydraulic end, thereby preventing the valve seat 620 from cracking. In addition, to prolong the service life of the valve seat 620, the valve seat 620 can use a split structure design, which can include a seat body and a gasket. The gasket can be formed using a metal material with high hardness, such as tungsten carbide, or may be strengthened with a hardened layer, to ensure that the gasket has high structural strength. By using the gasket to cooperate with the valve, the service life of the valve seat 620 can be prolonged.

In addition, in the working process of the hydraulic end, due to the impact of a flowing direction of the liquid, a cavitation problem easily occurs in a region, facing the plunger chamber, in the inlet part, communicated to the lower valve chamber, in the cross intersection line region. Based on this, the hydraulic end disclosed in this embodiment of the present application embodiment may further include a protective support 700. The protective support 700 is located on one side of a lower valve (i.e. the valve 610 located below the hydraulic end) close to the upper valve, namely, at an outlet position, communicated to the lower valve chamber, in the cross intersection line region. Meanwhile, the protective support 700 includes a blocking part 710, and the blocking part 710 abuts against and blocks the region, facing the plunger chamber, in the inlet part, communicated to the lower valve chamber, of the cross intersection line region in the body 100, so that the blocking part 710 is used to provide a protective effect for a position, where cavitation easily occurs, in the cross intersection line region, which further prolonging the service life of the body 100.

Specifically, a specific shape and size of the blocking part 710 can be correspondingly designed according to a shape and size of the position, where cavitation easily occurs, in the cross intersection line region, which will not be limited herein. In addition, to ensure that the protective support 700 can be stably located in the inner cavity of the body 100, the protective support 700 and the body 100 further form a limited fit relationship in the axial direction of the plunger chamber of the body 100 and around the axial direction of the lower valve. Specifically, it can ensure that the protective support 700 can be stably fixed in the inner cavity of the body 100 by matching specific shapes of corresponding positions on both the protective support 700 and the body 100. In addition, the protective support 700 may further include a limiting pin 720. The limiting pin 720 is in plugging fit with a lower valve spring. On the one hand, the expansion and retraction reliability of the lower valve spring can be improved, and on the other hand, a bearing effect can be further provided for the protective support 700.

Based on the hydraulic end disclosed in any one of the above embodiments, the embodiments of the present application further provide a fracturing pump, including a reduction system, a power end, and any hydraulic end described above. The reduction system is connected to the hydraulic end through the power end. Certainly, the fracturing pump further includes other components such as a plunger. Considering the simplicity, the components will not be described in detail here.

Some example embodiments and features are described below with reference to FIGS. 7-47

Figure 7:
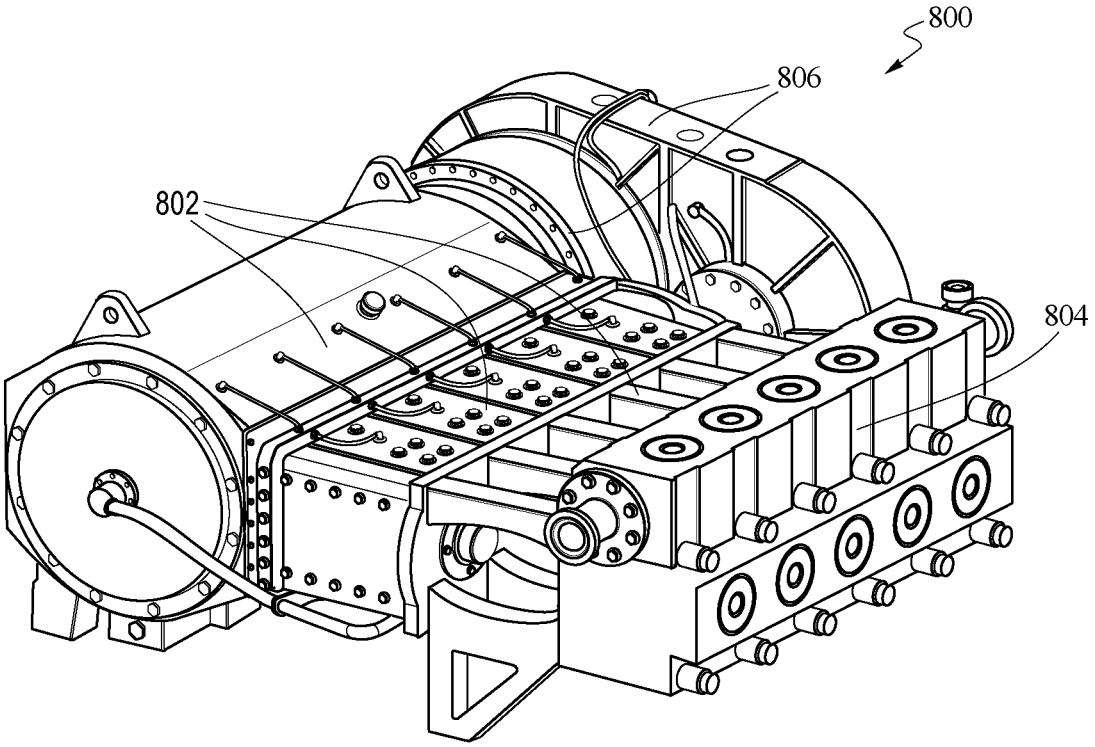
FIG. 7 is an illustration of a fracturing pump according to an embodiment of the present disclosure.
Figure 8:
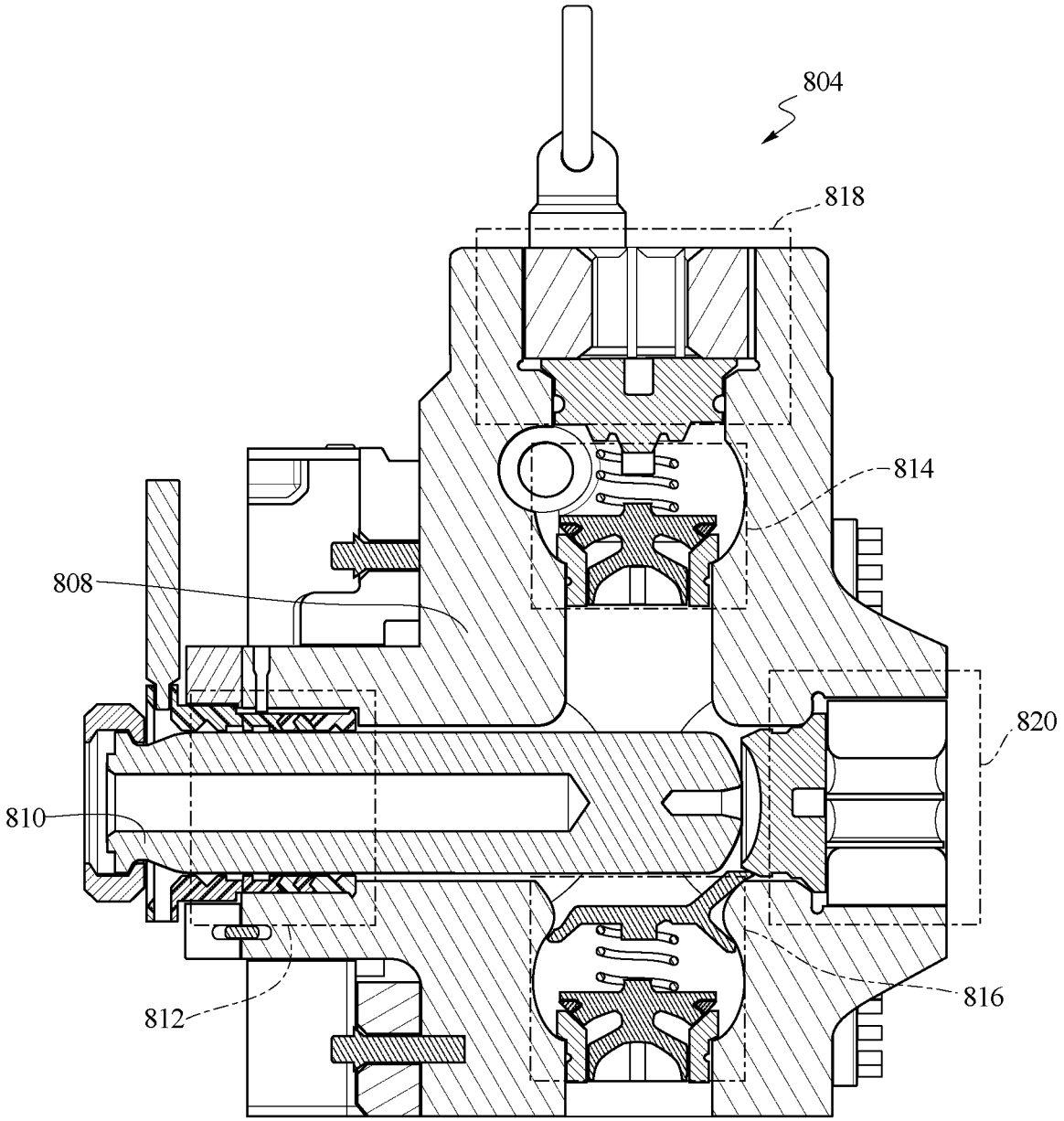
FIG. 8 is an illustration of a hydraulic end of a fracturing pump according to an embodiment of the present disclosure.

The fracturing pump 800 includes three major subsystems: the power end 802, the hydraulic end 804, and the gear reduction system 806 (e.g., see FIG. 7). Referring to FIG. 8, the conventional integrated hydraulic end includes the hydraulic end body 808, the plunger 810, the packing 812, the upper valve assembly 814, the lower valve assembly 816, the outlet end cover assembly 818, and the end cover assembly 820.

Figure 9:
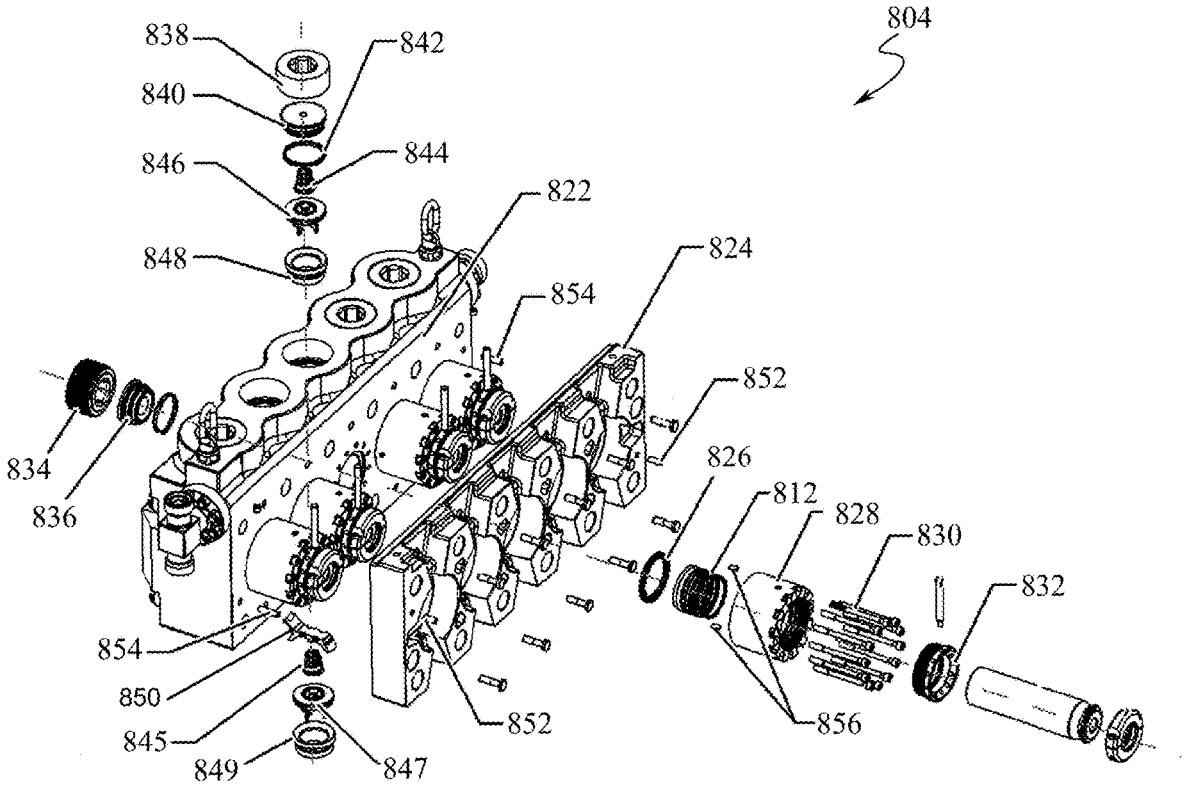
FIG. 9 is an illustration of a semi-split hydraulic end structure according to an embodiment of the present disclosure.

Some embodiments of split-type hydraulic end structures are described below:

Referring to FIG. 9, in some embodiments, in a semi-split hydraulic end structure, only the packing box is separate. As shown, in this embodiment, the hydraulic end 804 comprises the hydraulic end valve box 822, base plate 824, sealing gasket ring 826, packing 812, independent packing box 828, fixing screws/bolt 830, packing pressing cap 832, plunger 810, pressing cap 834, pressing cover 836, outlet pressing cap 838, outlet pressing cover 840, sealing ring 842, upper and lower valve springs 844 and 845, upper and lower valve body assemblies 846 and 847, upper and lower valve seat assemblies 848 and 849, spring support 850, and positioning pin(s), among other components. The advantage of this embodiment is to at least reduce the cost of forging materials for the hydraulic end body, reduce processing costs, improve the local stress structure, and enhance structural fatigue strength. At least one positioning pin 852 on each side is used to connect the power end for positioning, ensuring that the plunger chambers in the hydraulic end and power end are aligned coaxially one-to-one, respectively. At least one positioning pin 854 one each side is used to ensure that the base plate cavity and the valve box corresponding cavity are coaxial within a reasonable range. Each independent packing box 828, on its surface that is facing the valve box 822, has at least two corresponding pin holes for installing positioning pins 856. The positioning pins 856 connect the independent packing box 828 and the hydraulic end valve box 822, ensuring that the cavity of the independent packing box 828 is coaxial with the corresponding cavity of the valve box 822 within a reasonable range.

Figure 10:
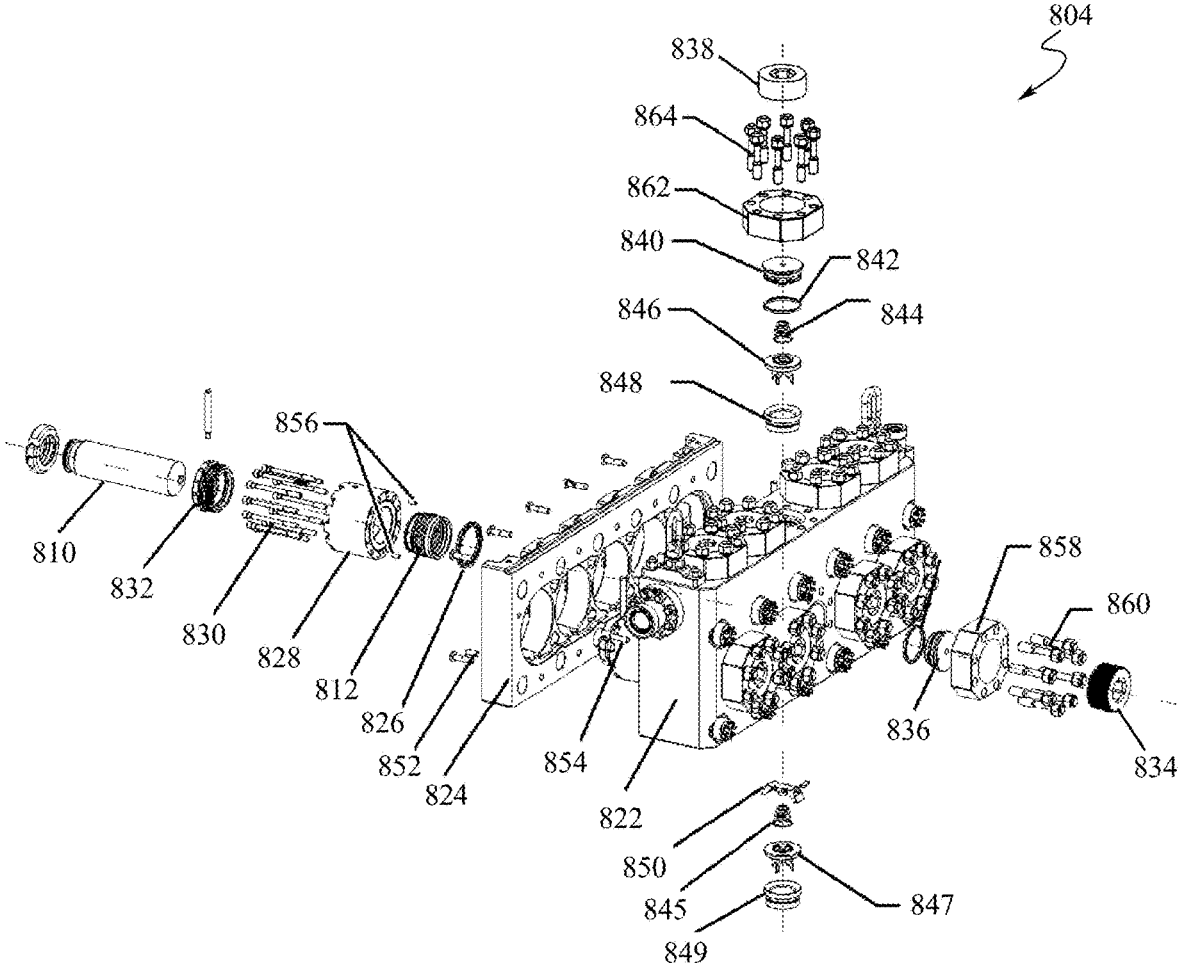
FIG. 10 is an illustration of a fully split hydraulic end structure according to an embodiment of the present disclosure.

Referring to FIG. 10, in some embodiments, in a fully split hydraulic end structure, in addition to split the packing box, discussed with reference to FIG. 9, the internal threaded portions of the valve box 822 configured to connect with the pressing cap 834 and the outlet pressing cap 838 are also split independently. As shown, in this embodiment, the hydraulic end 804 comprises a hydraulic end valve box 822, a base plate 824, a sealing gasket ring 826, a packing 812, an independent packing box 828, a set of fixing screw/bolt 830, a packing pressing cap 832, a plunger 810, an pressing cap 834, an pressing cap fixing seat 858, an pressing cap fixing seat stud assembly 860, an pressing cover 836, an outlet pressing cap 838, an outlet pressing cap fixing seat 862, an outlet pressing cap fixing seat stud assembly 864, an outlet pressing cover 840, a sealing ring 842, upper and lower valve springs 844 and 845, upper and lower valve body assemblies 846 and 847, upper and lower valve seat assemblies 848 and 849, a spring support 850, and positioning pin(s) and other components. The advantage of this embodiment is to at least save the cost of the forging material of the hydraulic end body, to save the processing cost, to improve the local stress structure, to improve the structural fatigue strength, and etc. At least one positioning pin 852 on each side is used to connect the power end for positioning, ensuring that the plunger chambers in the hydraulic end and power end are aligned coaxially one-to-one, respectively. At least one positioning pin 854 one each side is used to ensure that the base plate cavity and the valve box corresponding cavity are coaxial within a reasonable range. Each independent packing box 828, on its surface that is facing the valve box 822, has at least two corresponding pin holes for installing positioning pins 856. The positioning pins 856 connect the independent packing box 828 and the hydraulic end valve box 822, ensuring that the cavity of the independent packing box 828 is coaxial with the corresponding cavity of the valve box 822 within a reasonable range.

Figure 11:
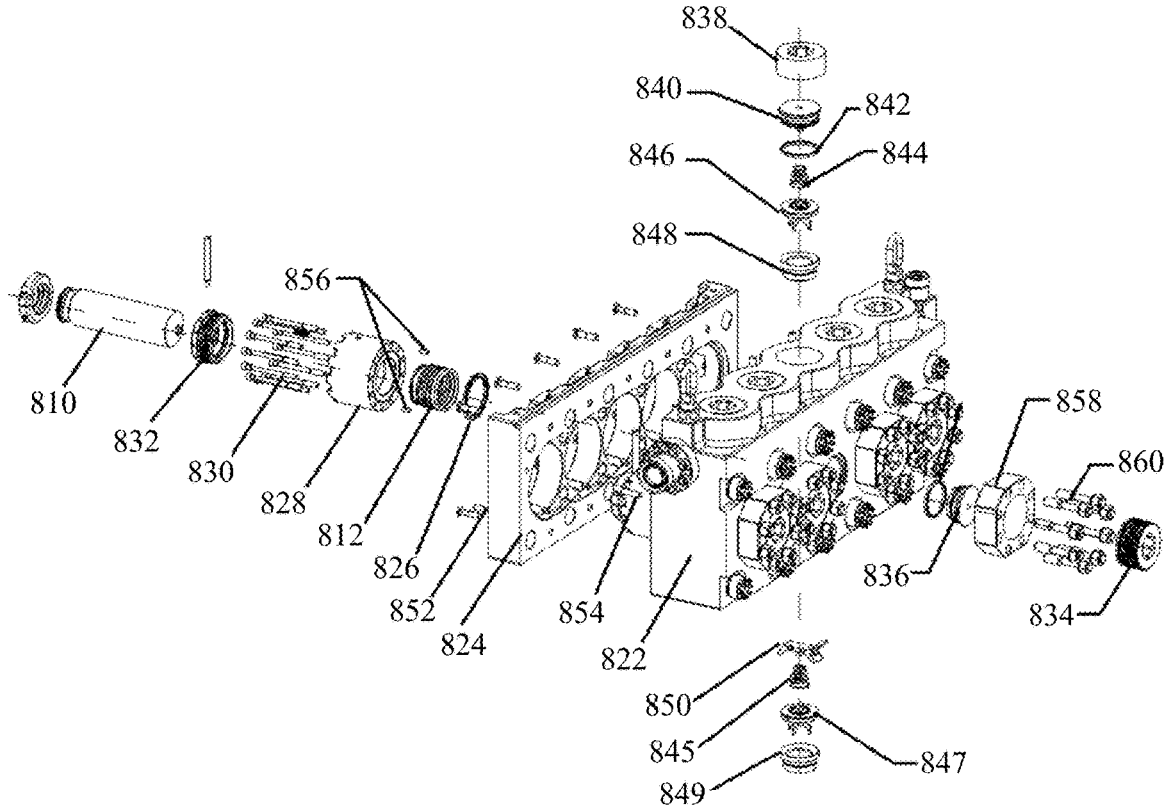
FIG. 11 is an illustration of another fully split hydraulic end structure according to an embodiment of the present disclosure.

Referring to FIG. 11, in some embodiments, in a fully split hydraulic end structure, i.e. in addition to splitting the packing box, only the inner threaded part of the valve box that is configured to connect with the pressing cap is split independently, where the internal threaded part of the valve box that is configured to connect with the outlet pressing cap is not separated from the valve box body. In this embodiment, the hydraulic end comprises the valve box 822, base plate 824, sealing gasket ring 826, packing 812, independent packing box 828, fixing screw/bolt 830, packing pressing cap 832, plunger 810, pressing cap 834, pressing cap fixing seat 858, pressing cap fixing seat stud assembly 860, pressing cover 836, outlet pressing cap 838, outlet pressing cover 840, sealing ring 842, upper and lower valve springs 844 and 845, upper and lower valve body assemblies 846 and 847, upper and lower valve seat assemblies 848 and 849, spring support 850 and positioning pin(s), and other parts and components. The advantage of this embodiment is to at least save the cost of the forging material of the hydraulic end body, to save the processing cost, to improve the local stress structure, to improve the structural fatigue strength, and etc. At least one positioning pin 852 on each side is used to connect the power end for positioning, ensuring that the plunger chambers in the hydraulic end and power end are aligned coaxially one-to-one, respectively. At least one positioning pin 854 one each side is used to ensure that the base plate cavity and the valve box corresponding cavity are coaxial within a reasonable range. Each independent packing box 828, on its surface that is facing the valve box 822, has at least two corresponding pin holes for installing positioning pins 856. The positioning pins 856 connect the independent packing box 828 and the hydraulic end valve box 822, ensuring that the cavity of the independent packing box 828 is coaxial with the corresponding cavity of the valve box 822 within a reasonable range.

The advantages of the above embodiments: the fragile threads of the valve box can be removed from the valve box, where the threads may be made of low-cost materials that can be replaced if damaged. This enables a "replace only the damaged part" approach, avoiding the need to replace the entire valve box due to damage to a single thread or cavity, thereby reducing costs for users and extending the service life of the valve box. In some embodiments, the connection part between the valve box and the spacer frame is replaced with a low-cost gray iron casting base plate, reducing weight and further lowering costs. The valve box uses less material, resulting in lower overall costs.

Figure 12:
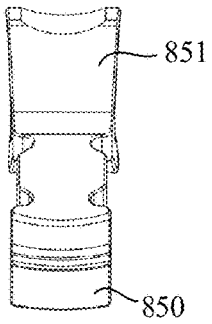
FIGS. 12 and 13 are illustrations of a spring support with a "wide ear" structure according to an embodiment of the present disclosure.
Figure 13:
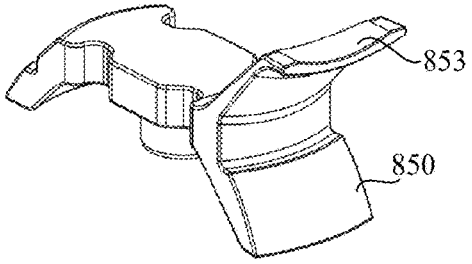
Figure 14:
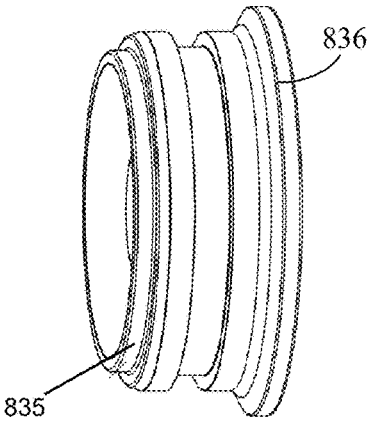
FIG. 14 is an illustration of a pressing cover according to an embodiment of the present disclosure.
Figure 15:
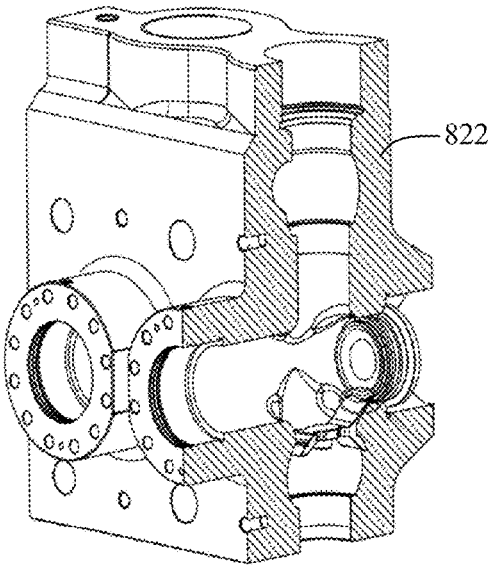
FIGS. 15 and 16 are illustrations showing a pressing cover installed on a valve box according to an embodiment of the present disclosure.
Figure 16:
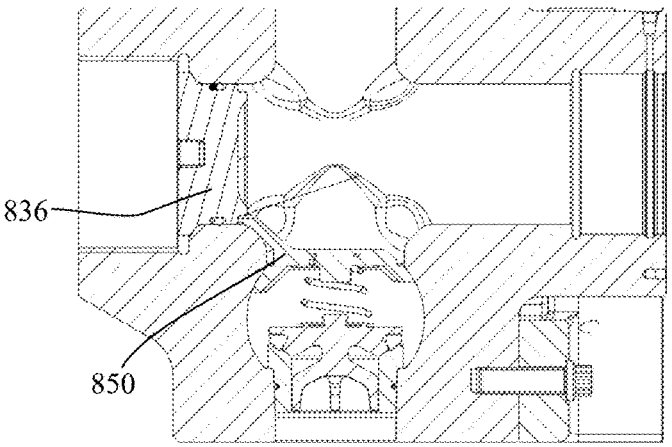

In some embodiments, referring to FIGS. 12-16, the spring support 850 has a "wide ear" structure 851, where the top of one end of the "wide ear" structure is configured to have a curved structure 853 (e.g., as shown in FIGS. 12 and 13). In some embodiments, as shown in FIG. 14, The pressing cover 836 is configured with a ring groove structure 835 at one end. In some embodiments, as shown in FIGS. 15 and 16, after the spring support 850 and the pressing cover 836 are installed on the valve box 822, a ring-shaped space is formed. The curved structure 853 of the "wide ear" structure 851 of the spring support 850 extends into this space, with a clearance of 0-10 mm, forming a curved surface matching, thereby limiting the rotation of the spring support around the axis of the spring support.

Figure 17:
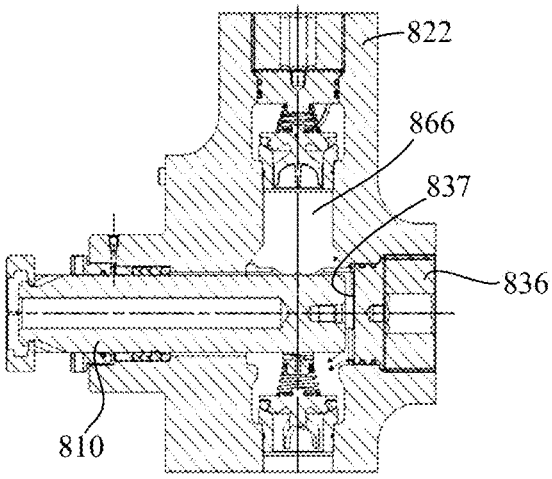
FIGS. 17 and 18 are illustrations showing the structures of existing pressing cover and plunger.
Figure 18:
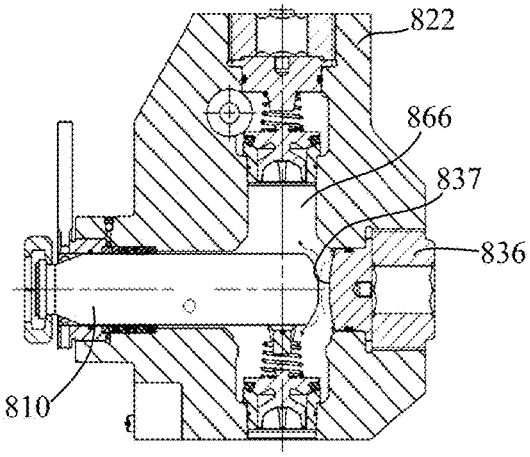
Figure 19:
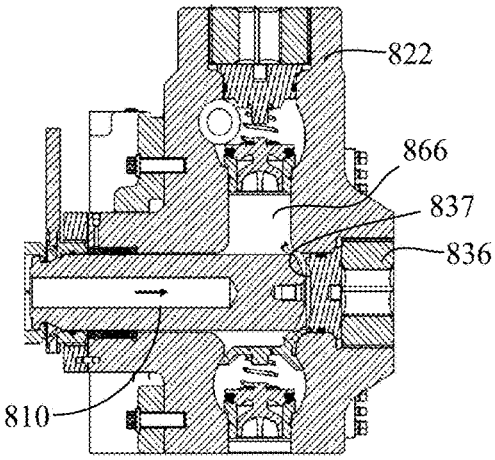
FIG. 19 is an illustration showing the structures of a pressing cover and a plunger according to an embodiment of the present disclosure.
Figure 20:
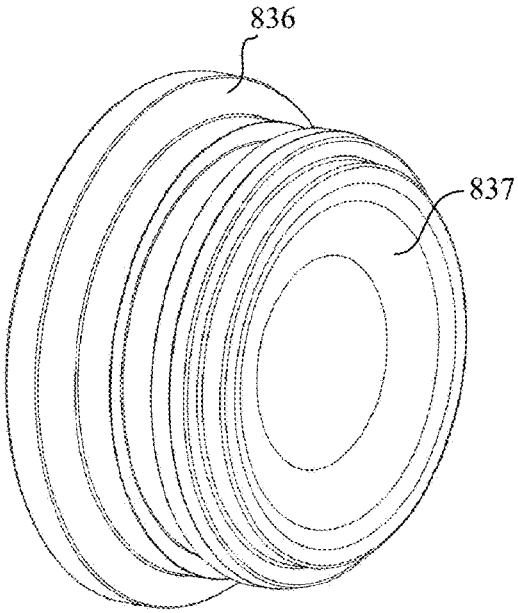
FIG. 20 is an illustration of a pressing cover according to an embodiment of the present disclosure.

Referring to FIGS. 17 and 18, the end surface 837 of the existing pressing cover 836 facing the cavity 866 of the valve box 822 is mostly flat or convex. When the plunger 810 impacts the liquid, part of the high-pressure and high-speed fluid will impact the intersection line of the valve box 822, causing fatigue and cracks at this location. Referring to FIGS. 19 and 20, in some embodiments, in the present disclosure, the end surface 837 of the pressing cover 836 facing the cavity 866 of the valve box 822 is configured with a concave or curved surface (e.g., as shown in FIG. 20), which can divert the hydraulic force generated by the plunger impact, thereby reducing the impact of high-speed fluid on the valve box cavity (e.g., as shown in FIG. 19).

Figure 21:
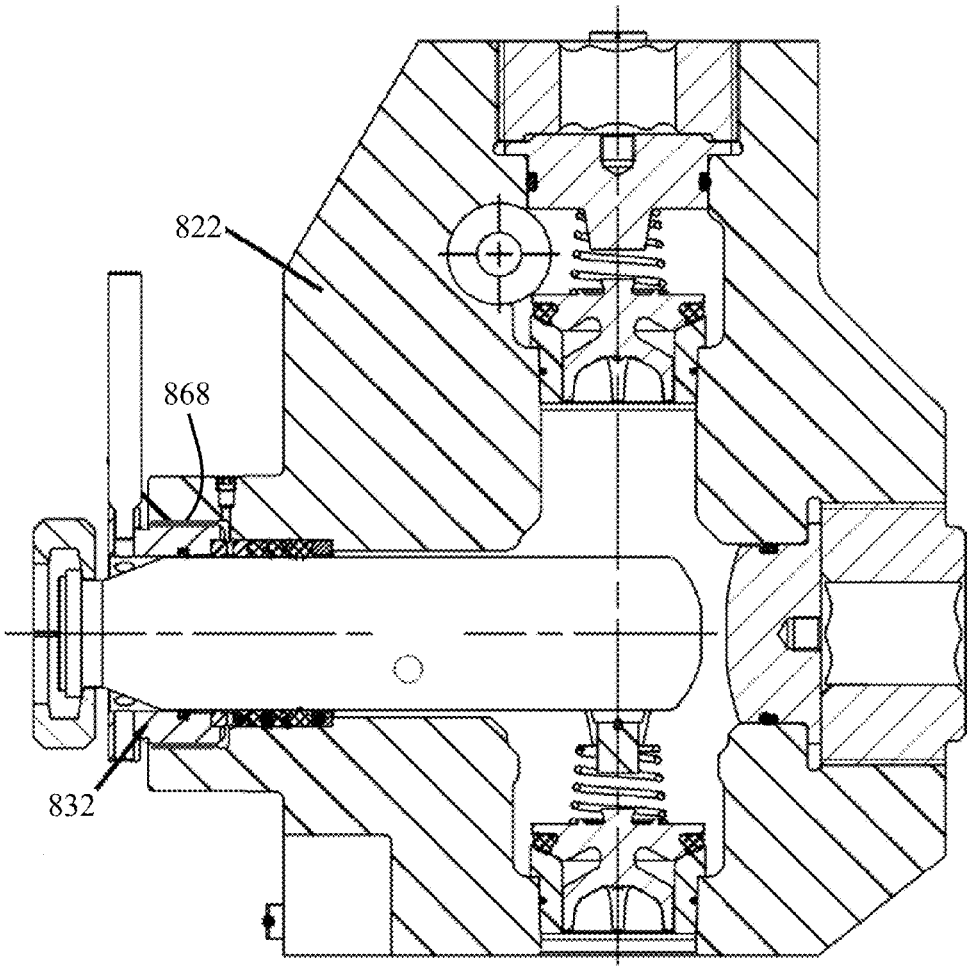
FIG. 21 is an illustration showing a packing assembly of an integral type hydraulic end.

Generally, a packing assembly of an integral type hydraulic end primarily comprises a packing pressing cap 832, a packing box pressing cap integrated with the valve box body 822, connecting screw(s), and positioning pin(s) (optional in matching-surfaces type connection) (e.g., as shown in FIG. 21). In the present disclosure, in addition to separating the end cover/pressing cover 836 and packing from the hydraulic end body, further separates the threads 868 of the hydraulic end body configured to connect with the packing pressing cap 832 from the hydraulic end body. This prevents damage to the valve box body threads, thereby avoiding the need to replace the hydraulic end body and reducing maintenance costs.

Figure 22:
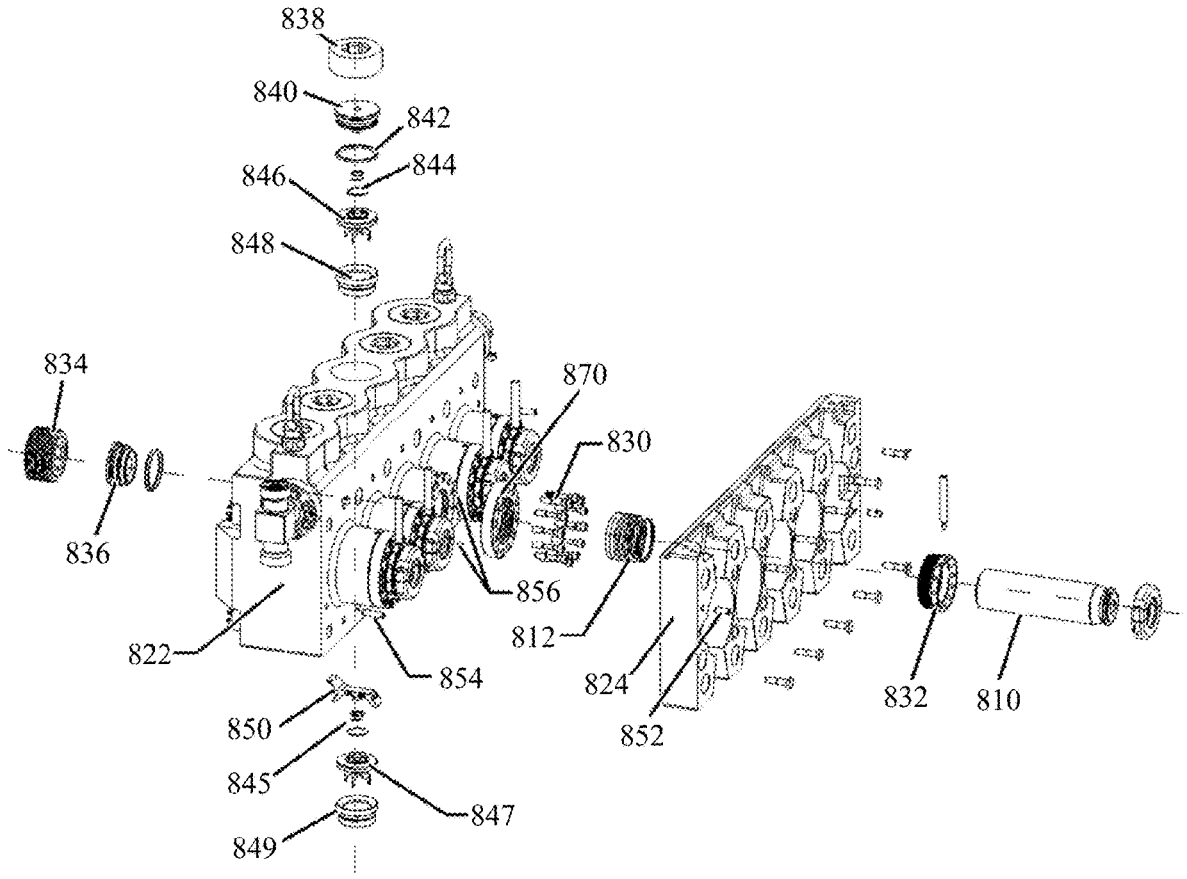
FIGS. 22-24 are illustrations showing a packing assembly of a hydraulic end according to an embodiment of the present disclosure.
Figure 23:
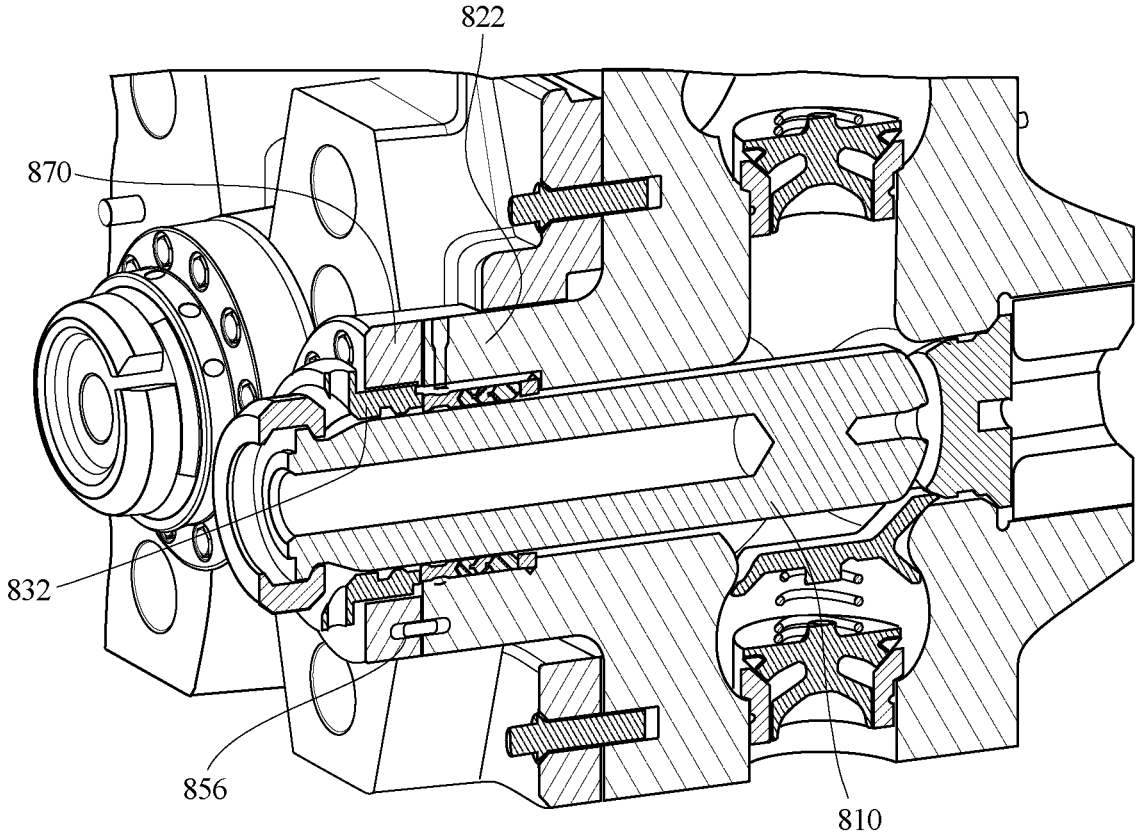
Figure 24:
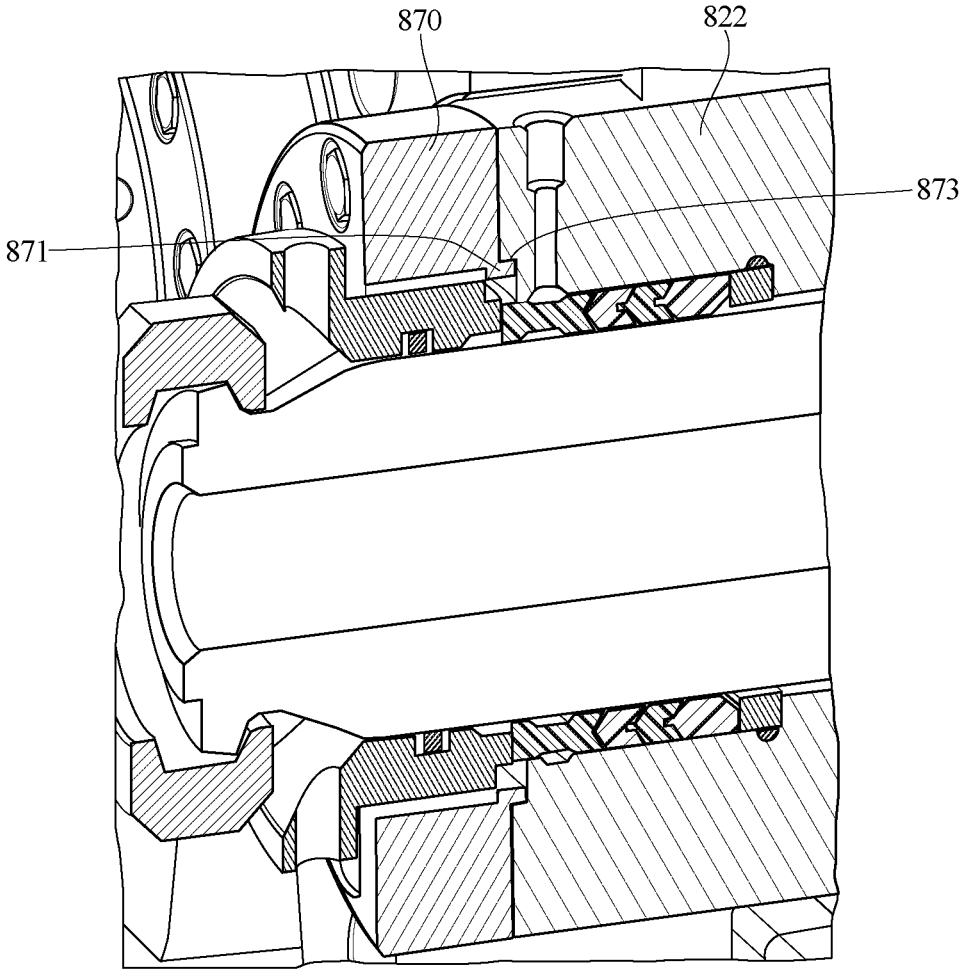

Referring to FIGS. 22-24, in some embodiments, the internal threads of the valve box configured to connect with the packing pressing cap is separated into a new component—the packing box pressing cap. In this embodiment, the hydraulic end comprises the hydraulic end valve box 822, base plate 824, packing 812, packing box pressing cap 870, fixing screw(s)/bolt(s) 830, packing pressing cap 832, plunger 810, pressing cap 834, pressing cover 836, outlet pressing cap 838, outlet pressing cover 840, seal ring 842, upper and lower valve springs 844 and 845, upper and lower valve body assemblies 846 and 847, upper and lower valve seat assemblies 848 and 849, spring support 850, and positioning pin(s), among other components. The base plate 824 is configured to reduce the cost of forging materials for the hydraulic end body and minimize processing costs. At least one positioning pin 852 on each side is used to connect the power end for positioning, ensuring that the plunger chambers in the hydraulic end and power end are aligned coaxially one-to-one, respectively. At least one positioning pin 854 one each side is used to ensure that the base plate cavity and the valve box corresponding cavity are coaxial within a reasonable range.

The separated packing box pressing cap 870 is connected to the valve box body 822: in the circumferential direction of the packing box pressing cap 870, there are at least two positioning pin holes, and the corresponding positioning pin holes are added at the corresponding positions of the corresponding valve box 822 matching surface. On the matching surface of the valve box body 822 facing the packing box pressing cap 870, there are multiple threaded holes on the circumference, and the packing box pressing cap 870 has multiple through holes in the corresponding positions. The packing box pressing cap 870, the pin hole(s) and the valve box body 822 are fixed together by screw(s) or bolt(s) (e.g., as shown in FIG. 22). The positioning pin(s) 856 can ensure the coaxiality of the center of the packing box pressing cap cavity and the center of the corresponding cavity of the valve box, reducing or avoiding the eccentricity of the plunger and the packing which may cause the packing to wear and prematurely damage. In addition to the pin structure that can realize the above functions, in some embodiments, the concave and convex surfaces can be used to realize the coaxiality of the plunger 810 and the packing pressing cap 832 connected with the separated packing box pressing cap thread. For example, as shown in FIG. 24, the packing box pressing cap 870 may have a convex stopper 871, which is matched with a concave stopper 873 of the valve box body 822. In some embodiments, the packing box pressing cap 870 may have a concave stopper, which is matched with a convex stopper of the valve box body 822.

Figure 25:
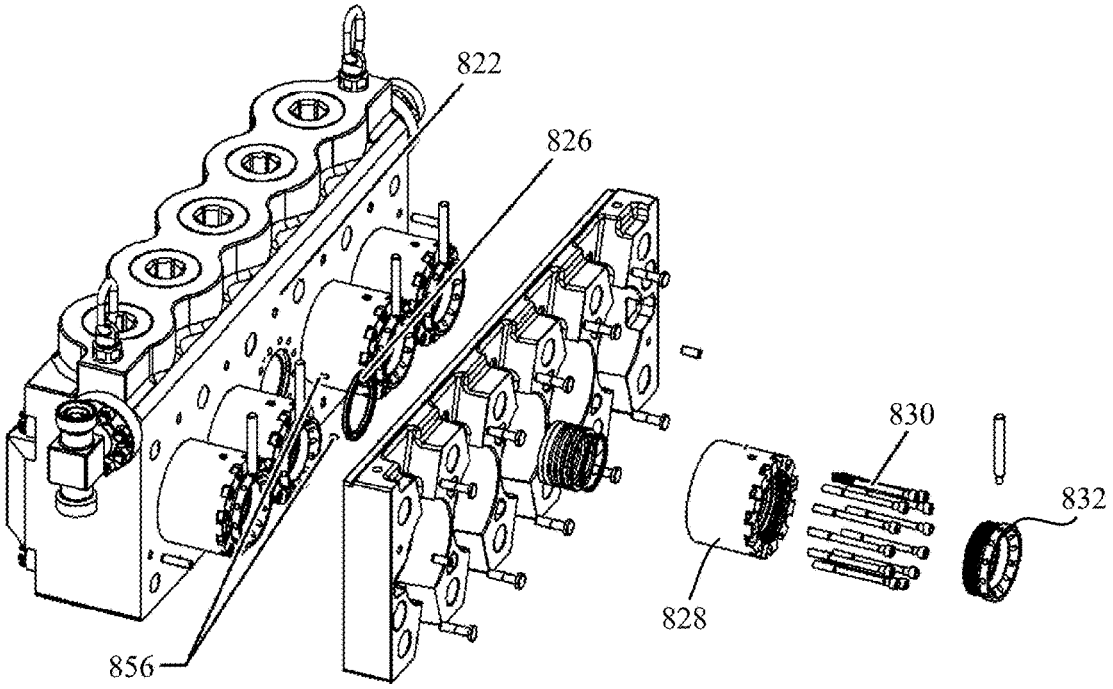
FIGS. 25 and 26 are illustrations showing another packing assembly of a hydraulic end according to an embodiment of the present disclosure.
Figure 26:
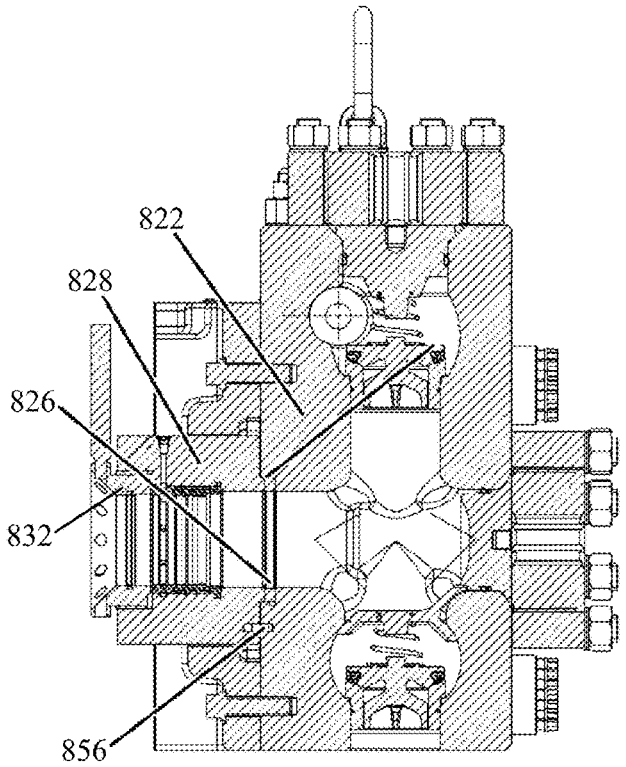

In some embodiments, referring to FIGS. 25 and 26, in the split-type hydraulic end structure, the cavity configured to receive the packing and the threads configured to connect with the packing pressing cap in the hydraulic end valve box are separated from the valve box as a separate component—the independent packing box 828. The first/front end of the independent packing box 828 contacts the outer side of the sealing gasket ring 826, while its second/rear end contacts the packing pressing cap 832. The inner side of the sealing gasket ring 826 contacts the hydraulic end valve box. On the connecting surfaces between the hydraulic end valve box 822 and the independent packing box 828, there are at least one pair of corresponding pin holes. Each pin hole is equipped with a positioning pin 856, ensuring that the corresponding cavities of the independent packing box 828 and the hydraulic end valve box 822 are coaxial, thereby reducing or eliminating wear caused by eccentricity between the plunger and the packing, which would otherwise shorten the service life of the packing. On the surface of the hydraulic end valve box 822 mating with the independent packing box 828, a plurality of threaded holes are formed around the circumference. Bolt holes are formed at the corresponding positions of the packing box. After the positioning pins 856 are installed into the pin holes, the packing box, pin holes, and valve box body 822 are secured together using multiple screws or bolts 830 (e.g., as shown in FIG. 25), causing the independent packing box 828 to clamp the sealing gasket ring 826 under the axial force of the screws or bolts 830, thereby achieving a sealing effect.

The positioning pin(s) 856 can ensure the coaxiality of the plunger and the packing pressing cap 832 connected with the separated packing box threads, reducing or avoiding the wear caused by the eccentricity of the plunger and the packing pressing cap 832. In addition to the pin structure to achieve the above functions, the concave and convex surfaces can be used to achieve the coaxiality of the plunger and the independent packing box connected with the hydraulic end valve box cavity. For example, in some embodiments, as shown in FIG. 26, the packing box 828 can also have a concave stopper, which is matched with a convex stopper of the valve box body 822.

Figure 27:
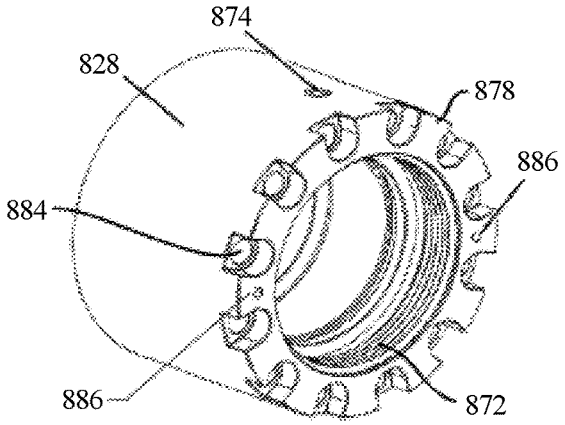
FIGS. 27 and 28 are illustrations showing an independent packing box of a packing assembly according to an embodiment of the present disclosure.
Figure 28:
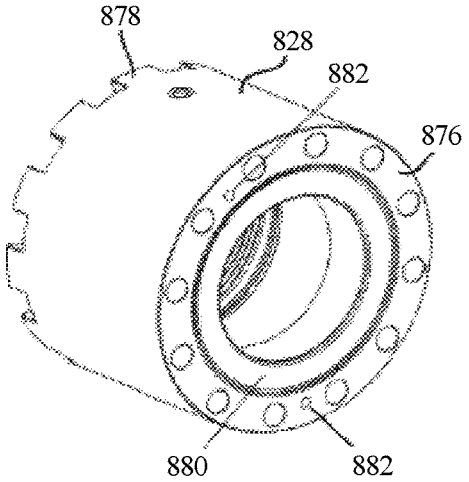

Referring to FIGS. 27-28, in some embodiments, the independent packing box 828 is cylindrical in shape, or at least a part of it is cylindrical, and the outer cylindrical surface has an opening thread 872+through hole 874 structure, which is used to connect the external grease or oil injection joint.

In some embodiments, as shown in FIGS. 27 and 28, the end face 876 of the independent packing box 828 that is close to the valve box is configured to have a sealing annular surface 880 for fitting the sealing gasket ring 826. This end face 876 is also configured to have at least two positioning pin holes 882 for installing the positioning pins, thereby ensuring that the internal cavity axis of the independent packing box 828 and the corresponding cavity axis of the valve box are coaxial. The outer end face 878 of the independent packing box 828 that is away from the valve box has multiple holes 884 on the circumference, which are configured for inserting fixing screws or bolts. The multiple holes 884 can be through holes, countersunk holes or circular countersunk holes, or they can be open countersunk holes (e.g., as shown in FIG. 27). The outer end face 878 of the independent packing box 828 that is away from the valve box also has one or more threaded holes 884 for hoisting or installing other components.

Figure 29:
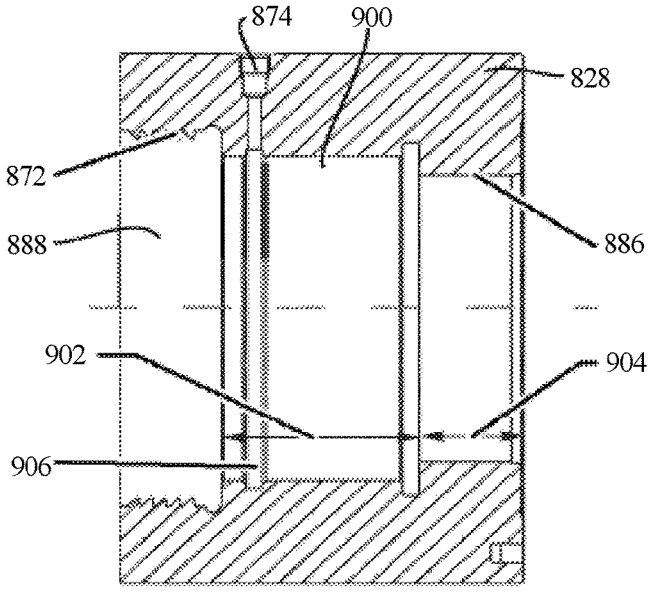
FIG. 29 is an illustration showing another independent packing box of a packing assembly according to an embodiment of the present disclosure.

Referring to FIG. 29, in some embodiments, the internal cavity of the independent packing box 828 has multiple cavities of different diameters. When installed, the first inner cavity 886 of the independent packing box 828 that is close to the hydraulic end valve box is the plunger cavity 886 configured to accommodate the plunger; the second inner cavity 888 of the independent packing box 828 that is away from the hydraulic end valve box is the threaded cavity 888 configured to install the packing pressing cap 832; the middle cavity 900 between the first inner cavity 886 and the second inner cavity 888 is the packing cavity 900 configured to accommodate the packing. The packing includes a spacer ring, a soft packing, a hard packing, a pressing ring and other component(s). The relationship between the diameters of the three cavities inside the independent packing box is: the minor diameter of the threaded cavity 888>the diameter of the packing cavity 900>the diameter of the plunger cavity 886. The straight length 902 of the packing cavity 900 is less than twice the length 904 of the plunger cavity 886. An annular groove 906 is arranged at the grease/oil injection port 874 on the inner wall of the packing cavity 900, which is configured to store oil/grease.

Figure 30:
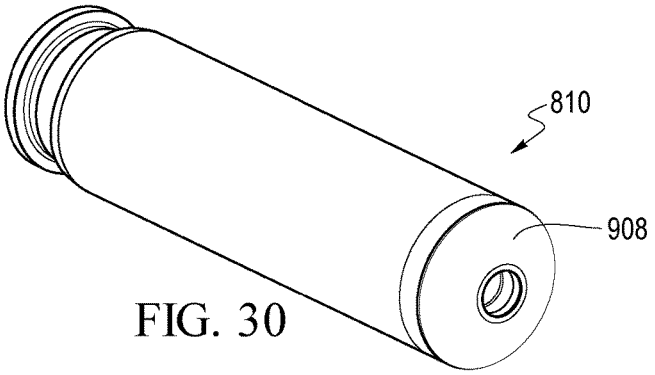
FIG. 30 is an illustration showing a plunger according to an embodiment of the present disclosure.

In some embodiments, as shown in FIG. 30, the end surface 908 of the plunger 810 is configured to have a conical surface or an arc surface, which can increase the stability of the plunger during movement and reduce the risk of eccentricity.

Figure 31:
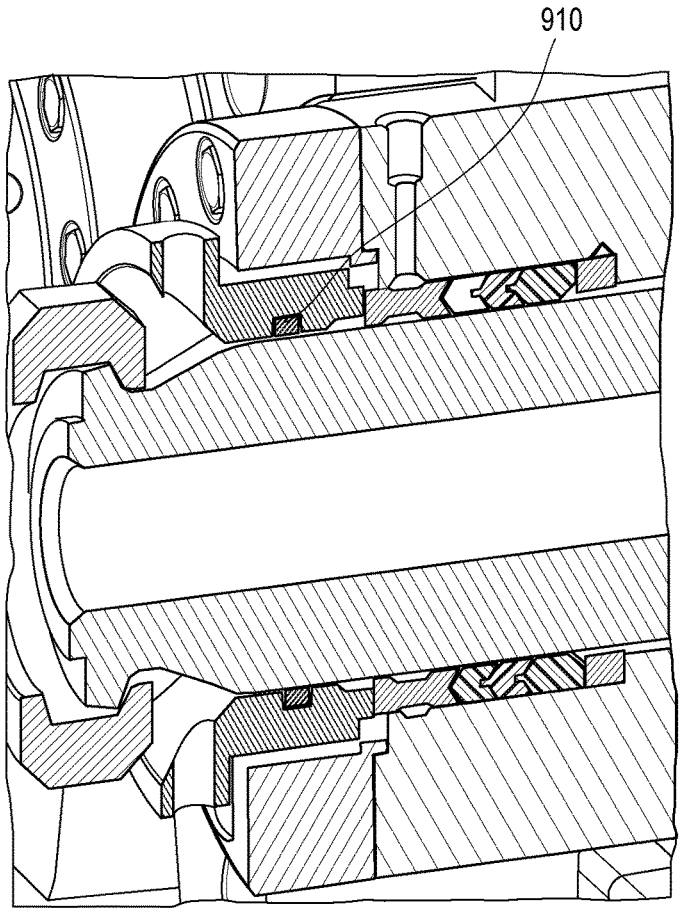
FIG. 31 is an illustration showing an oil ring in a conventional packing assembly.
Figure 32:
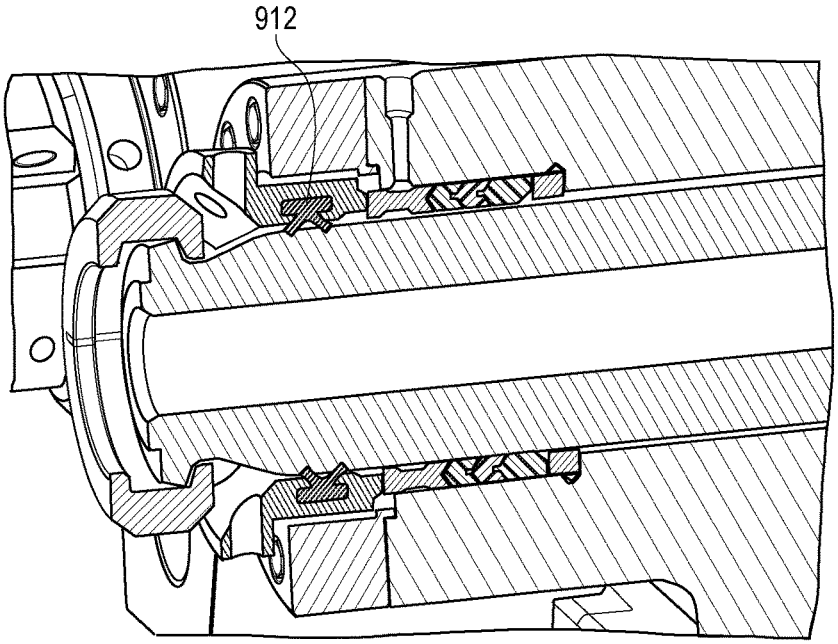
FIG. 32 is an illustration showing an oil ring according to an embodiment of the present disclosure.
Figure 33:
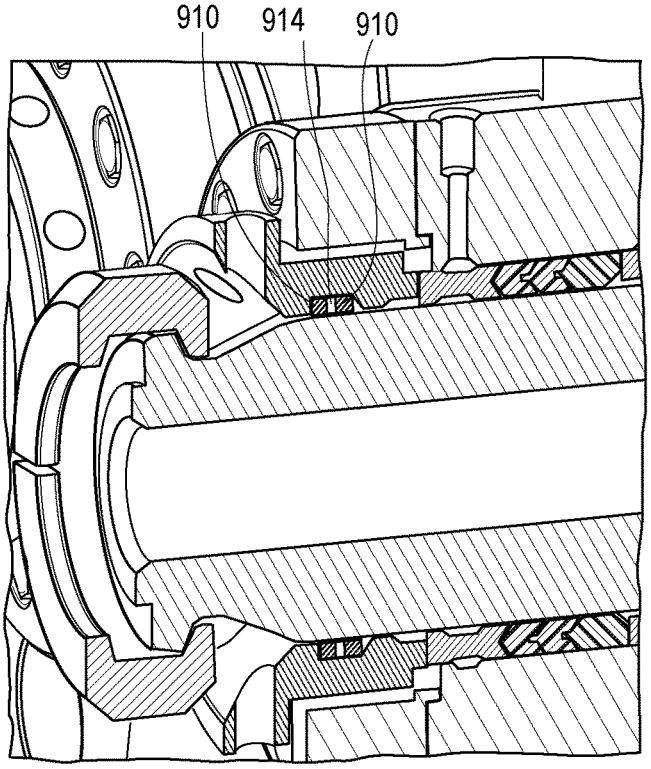
FIG. 33 is an illustration showing another oil ring according to an embodiment of the present disclosure.

Referring to FIG. 31, the lip of the oil ring 910 in a conventional packing assembly is generally positioned toward the inner side of the valve box cavity to seal the oil. In some embodiments of the present disclosure, an oil ring 912 with a double lip structure (e.g., as shown in FIG. 32) is used, which can prevent external dust, sand and other impurities from entering the cavity and prevent the leakage of internal oil or grease, and can effectively reduce the amount of oil or grease used and the probability of damage to the packing and plunger. In some embodiments of the present disclosure, two single-sided lip oil rings 910 may be used, installed back to back or with a spacer ring or segment 914 added in the middle of the back-to-back installation (e.g., as shown in FIG. 33), to achieve the same function as an oil ring 912 with a double lip structure.

Figure 34:
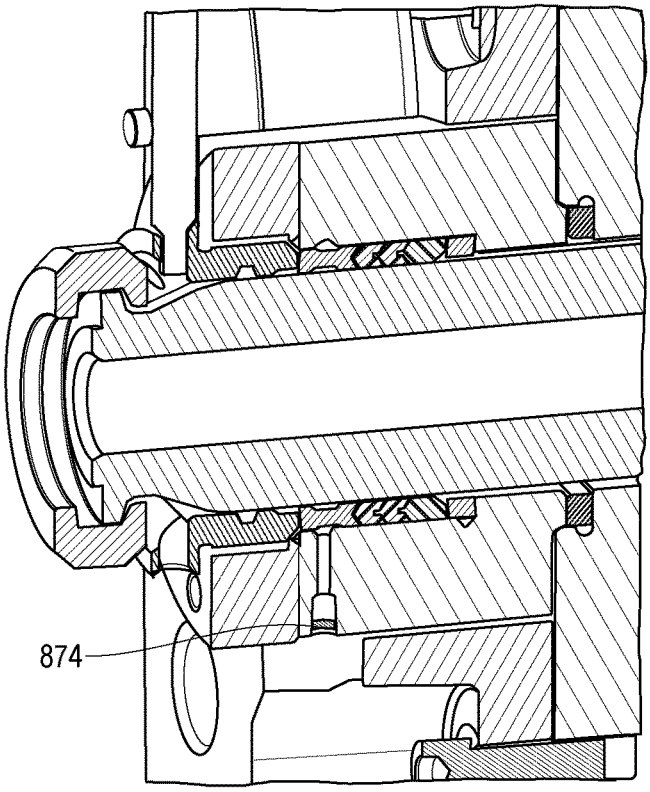
FIG. 34 is an illustration showing an oil/grease inlet according to an embodiment of the present disclosure.

Conventional packing lubrication is oil/grease inlet from the top. In some embodiments of the present disclosure, as shown in FIG. 34, another packing lubrication method is used, which is oil/grease inlet 874 from the bottom. The bottom grease inlet can make the bottom of the cavity filled with grease first, and then gradually rise to fill the entire lubrication cavity. In the process, the air in the cavity can be gradually squeezed out, and the exhaust is fast and thorough.

Figure 35:
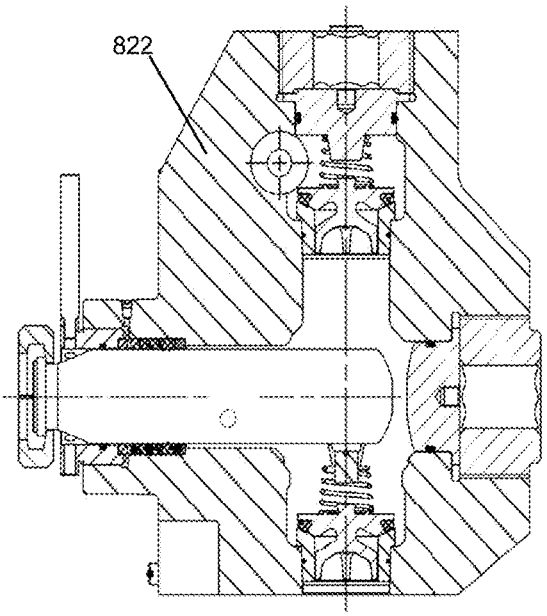
FIG. 35 is an illustration showing a conventional one-piece hydraulic end body.
Figure 36:
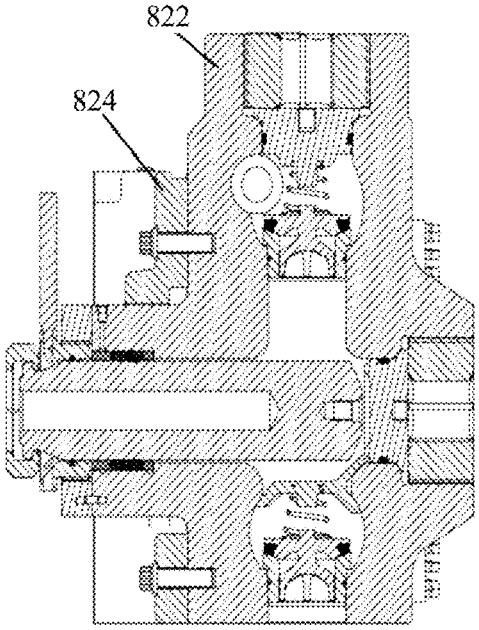
FIG. 36 is an illustration showing a hydraulic end body according to an embodiment of the present disclosure.

The conventional one-piece hydraulic end body is thickened and connected to the rear spacer frame (e.g., as shown in FIG. 35). In some embodiments of the present disclosure, the new structure separates part of the materials that connects the valve box body and the spacer frame from the conventional one-piece hydraulic end body, and makes it an independent base plate 824 (e.g., as shown in FIG. 36). The base plate 824 is processed with a relatively low-cost material, which can be machined with carbon structural steel such as Q235 and Q355, or cast with gray iron, cast iron, stainless steel, etc. The advantage is to save the cost of forging materials for the hydraulic end body, save processing costs, etc.

Figure 37:
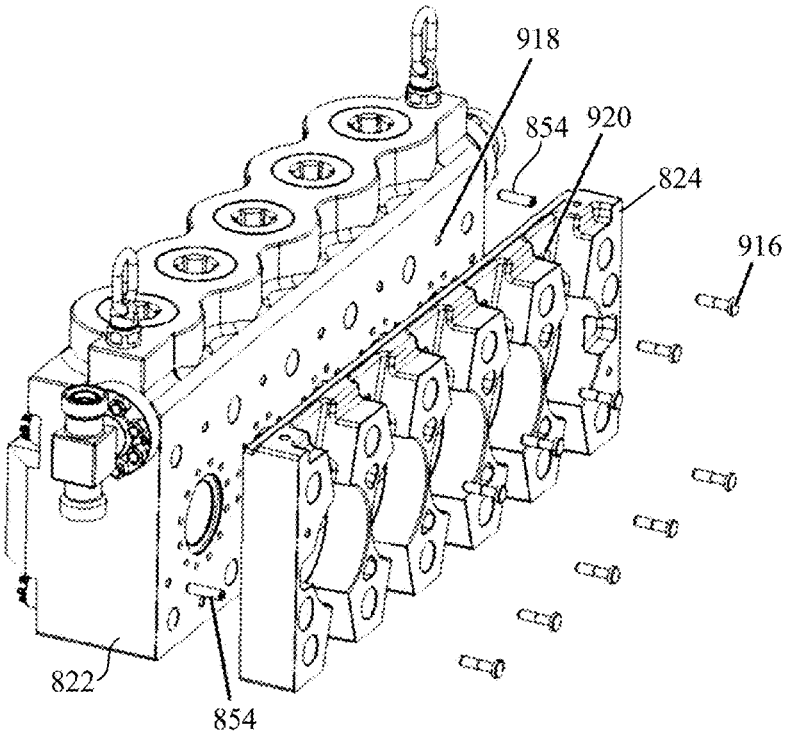
FIG. 37 is an illustration showing a first method of attaching the base plate to the valve box according to an embodiment of the present disclosure.

Referring to FIG. 37, in some embodiments, the base plate 824 is attached to the back of the hydraulic end 822, and at least a part of the base plate 824 is not flush with the valve box 822. There are corresponding positioning pin holes between the base plate 824 and the valve box 822 (e.g., the positioning pin hole 918 on the valve box 822 and the corresponding positioning pin hole 920 on the base plate 824, as shown in FIG. 37). Before installation, the positioning pins 854 are installed in the pin holes (e.g., the pin holes on the valve box), and then the corresponding holes (e.g., the holes on the base plate 824) are aligned with the positioning pins. The positioning pins 854 can ensure that the base plate cavity is coaxial with the corresponding cavity of the valve box. After the base plate 824 and the valve box 822 are attached, they are fixed with multiple non-threaded pins 916 to prevent them from coming off.

Figure 38:
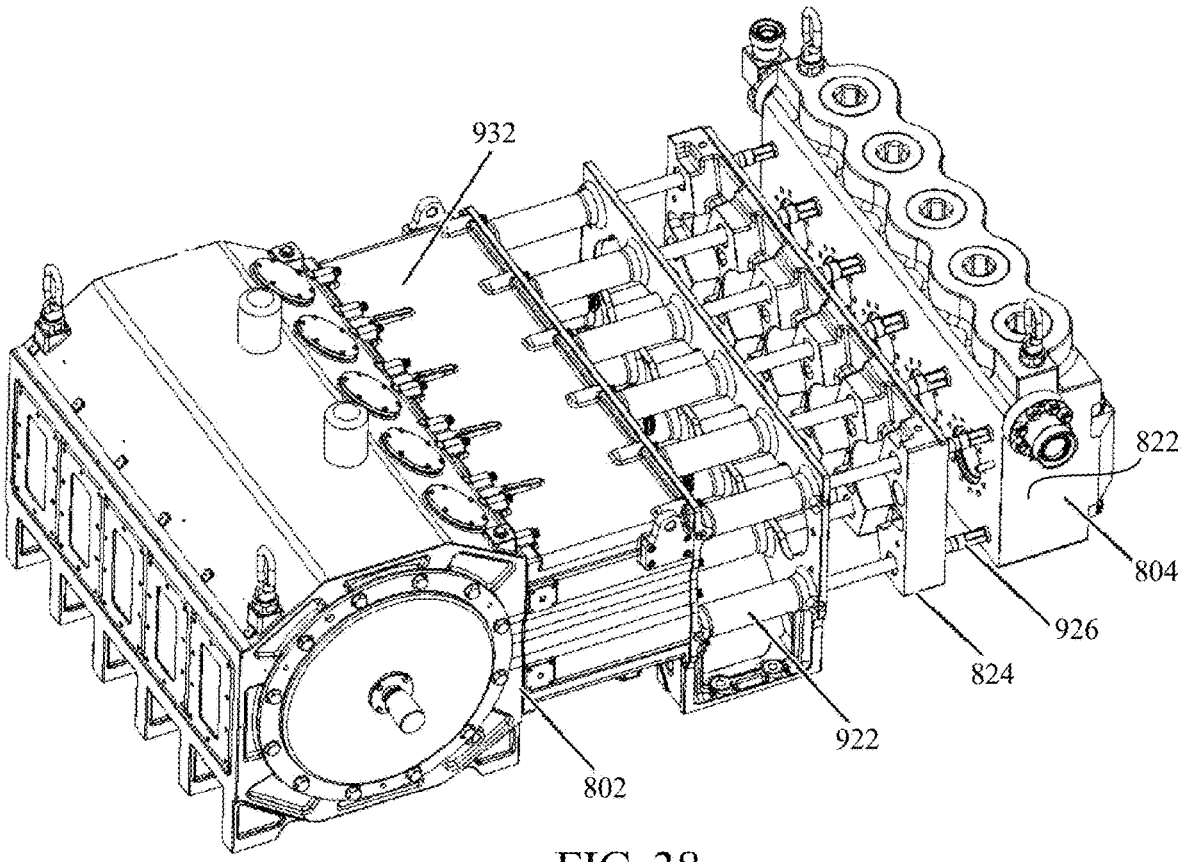
FIG. 38 is an illustration showing a second method of attaching the base plate to the valve box according to an embodiment of the present disclosure.

Referring to FIG. 38, another solution can be used to connect the base plate 824 and the valve box 822. The base plate 824 and the valve box 822 do not have one-to-one corresponding holes, and a plurality of long studs are used to clamp the base plate 824 between the hydraulic end 804 and the power end 802. The front end surface of the base plate 824 fits with the hydraulic end 804, and the rear end surface fits with the front end surface of the power end assembly 802. At least a portion of the upper, lower, left, and right sides of the base plate 824 do not fit flush with the valve box 822. There are corresponding positioning pin holes between the base plate 824 and the valve box 822. Before installation, the positioning pins are installed in the pin holes, and then the corresponding holes of the base plate 824 are aligned and fit with the positioning pins. The positioning pins can ensure that the center lines of the base plate cavity and the corresponding cavity of the valve box 822 are coaxial. After the base plate 824 and the valve box 822 are fitted together, a plurality of long studs are used to clamp the base plate 824 between the hydraulic end 804 and the power end 802.

Figure 39:
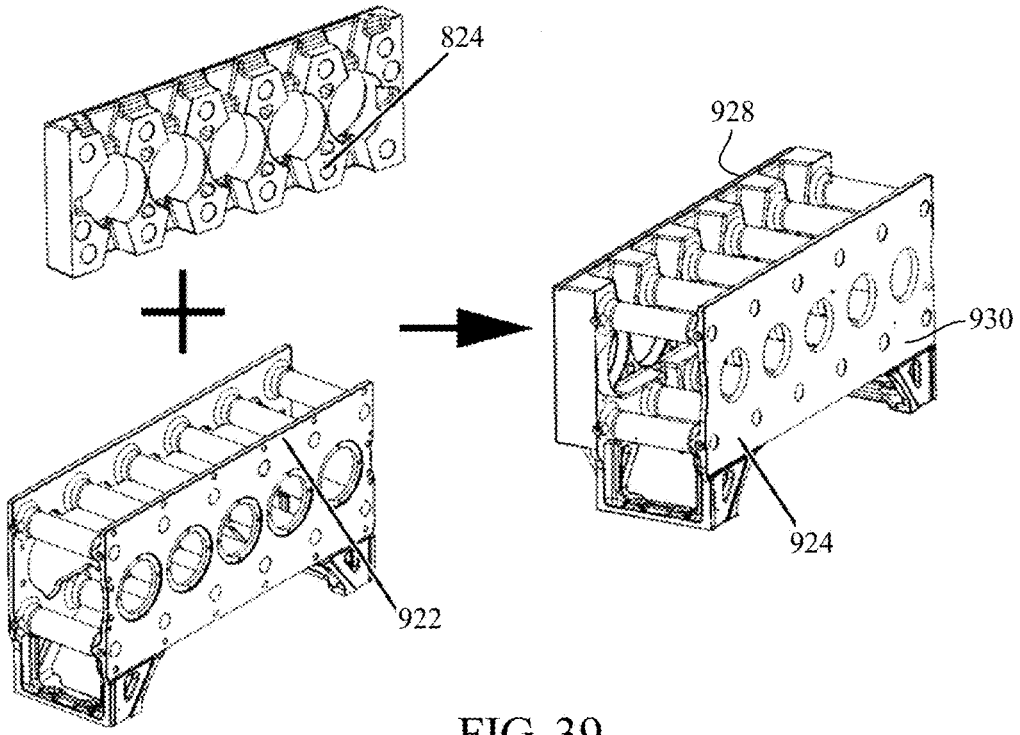
FIG. 39 is an illustration showing a new spacer frame according to an embodiment of the present disclosure.

Referring to FIG. 39, in some embodiments, the two parts of the original spacer frame 922 and the base plate 824 are combined into a new spacer frame 924 as a single part. The end surface 928 of the new spacer frame 924 facing the hydraulic end 804 is fitted with the valve box 822 of the hydraulic end 804, and the end surface 930 of the new spacer frame 924 facing the power end 802 is fitted with the end surface of the crosshead box 932. There are corresponding positioning pin holes between the new spacer frame 924 and the valve box 822. Before installation, the positioning pins are installed in the pin holes (e.g., of the valve box 822), and then the corresponding holes of the new spacer frame 924 are aligned with the positioning pins to fit. The positioning pins can ensure that the center line of the cavity of the new spacer frame 924 is coaxial with the center line of the corresponding cavity of the valve box 822. After the new spacer frame 924 is fitted with the valve box 822, a plurality of long studs 926 may be used to clamp the new spacer frame 924 between the hydraulic end 804 and the power end 802. There are corresponding positioning pin holes between the new spacer frame 924 and the crosshead box 932 of the power end 802. Before installation, the positioning pins are installed in the pin holes (e.g., of the crosshead box 932), and then the corresponding holes of the new spacer frame 924 are aligned with the positioning pins to make the new spacer frame 924 fit with the crosshead box 932. The positioning pins can ensure that the center line of the cavity of the new spacer frame 924 is coaxial with the center line of the corresponding cavity of the crosshead box 932.

Figure 40:
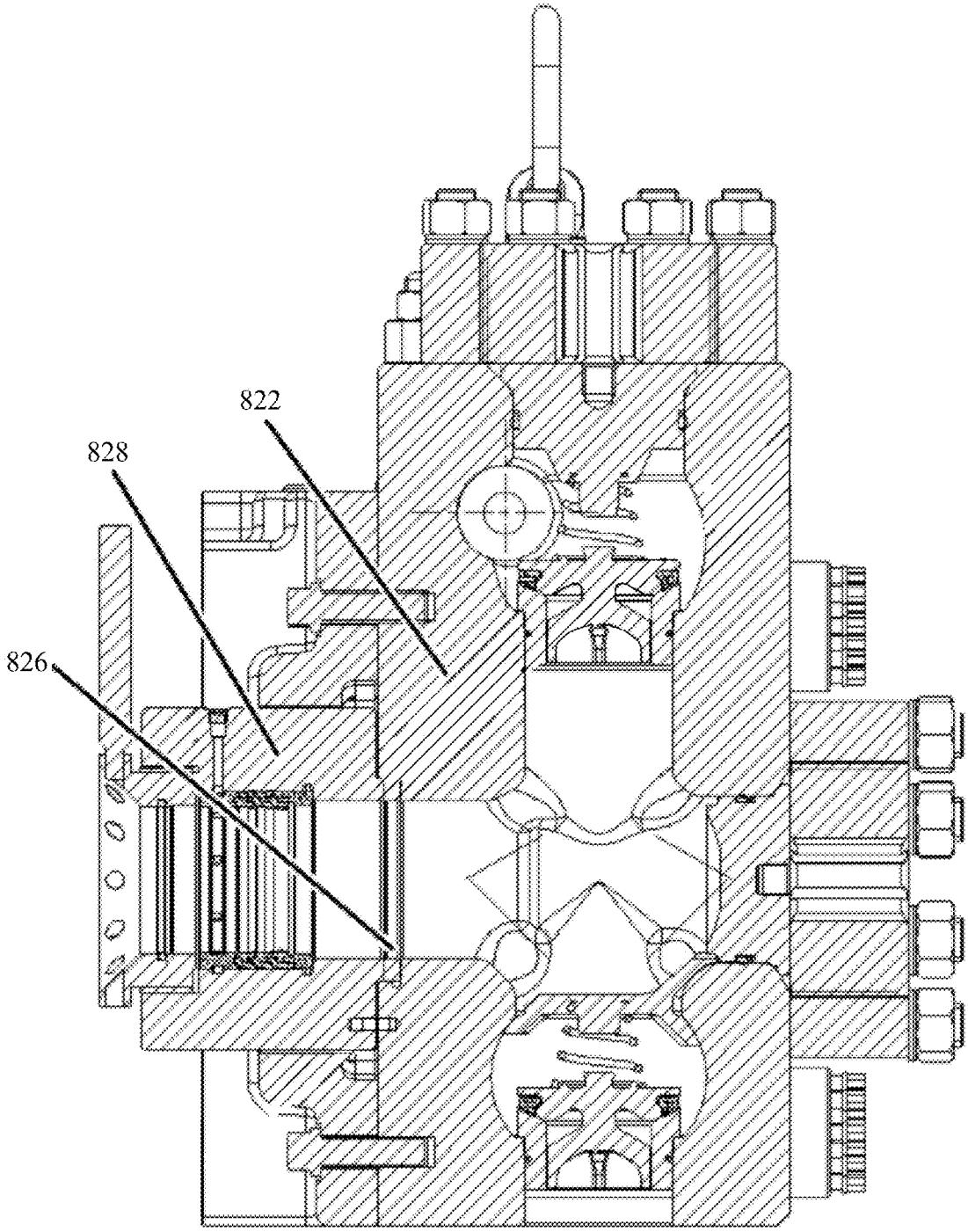
FIGS. 40-42 are illustrations showing a metal rigid sealing gasket ring according to an embodiment of the present disclosure.

Referring to FIG. 40, in some embodiments, a metal rigid sealing gasket ring 826 is positioned between the independent packing box 828 and the hydraulic end valve box 822. The metal rigid sealing gasket ring 826 is made of corrosion-resistant metal material, and its hardness is less than that of the hydraulic end valve box 822 and the independent packing box 828.

Figure 41:
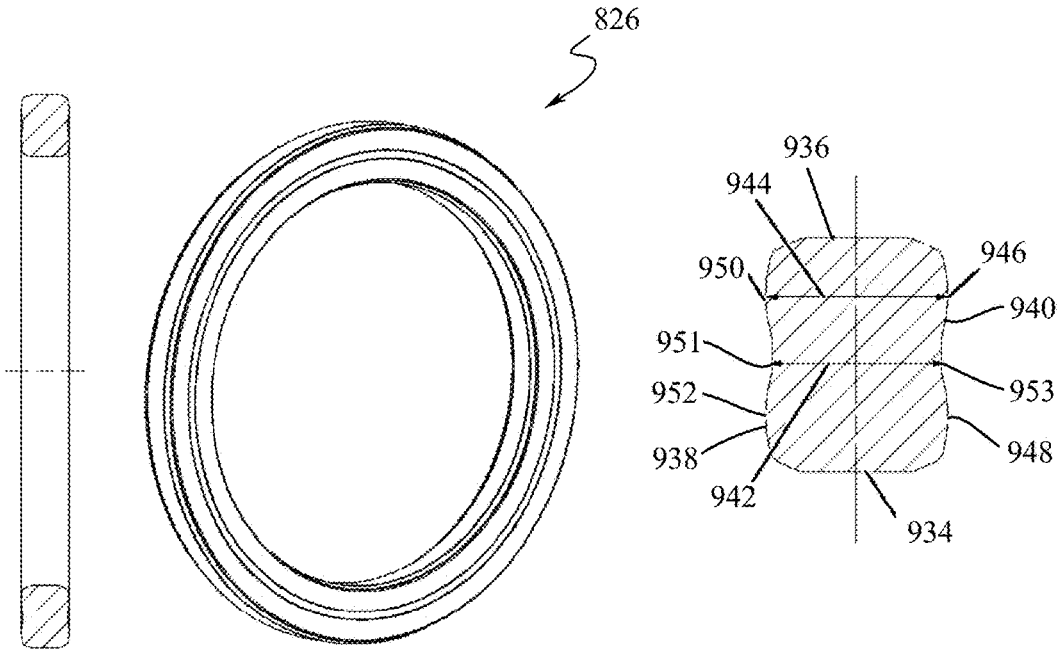

Referring to FIG. 41, in some embodiments, the metal rigid seal is an annular structure, the cross-sectional shape of the inner side surface 934 and the outer side surface 936 is a straight line or arc structure, the left end surface 938 and right end surface 940 have arc-shaped protrusions, and each end surface of the left and right end surfaces 938 and 940 has at least one arc protrusion. When each end surface of the left and right end surfaces 938 and 940 has at least two arc protrusions, the width 942 between a first position 951 (between the upper and lower arc protrusions (950 and 952) on the left side) and a second position 953 (between the upper and lower arc protrusions (946 and 948) on the right side) may be less than the width 944 between the arc protrusions on the left and right sides, (that is, as shown in FIG. 41, the width 944 between arc protrusions 946 and 950 or between arc protrusions 948 and 952). There is an inverted bevel or fillet at the intersection of the straight line and the arc protrusion in the cross-sectional shape to reduce stress concentration.

Figure 42:
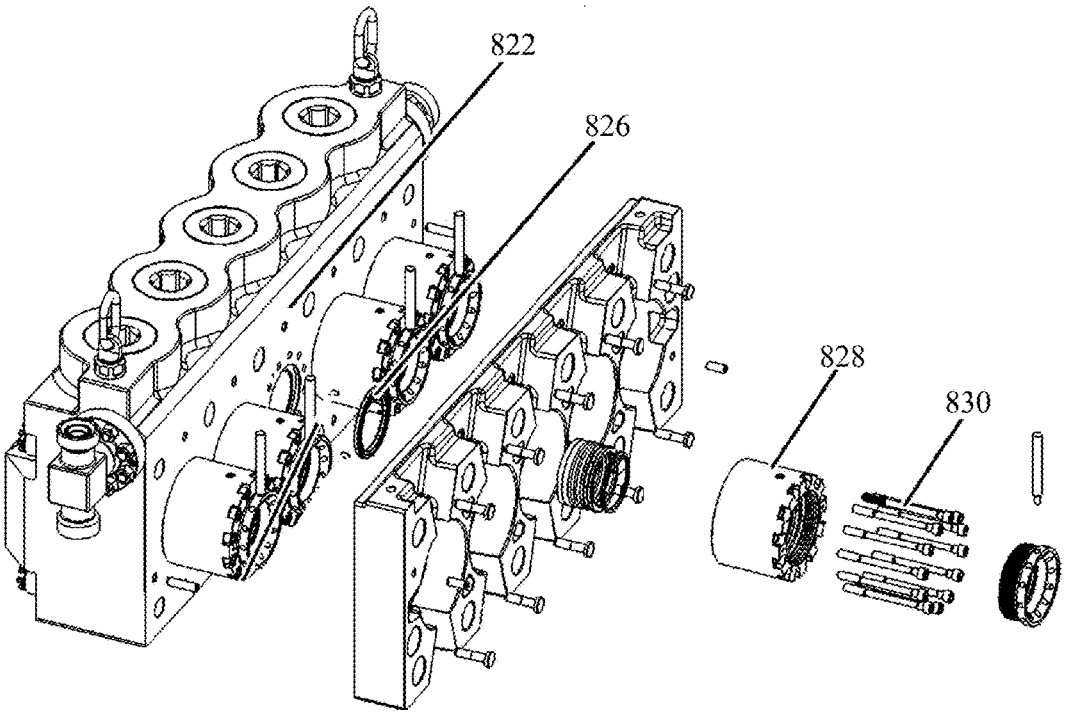

Referring to FIG. 42, in some embodiments, during operation, the sealing gasket ring 826 is installed between the hydraulic end valve box 822 and the independent packing box 828, and connected by fixing bolts or screws 830. There is a gap between the independent packing box 828 and the hydraulic end valve box 822, so the axial force of the fixing bolts/screws 830 can all act on the sealing gasket ring 826 to form an effective seal.

Figure 43:
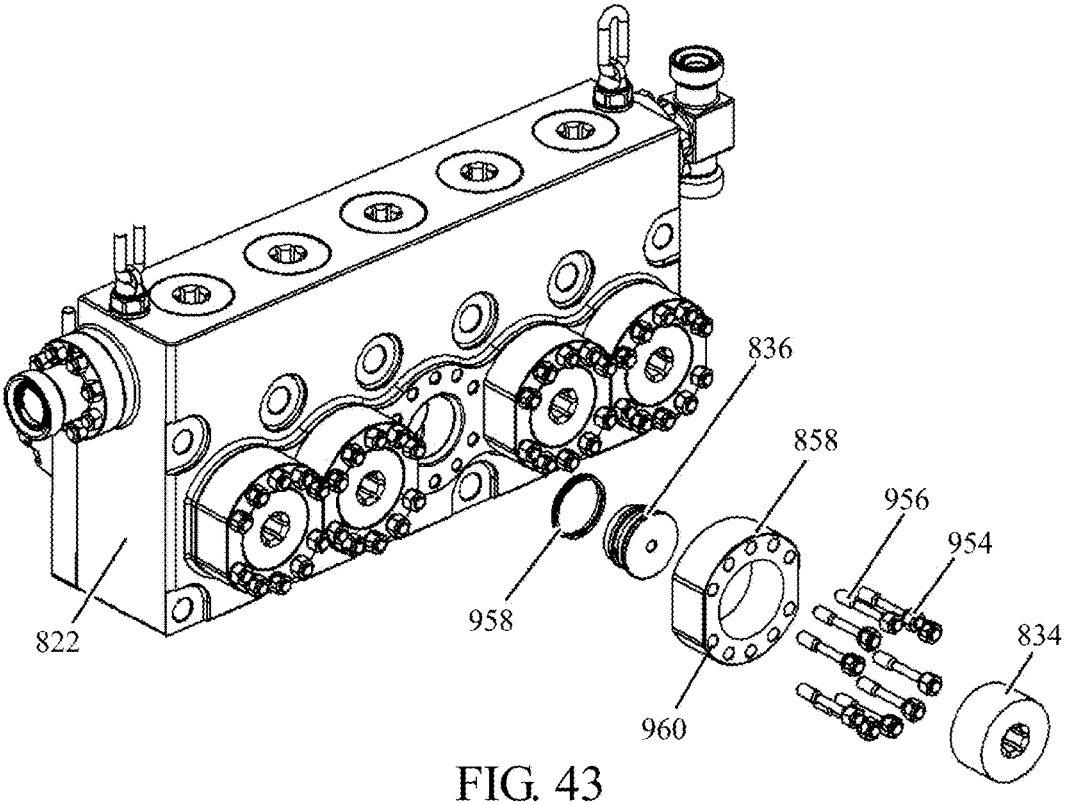
FIG. 43 is an illustration showing a pressing cap fixing seat according to an embodiment of the present disclosure.

In some embodiments, referring to FIG. 43, the internal threaded part configured to connect with the pressing cap 834 is separated from the hydraulic end valve box body 822 to become a separate component—the pressing cap fixing seat 858. The pressing cap and pressing cover fixing part includes an pressing cap 834, a nut 954, a stud 956, an pressing cap fixing seat 858, an pressing cover 836, and a sealing ring 958. The pressing cap fixing seat 858 includes multiple through holes 960 on the circumference configured to insert studs or screws or bolts. The hydraulic end body 822 is provided with threaded holes that correspond one by one to the through holes 960 of the pressing cap fixing seat 858, which are configured to insert studs or screws or bolts to fix the pressing cap fixing seat 858 to the hydraulic end valve box body 822

Figure 44:
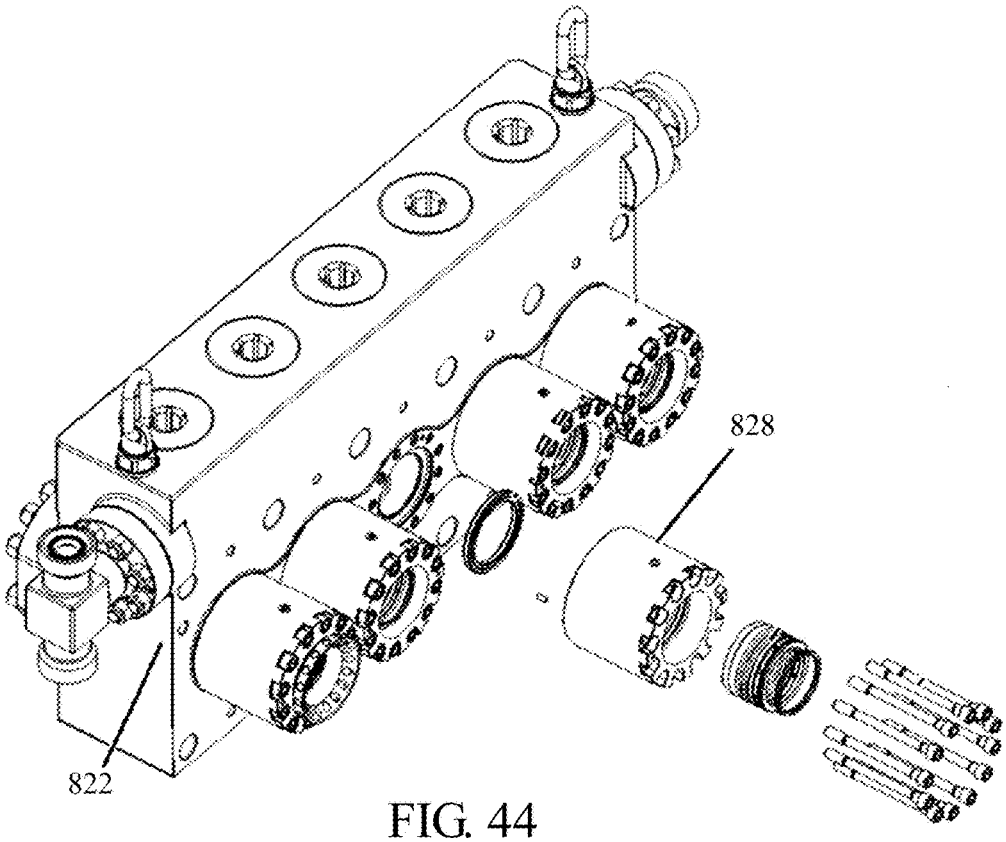
FIG. 44 is an illustration showing an independent packing box of a packing assembly according to an embodiment of the present disclosure.
Figure 45:
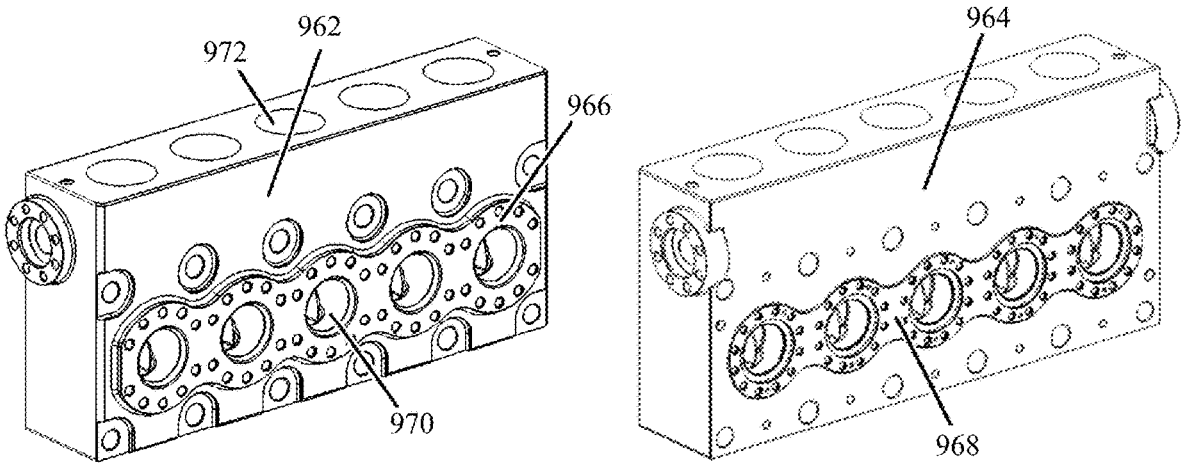
FIG. 45 is an illustration showing a valve box with front boss and rear boss according to an embodiment of the present disclosure.

In some embodiments, referring to FIGS. 43-45, the front end face 962 and the rear end face 964 of the hydraulic end valve box 822 are respectively provided with bosses, where the front boss 966 is configured to fit with the pressing cap fixing seat 858. The rear boss 968 is not in direct contact with the independent packing box 828. The front boss 968 is higher than the front end face 962 of the valve box body 822, and the rear boss 968 is higher than the rear end face 964 of the valve box body 822. The hydraulic end valve box body 822 is provided with a plurality of cross-intersecting horizontal cavities 970 and vertical cavities 972, where the horizontal cavity 970 is configured to accommodate the plunger. The boss can make the thickness of the wall between the bottom of the threaded hole on it and the horizontal cavity of the valve box body greater, thereby increasing the overall stiffness of the valve box and thus increasing the life of the threads. The pressing cap fixing seat 858 is provided with a plurality of circumferential through holes configured to insert studs or screws or bolts. The conventional solution is to arrange the circumferential holes evenly around the circumference. The present disclosure includes a non-uniform arrangement solution, which can solve the problem that the pressing cap fixing seat 858 cannot be configured circumferentially when the distance between the two horizontal cavities is close. The front boss 966 of the valve box body 822 has multiple sets of threaded holes corresponding to the through holes of the pressing cap fixing seat 858. Each set of threaded holes is distributed circumferentially around the axis of the horizontal cavity 970 and is configured to insert studs to fix the pressing cap fixing seat 858 to the hydraulic end valve box body 822.

Figure 46:
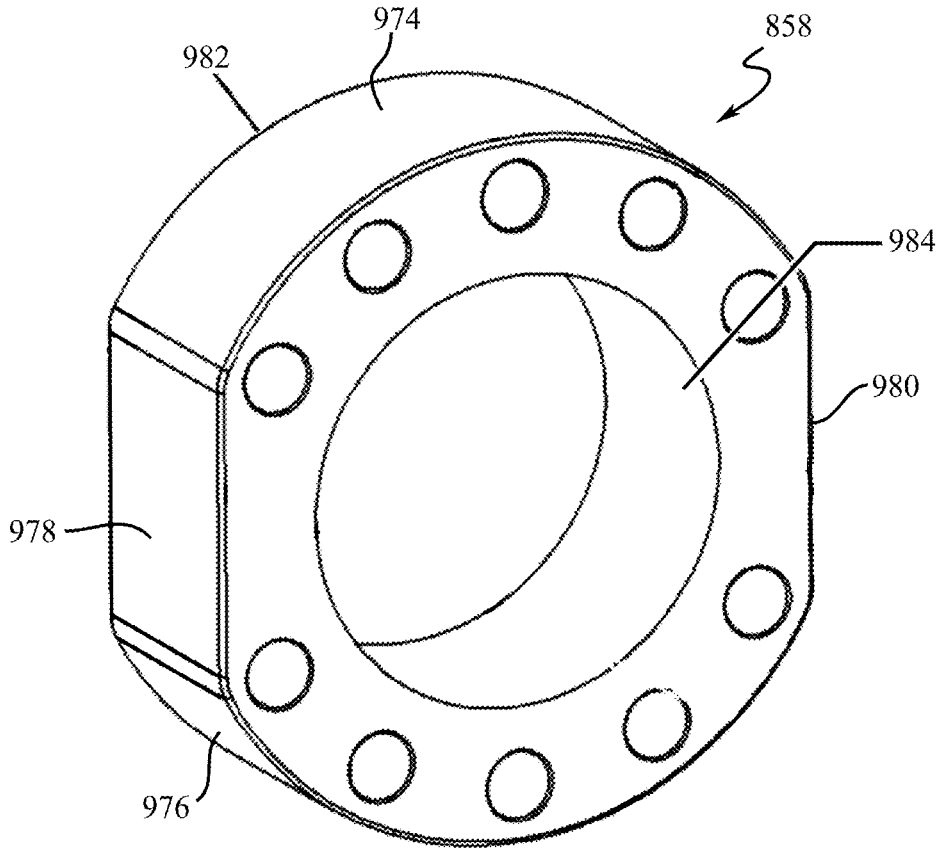
FIG. 46 is an illustration showing a pressing cap fixing seat according to an embodiment of the present disclosure.

Referring to FIG. 46, in some embodiments, the pressing cap fixing seat 858 is configured with through holes that are not circumferentially uniformly distributed. As shown in FIG. 46, the upper surface 974 and the lower surface 976 are arc-shaped, and the left side surface 978 and the right side surface 980 are flat or arc-shaped, where the outer spacing of the left and right side surfaces 978 and 980 is less than the maximum distance between the upper and lower arc surfaces 974 and 976. As shown, the pressing cap fixing seat 858 has multiple through holes that are not circumferentially uniformly distributed, which are configured to install bolts or studs. After installation, the inner end face 982 fits the valve box body. The large hole 984 in the middle is a threaded through hole configured to install the pressing cap.

Figure 47:
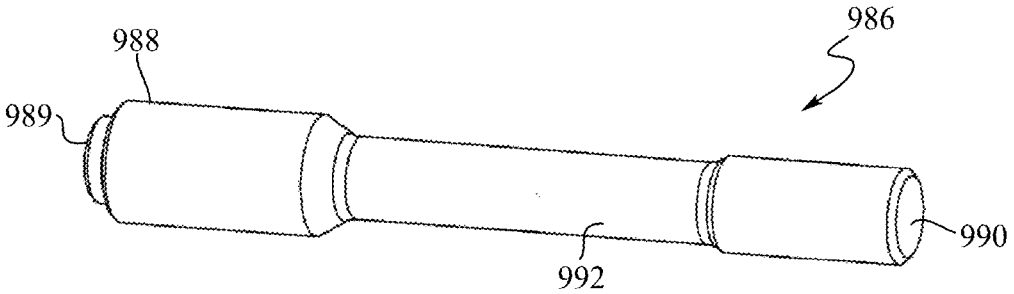
FIG. 47 is an illustration showing a double-ended stud according to an embodiment of the present disclosure.

Referring to FIG. 47, in some embodiments, a double-ended stud 986 may have different thread specifications at both ends. As shown, the thread specification at the first end 988 is larger than the thread specification at the opposite second end 990. For example, the diameter of the thread specification at the first end 988 is larger than the diameter of the thread specification at the second end 990. The diameter of the non-threaded section 992 between the two thread specifications is smaller than the minimum diameter of the threads on both the first and second ends 988 and 990. This configuration is advantageous for reducing the overall stiffness of the stud, thereby increasing the fatigue life of the thread. In some embodiments, as shown in FIG. 47, a positioning step 989 is provided at one end (e.g., the first end 988) of the thread, and the step diameter is smaller than the diameter of the adjacent thread specification (e.g., the thread specification at the first end 988). The positioning step 989 can ensure that the meshing tooth profile is complete when the stud 986 is screwed into the threaded hole, increase the stress of the thread teeth, and increase the service life of the thread. This stud can be used to connect the pressing cap fixing seat of the hydraulic end.

Some example embodiments and features are described below with reference to FIGS. 48-74:

Some embodiments of the present disclosure provide a valve support, which can solve the problems of cavitation inside the hydraulic end.

As discussed in greater detail below, in some embodiments of the present disclosure, the leg portion of the valve support can be used to be installed in the first valve cavity of the valve box in the hydraulic end to ensure the installation stability of the valve support; the protective portion of the valve support can be used to shield the connection area between the first valve cavity of the valve box and the intersecting cavity, thereby effectively alleviating the problem of high-pressure liquid in the intersecting cavity impacting the connection area and causing cavitation. Therefore, the embodiment of the present disclosure can improve the protective effect of the valve box by reconfiguring the valve support, which is advantageous to extending the service life of the valve box and even the entire hydraulic end.

Referring to FIGS. 48 to 70, the embodiment(s) of the present disclosure discloses a valve support 90-31, which is applied to the hydraulic end 90-01 of a fracturing pump. In addition, the valve support 90-31 can also be applied to other high-pressure liquid erosion equipment, and the present disclosure does not specifically limit the use scenario of the valve support 90-31.

Among them, the support body 90-311 is the basic part, which can play a bearing and fixing role for the leg portion 90-312 and the protective portion 90-313. In some embodiments, the support body 90-311 includes a first end surface 90-3111 and a second end surface 90-3112, and the first end surface 90-3111 and the second end surface 90-3112 are arranged opposite to each other along the axis of the valve support 90-31 (i.e., the dotted line in FIG. 57). It should be noted here that, considering that the valve support 90-31 can be installed in the first valve cavity 90-112 of the valve box 11, the axis of the valve support 90-31 can be parallel to the axis of the first valve cavity 90-112, and of course, they can also be colinear.

Figure 65:
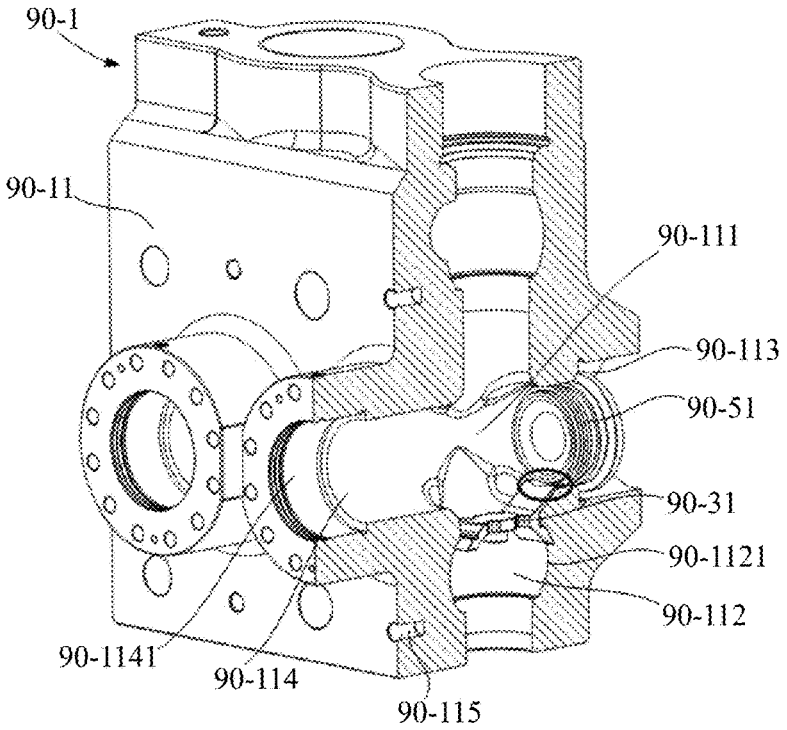
FIG. 65 is a schematic structural diagram of a valve box, an end cover and a valve support according to an embodiment of the present disclosure.
Figure 66:
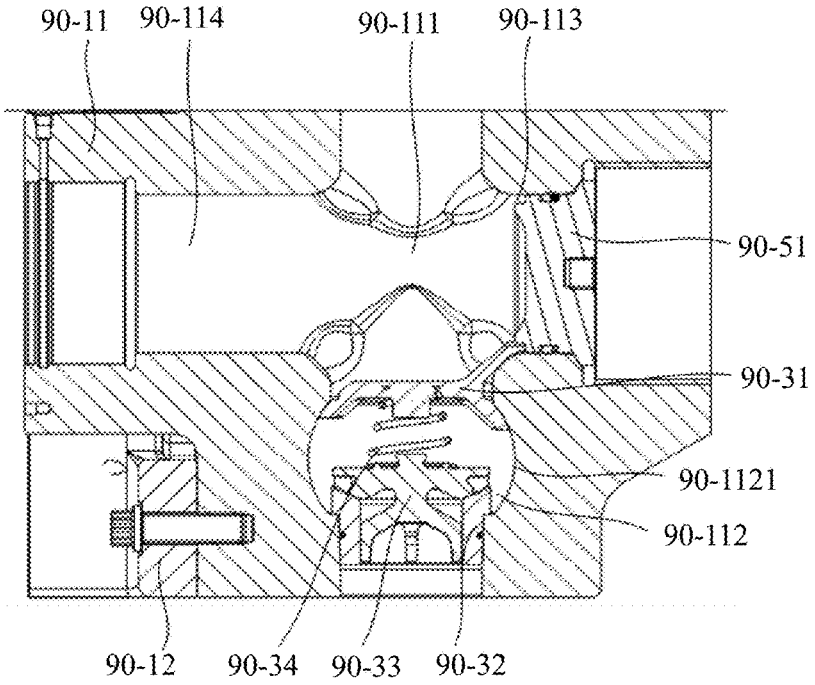
FIG. 66 is a partial schematic diagram of the valve box, the first valve assembly and the end cover assembly according to an embodiment of the present disclosure.
Figure 67:
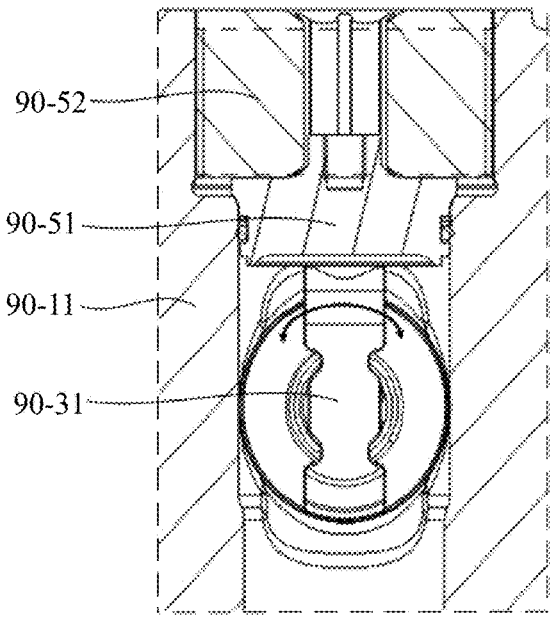
FIG. 67 is a top view of the valve support, the end cover body and the end cover pressing cap according to an embodiment of the present disclosure.

For example, referring to FIGS. 65 and 66, when the valve support 90-31 is installed in the first valve cavity 90-112, the axis of the valve support 90-31 can extend in the vertical direction. Of course, in other working conditions, the axis of the valve support 90-31 can also extend in other directions. In this case, the first end surface 90-3111 can be the upper end surface of the support body 90-311, and the second end surface 90-3112 can be the lower end surface of the valve body.

The protective portion 90-313 is a portion that protects the connection area between the first valve cavity 90-112 and the intersecting cavity 90-111 where cavitation is prone to occur. The protective portion 90-313 can shield the connection area and separate the high-pressure liquid in the intersecting cavity 90-111 from the connection area, thereby effectively alleviating the problem of erosion of the connection area by the high-pressure liquid, which is beneficial to reducing the probability of cavitation.

In the embodiment of the present disclosure, the protective portion 90-313 is arranged on the first end surface 90-3111 and is located in the edge area of the support body 90-311, and the protective portion 90-313 extends (obliquely) from the first end surface 90-3111 along the axis of the valve support 90-31 and in a direction away from the axis. Based on this, the extension direction of the protective portion 90-313 is not in the same straight line as the support body 90-311, but forms a certain angle to meet the requirements of the installation of the support body 90-311 in the first valve cavity 90-112 and the shielding of the connection area by the protective portion 90-313. It should be noted here that the first valve cavity 90-112 is arranged on one side of the intersecting cavity 90-111, such as the bottom side, so that the extension direction of the first valve cavity 90-112 and the extension direction of the connection area are not in the same straight line. Therefore, in order to simultaneously meet the installation requirements of the support body 90-311 and the shielding requirements of the protective portion 90-313, the embodiment of the present disclosure, when configuring the valve support 90-31, makes an adaptive design of the positional relationship between the protective portion 90-313 and the support body 90-311 to simultaneously meet the installation and shielding requirements.

For example, the angle between the extension direction of the protective portion 90-313 and the first end surface 90-3111 can range from 90° to 160°, including, for example, 90°, 120°, 135°, 150°, 160°, etc. Of course, it can also be other degrees, which can be determined according to the configuration of the valve box 90-11 and is not specifically limited here.

Optionally, the protective portion 90-313 and the support body 90-311 can be fixedly connected, such as by welding, bonding, riveting, etc. Of course, it can also be an integrated structure, that is, the protective portion 90-313 and the support body 90-311 are integrally manufactured and formed, such as by casting, forging, machining, etc.

In some embodiments, the leg portion 90-312 is provided on the second end surface 90-3112 and is located at the edge area of the support body 90-311, and the leg portion 90-312 extends (obliquely) from the second end surface 90-3112 along the axis direction of the valve support 90-31 and in a direction away from the axis. Based on this, the extension direction of the leg portion 90-312 is not on the same straight line as the support body 90-311, but at a certain angle, so as to meet the installation requirements of the valve support 90-31 as a whole in the first valve cavity 90-112.

It should be noted here that, by the inclined extension of the leg portion 90-312, it can abut against the inner wall of the first valve cavity 90-112, thereby achieving the installation of the valve support 90-31 and improving the installation stability of the valve support 90-31.

In addition, the leg portion 90-312 is provided on the second end surface 90-3112 and extends obliquely from the second end surface 90-3112, and the protective portion 90-313 is provided on the first end surface 90-3111 and extends obliquely from the first end surface 90-3111, so that the leg portion 90-312 and the protective portion 90-313 are respectively located on both sides of the support body 90-311 along the axial direction, which can improve the installation balance of the valve support 90-31 to a certain extent.

For example, the angle between the extension direction of the leg portion 90-312 and the second end surface 90-3112 can range from 90° to 160°, including, for example, 90°, 120°, 135°, 150°, 160°, etc. Of course, it can also be other degrees, which can be determined according to the configuration of the valve box 90-11 and is not specifically limited here.

Optionally, the leg portion 90-312 and the support body 90-311 may be fixedly connected, such as by welding, bonding, riveting, etc. Of course, they may also be an integral structure, that is, the leg portion 90-312 and the support body 90-311 are integrally manufactured and formed, such as by casting, forging, machining, etc.

In some more embodiments, the support body 90-311, the protective portion 90-313 and the leg portion 90-312 are an integrated structure, which can improve the overall strength of the valve support 90-31 to a certain extent.

In order to alleviate the stress concentration problem, a first fillet may be formed between the protective portion 90-313 and the first end surface 90-3111. The first fillet may reduce the stress between the protective portion 90-313 and the support body 90-311, thereby alleviating the stress concentration problem.

Similarly, a second fillet may be formed between the leg portion 90-312 and the second end surface 90-3112. The second fillet may reduce the stress between the leg portion 90-312 and the support body 90-311, thereby alleviating the stress concentration problem.

In some embodiments, the leg portion 90-312 can be used to be installed to the first valve cavity 90-112 of the valve box 90-11 in the hydraulic end 90-01 to ensure the installation stability of the valve support 90-31; the protective portion 90-313 can be used to shield the connection area between the first valve cavity 90-112 of the valve box 11 and the intersecting cavity 90-111, thereby effectively alleviating the problem of cavitation caused by the impact of the high-pressure liquid in the intersecting cavity 90-111 on the connection area. Therefore, the present disclosure improves the protective effect of the valve box 90-11 by reconfiguring the valve support 90-31, which is advantageous to extending the service life of the valve box 90-11 and even the entire hydraulic end 01.

Figure 59:
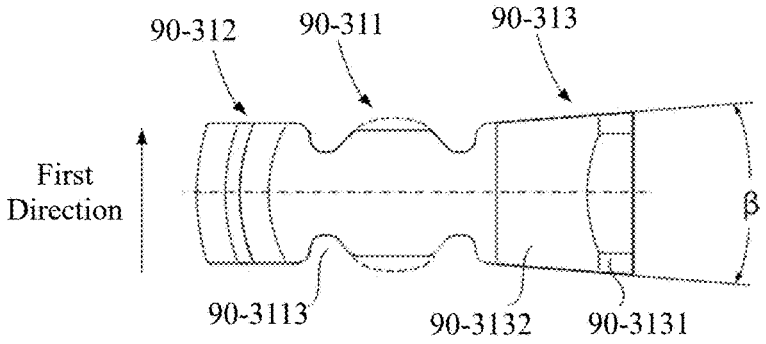
FIG. 59 is a top view of a valve support according to an embodiment of the present disclosure.

Referring to FIG. 59, in some embodiments, in the first direction, the width dimension of the protective portion 90-313 is greater than the width dimension of the support body 90-311, where the first direction is parallel to the first end surface 90-3111 and perpendicular to the extension direction of the protective portion 90-313. Based on this configuration, the protective portion 90-313 can form a structure similar to a "wide ear", which can increase the shielding area of the connection area by the protective portion 90-313 to a certain extent, thereby preventing the high-pressure liquid from contacting a larger area of the connection area, which is advantageous to alleviating the cavitation problem of a larger area in the connection area.

For example, the width dimension of a part or all of the protective portion 90-313 in the first direction may be greater than the width dimension of the support body 90-311 in the first direction, which may be configured according to actual working conditions.

In some preferred embodiments, along the extension direction of the protective portion 90-313 (i.e., from left to right in FIG. 59), the width dimension of the protective portion 90-313 in the first direction gradually increases, that is, the protective portion 90-313 gradually widens from the support body 90-311 to the direction away from the support body 90-311, thereby making the area away from the support body 90-311 have a larger shielding area, which is beneficial to improving the protection effect to a certain extent.

It should be noted that, when the plunger 90-6 squeezes the liquid in the intersecting cavity 90-111, the high-pressure liquid formed by the squeezing is mainly concentrated in the end cover assembly 90-5 area on one side of the valve body, so that the liquid pressure in the area close to the end cover assembly 90-5 is relatively high. The end of the protective portion 90-313 that is away from the support body 90-311 is close to the end cover assembly 90-5 area, so that by widening the area of the protective portion 90-313 that is away from the support body 90-311, it is beneficial to increase the blocking effect on the high-pressure liquid, thereby improving the protection effect on the connection area.

Optionally, the angle between two edges of the protective portion 90-313 arranged opposite to each other in the first direction (i.e., β in FIG. 59) can range from 0° to 90°, for example, including 0°, 30°, 45°, 60°, 75°, 90°, etc., and of course, it can also be other degrees, which is not specifically limited here.

When the angle between the two edges is 0°, the projection of the protective portion 90-313 in the plane perpendicular to the axis of the valve support 90-31 can be a rectangle; when the angle between the two edges is greater than 0°, the projection of the protective portion 90-313 in the plane perpendicular to the axis of the valve support 90-31 can be a trapezoid, such as an isosceles trapezoid, and the upper base of the trapezoid is connected to the support body 90-311, and the lower base of the trapezoid is away from the support body 90-311.

Figure 57:
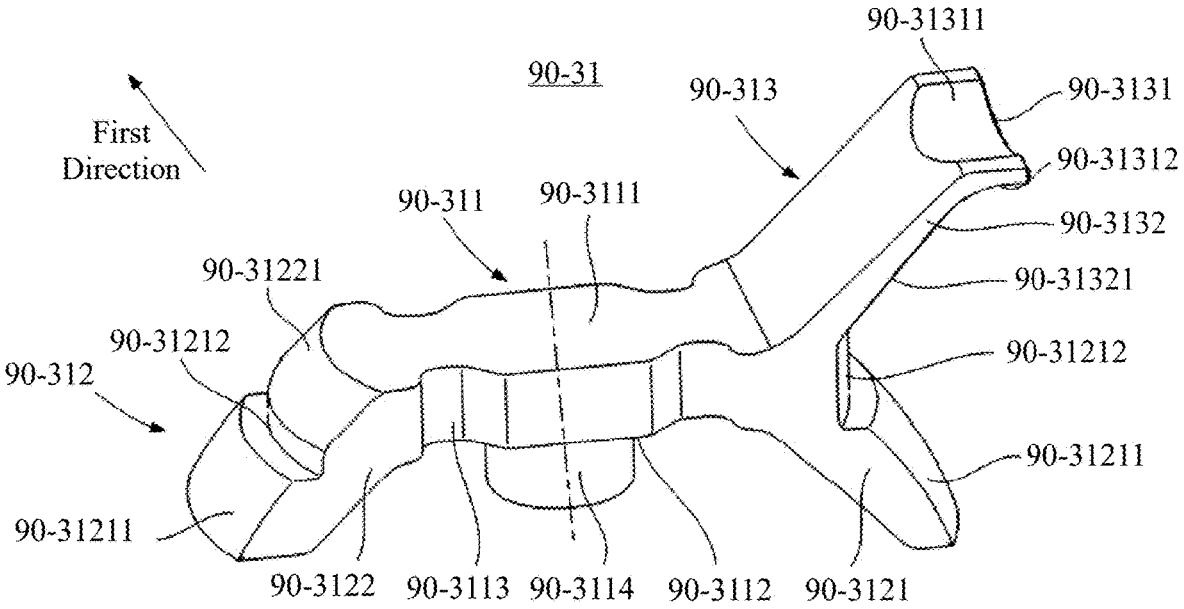
FIG. 57 is a first schematic structural diagram of a valve support according to an embodiment of the present disclosure.
Figure 58:
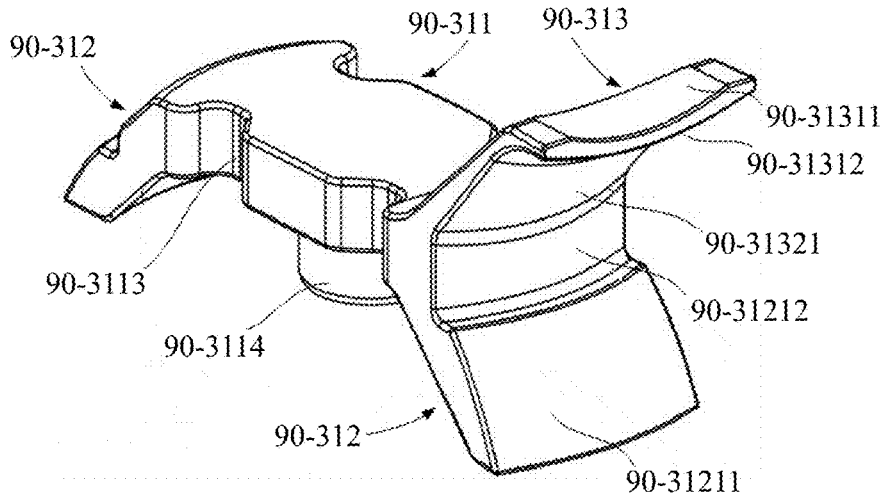
FIG. 58 is a second schematic structural diagram of a valve support according to an embodiment of the present disclosure.

Referring to FIGS. 57 and 58, in some embodiments, the protective portion 90-313 may include a first protective segment 90-3131 and a second protective segment 90-3132, the second protective segment 90-3132 is connected between the first protective segment 90-3131 and the support body 90-311, and the first protective segment 90-3131 and the second protective segment 90-3132 have different extension directions, so that a certain angle can be formed between the two. Based on this configuration, the protective portion 90-313 can adapt to the shape of the connection area between the intersecting cavity 90-111 and the first valve cavity 90-112 to improve the protection effect of the connection area.

It should be noted here that the first valve cavity 90-112 extends along the axial direction of the valve support 90-31, and one side of the intersecting cavity 90-111 extends along the direction perpendicular to the axial direction of the valve support 90-31, thereby forming a part extending along the axis and a part extending perpendicular to the axis at the connection area. Therefore, when configuring the protective portion 90-313, it is necessary to shield the entire area of the connection area to provide comprehensive protection. In addition, the first protective segment 90-3131 and the second protective segment 90-3132 together form the above-mentioned "wide ear" structure to provide good protection.

Further, the extension direction of the first protective segment 90-3131 can be parallel to the first end surface 90-3111, and the angle between the extension direction of the second protective segment 90-3132 and the extension direction of the axis can range from 100° to 135°, including, for example, 100°, 110°, 120°, 130°, 135°, etc. Of course, it can also be other degrees, which are not specifically limited here. With this configuration, the second protective segment 90-3132 can shield the portion of the connection area that is close to the first valve cavity 90-112, and the first protective segment 90-3131 can shield the portion of the connection area that is close to the intersecting cavity 111, thereby achieving comprehensive protection of the connection area to improve the protection effect.

It should be noted here that, in order to further improve the protection effect, the protective portion 90-313 can be sealingly connected to the end cover assembly 90-5 to prevent the high-pressure liquid from leaking from the gap between the protective portion 90-313 and the end cover assembly 90-5 and causing cavitation to the connection area.

Based on the above situation, the shape of the first protective segment 90-3131 needs to be adapted to the end cover assembly 90-5, so that the extension direction of the first protective segment 90-3131 is parallel to the first end surface 90-3111, so as to form a good match with the end cover assembly 90-5, thereby ensuring the sealed connection between the first protective segment 90-3131 and the end cover assembly 90-5. The specific connection method between the first protective segment 90-3131 and the end cover assembly 90-5 will be described in detail in the following content.

Continuing to refer to FIG. 57 and FIG. 58, in some embodiments, the first protective segment 90-3131 may include a first contact surface 90-31311 and a second contact surface 90-31312 disposed opposite to each other along the axial direction, where the first contact surface 90-31311 is used for sealing connection with the end cover assembly 90-5, and the second contact surface 90-31312 is used for good contact with the connection area. Based on this, the first protective segment 90-3131 can ensure good protection of the connection area, effectively preventing the high-pressure liquid from causing cavitation to the connection area.

Furthermore, the first contact surface 90-31311 can be a concave arc surface, which can cooperate well with the end cover assembly 90-5, thereby increasing the cooperation area and improving the sealing effect; the second contact surface 90-31312 can be a convex arc surface, which can contact well with the connection area through the convex arc surface, thereby increasing the contact area and improving the sealing effect.

For example, the first contact surface 90-31311 and the second contact surface 90-31312 can both be arc surfaces, and the first contact surface 90-31311 and the second contact surface 90-31312 are coaxially arranged. In this case, the first protective segment 90-3131 can be regarded as a part of a cylinder. Of course, in other embodiments, the first contact surface 90-31311 and the second contact surface 90-31312 can also be arc surfaces with different axes.

In some embodiments, the second protective segment 90-3132 may include a third contact surface 90-31321 facing away from the support body 90-311, and the third contact surface 90-31321 may be an outer convex arc surface, which forms a good contact with the connection area through the outer convex arc surface, which is advantageous to increasing the contact area and improving the sealing effect. For example, the third contact surface 90-31321 may be a circular arc surface to adapt to the concave shape of the connection area.

In addition, there is a gap between at least part of the protective portion 90-313 and the inner wall of the first valve cavity 90-112, and this configuration can effectively alleviate the problem of assembly interference. Specifically, there is a gap between the third contact surface 90-31321 of the second protective segment 90-3132 and the inner wall of the first valve cavity 90-112 to ensure good contact between the second contact surface 90-31312 and the inner wall of the intersecting cavity 90-111 and good contact between the first contact surface 90-31311 and the end cover assembly 90-5.

In some embodiments, a fourth contact surface 90-31211 may be provided on the side of the leg portion 90-312 facing away from the support body, and the fourth contact surface 90-31211 may be an outer convex arc surface. The outer convex arc surface can form a good contact with the inner wall of the first valve cavity 90-112, which is advantageous to improving the installation stability of the valve support 90-31. For example, the fourth contact surface 90-31211 may be an arc surface so as to adapt to the shape of the inner wall of the first valve cavity 90-112.

In some embodiments, at least a portion of the first valve cavity 90-112 is a spherical surface 90-1121 or a spherical-like surface. Correspondingly, the fourth contact surface 90-31211 of the leg portion 90-312 can also be a spherical surface or a spherical-like surface to adapt to the shape of the inner wall of the first valve cavity 90-112, and can increase the contact area and improve the installation stability of the valve support 90-31.

In some embodiments, the side of the leg portion 90-312 facing away from the support body 90-311 may be provided with an arc groove 90-31212 extending along the circumference of the support body 90-311, and the arc groove 90-31212 is located in the connecting area between the leg portion 90-312 and the protective portion 90-313. Through the provision of the arc groove 90-31212, a certain avoidance space can be formed between the root of the protective portion 90-313 and the root of the leg portion 90-312 to prevent the roots of the protective portion 90-313 and the leg portion 90-312 from interfering with the connection area, thereby ensuring the stable installation of the valve support 90-31.

Referring to FIGS. 57 to 61, in some embodiments, the leg portion 90-312 may include a first leg 90-3121 and a second leg 90-3122, and the first leg 90-3121 and the second leg 90-3122 are respectively located at the edge area of the support body 90-311, so that the first leg 90-3121 and the second leg 90-3122 can respectively abut against the inner wall of the first valve cavity 90-112, thereby increasing the abutment area and improving the installation stability of the valve support 90-31.

Furthermore, the first leg 90-3121 and the second leg 90-3122 can be centrally symmetrically arranged relative to the axis of the valve support 90-31. This configuration can ensure that the force acting on the valve support 90-31 is relatively balanced, which is advantageous to improving the installation stability of the valve support 90-31.

In addition, the first leg 90-3121 is arranged corresponding to the protective portion 90-313, that is, the first leg 90-3121 and the protective portion 90-313 are both located at one side edge of the support body 90-311, and the second leg 90-3122 is located at the other side edge of the support body 90-311. Based on this, when the protective portion 90-313 is subjected to the action of high-pressure liquid, the arrangement of the first leg 90-3121 and the second leg 90-3122 can make the valve support 90-31 more stable to prevent the valve support 90-31 from tilting or rotating.

Of course, the extension lengths of the first leg 90-3121 and the second leg 90-3122 can be the same or different, and can be set specifically according to actual working conditions. Considering that the first leg 90-3121 and the protective portion 90-313 are located on the same side edge of the support body 90-311, and the protective portion 90-313 is subjected to a large load of high-pressure liquid, the valve support 90-31 has a tendency to rotate clockwise, and thus, the force exerted on the protective portion 90-313 and the second leg 90-3122 is relatively large, that is, the force exerted on the second leg 90-3122 is greater than the force exerted on the first leg 90-3121, and thus, the extension length of the second leg 90-3122 can be made greater than the extension length of the first leg 90-3121, thereby increasing the contact area between the second leg 90-3122 and the inner wall of the first valve cavity 90-112, which is advantageous to increasing the bearing capacity of the second leg 90-3122.

In some embodiments, the leg portion 90-312 may further include more legs to further increase the contact area between the leg portion 90-312 and the inner wall of the first valve cavity 90-112, thereby improving the installation stability of the valve support 90-31.

In some embodiments, the leg portion 90-312 may also be an annular structure, which is arranged around the edge of the second end surface 90-3112. This arrangement can form a circle of contact portions between the leg portion 90-312 and the inner wall of the first valve cavity 90-112, thereby improving the installation stability of the valve support 90-31. In this case, the opening of the first valve cavity 90-112 away from the intersecting cavity 90-111 can be enlarged to facilitate the disassembly and assembly of the valve support 90-31.

When the leg portion 90-312 includes a first leg 90-3121, a second leg 90-3122, or even other legs, an arc groove 90-31212 may be provided on the first leg 90-3121 and the second leg 90-3122 to facilitate installation avoidance and prevent installation interference.

To facilitate assembly and disassembly of the valve support 90-31, the support body 90-311, the first leg 90-3121, the second leg 90-3122 and the protective portion 90-313 can all be strip structures to reduce the space occupied by the valve support 90-31 in the first valve cavity 90-112, thereby facilitating assembly and disassembly.

In some embodiments, a side of the second leg 90-3122 facing away from the support body 90-311 may be provided with an arc surface 90-31221, and the arc surface 90-31221 may be provided to avoid interference between the valve support 90-31 and the valve box 90-11 when the valve support 90-31 is installed at an angle, which is beneficial to the smooth disassembly and assembly of the valve support 90-31. Of course, the arc surface 90-31221 may also be replaced by a conical surface, etc., as long as it can play a role in avoiding contacting with the valve box, and the specific shape is not limited.

It should be noted that the arc surface 90-31221 here is adapted to the arc groove 90-31212 and are located on both sides of the support body 90-311 respectively, and both play a role of avoiding contacting with the valve box.

In addition, since the first leg 90-3121 and the second leg 90-3122 are both provided with an arc groove 90-31212, the first leg 90-3121 and the second leg 90-3122 each form a step structure at the edge of the fourth contact surface 90-31211. In this way, when the valve support 90-31 is in the installed state, the fourth contact surface 90-31211 of the first leg 90-3121 and the second leg 90-3122 respectively abuts against the inner wall of the first valve cavity 90-112, and the groove bottom of the arc groove 90-31212 of the first leg 90-3121 and the arc surface 90-31221 of the second leg 90-3122 are respectively spaced from the inner wall of the first valve cavity 90-112. This arrangement can ensure that the fourth contact surface 90-31211 of the first leg 90-3121 and the second leg 90-3122 respectively abut well against the inner wall of the first valve cavity 90-112, and avoid affecting the abutment between the fourth contact surface 90-31211 and the inner wall of the first valve cavity 90-112 due to assembly interference.

Figure 60:
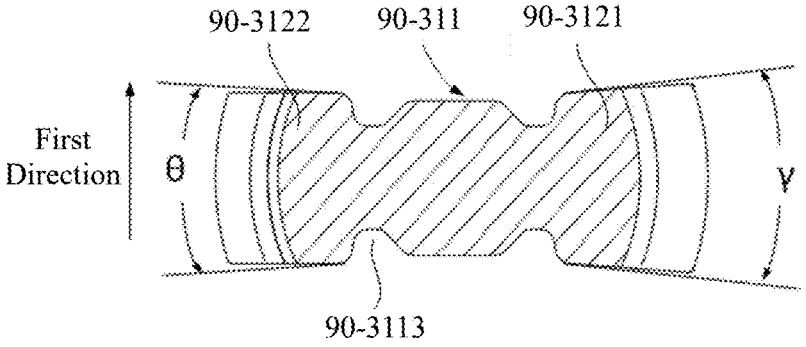
FIG. 60 is a cross-sectional schematic diagram of a valve support according to an embodiment of the present disclosure.

In order to improve the bearing capacity of the first leg 90-3121, the width dimension of the first leg 90-3121 in the first direction gradually increases along the extension direction of the first leg 90-3121, as shown in FIG. 60. Based on this, the contact area between the first leg 90-3121 and the inner wall of the first valve cavity 90-112 can be increased, thereby improving the bearing capacity of the first leg 90-3121.

Of course, along the extension direction of the first leg 90-3121, the width dimensions of the first leg 90-3121 in the first direction may also be equal, which may be selected according to actual working conditions.

Optionally, the angle between two edges of the first leg 90-3121 arranged opposite to each other in the first direction (i.e., θ in FIG. 60) can range from 0° to 45°, for example, including 0°, 10°, 20°, 30°, 40°, 45°, etc., and of course, it can also be other degrees.

In order to improve the bearing capacity of the second leg 90-3122, the width dimension of the second leg 90-3122 in the first direction gradually increases along the extension direction of the second leg 90-3122. Based on this, the contact area between the second leg 90-3122 and the inner wall of the first valve cavity 90-112 can be increased, thereby improving the bearing capacity of the second leg 90-3122.

Of course, along the extension direction of the second leg 90-3122, the width dimensions of the second leg 90-3122 in the first direction may also be equal, which may be selected according to actual working conditions.

Optionally, the angle between two edges of the second leg 90-3122 disposed opposite to each other in the first direction can range from 0° to 45°, including, for example, 0°, 10°, 20°, 30°, 40°, 45°, etc., and of course, other degrees can also be used.

Referring to FIGS. 57 to 61, in some embodiments, the outer edge surface of the support body 90-311 may be provided with a plurality of grooves 90-3113, each groove 90-3113 passing through the first end surface 90-3111 and the second end surface 90-3112. Based on this, the blocking effect on the fluid can be reduced, making the fluid flow smoother.

For example, the groove 90-3113 may be a circular groove, a rectangular groove, etc. In addition, a chamfer may be included to reduce the resistance of the fluid.

In addition, the projection of the area of the outer edge surface of the support body 90-311 between two adjacent grooves 90-3113 in a plane perpendicular to the axis can be a straight line or an arc.

In some embodiments, the support body 90-311 may also be provided with a boss 90-3114, which extends from the second end surface 90-3112 in a direction away from the first end surface 90-3111. The boss 90-3114 can limit and guide the elastic member 90-34 to prevent the elastic member 90-34 from moving or twisting at will, and ensure that the elastic member 90-34 is elastically deformed along the axial direction of the valve support 90-31.

For example, the boss 90-3114 may be a cylindrical boss, a conical boss, a prismatic boss, or the like.

Figure 61:
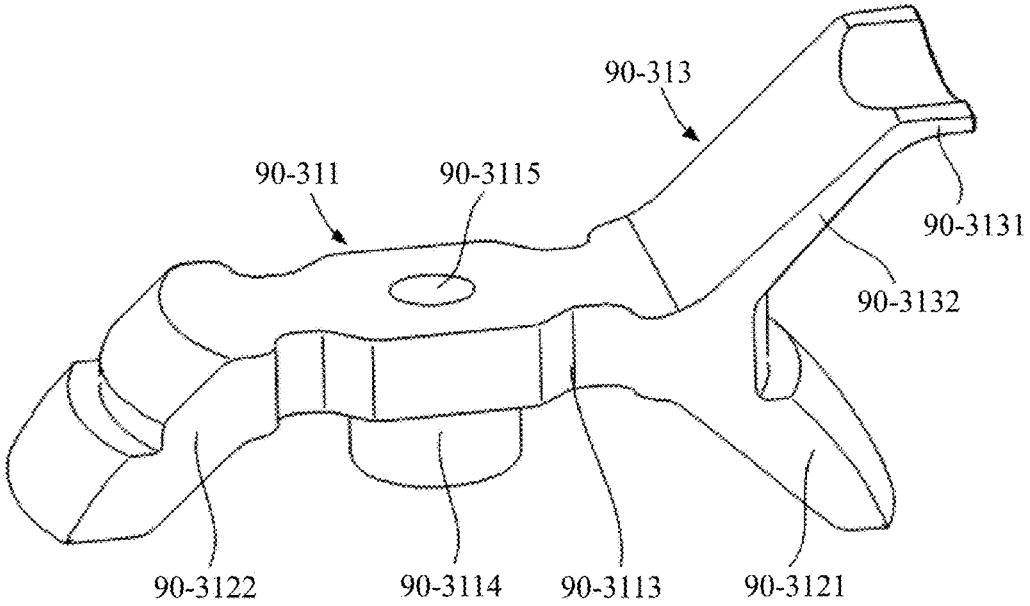
FIG. 61 is a schematic structural diagram of a valve support with a through hole according to an embodiment of the present disclosure.

In addition, as shown in FIG. 61, the support body 90-311 may be provided with a through hole 90-3115, which passes through the support body 90-311 and the boss 90-3114 along the axial direction of the valve support 90-31. The provision of the through hole 90-3115 can help reduce the weight of the valve support 90-31, and allow a small portion of the fluid to flow through the through hole 90-3115, further reducing the resistance to the fluid.

Advantages of the configurations discussed above, include at least:

1. The "wide ear"-shaped protective portion 90-313 can ensure that the portion of the connection area that is prone to cavitation is shielded, thereby effectively alleviating the problem of metal surface peeling and damage in the connection area caused by cavitation caused by "vacuuming" due to insufficient upper liquid.

2. It is easy to disassemble and assemble. There is no need to disassemble other structures of the hydraulic end 90-01 (such as the upper cover assembly 90-7, etc.). Only the end cover assembly 90-5 needs to be disassembled to realize the disassembly and assembly of the valve support 90-31.
3. The leg portion 90-312 conforms to the inner wall of the first valve cavity 90-112 and can increase the contact area with the inner wall of the first valve cavity 90-112, thereby improving the stability of the valve support 90-31 and alleviating the stress concentration problem.
4. It can reduce the resistance to fluid.

Based on the above-mentioned valve support 90-31, the present disclosure further discloses a hydraulic end 90-01 of a fracturing pump. Referring to FIGS. 48 to 70, the hydraulic end 90-01 includes a hydraulic end body 1 and a first valve assembly 90-3.

As shown in FIGS. 65 and 66, the hydraulic end body 90-1 is provided with an intersecting cavity 90-111 and a first valve cavity 90-112 that are connected, and through the first valve cavity 90-112, the liquid can flow to the intersecting cavity 90-111, so that the liquid in the intersecting cavity 90-111 can be squeezed by the plunger 90-6 to form a high-pressure liquid, which is finally discharged.

Of course, the liquid end body 90-1 can also be provided with a plunger cavity 90-114, a second valve cavity, and an end cover opening 90-113 that are connected to the intersecting cavity 90-111, so as to respectively realize the installation of the plunger 90-6, the second valve assembly 90-4 and the end cover assembly 90-5, so as to meet the normal working requirements of the hydraulic end 90-01. It should be noted here that the working principle of the hydraulic end 90-01 can refer to the relevant technology and will not be elaborated here.

In some embodiments, referring to FIG. 48, FIG. 49, FIG. 66 to FIG. 69, the first valve assembly 90-3 may include a valve sleeve 90-32, a valve member 90-33, an elastic member 90-34 and an elastic member support. The valve sleeve 90-32 is disposed in the first valve cavity 90-112, the valve member 90-33 is movably disposed in the valve sleeve 90-32, the elastic member support is disposed at the port of the first valve cavity 90-112 adjacent to the intersecting cavity 90-111, and the elastic member 90-34 is elastically connected between the valve member 90-33 and the elastic member support. Based on this, the elastic member support can play a limiting role on the elastic member 90-34, so that the elastic member 90-34 can exert an elastic force on the valve member 90-33. Under the elastic force of the elastic member 90-34, the valve member 90-33 has a tendency to move toward the outside of the first valve cavity 90-112; under the action of the fluid, the valve member 90-33 moves relative to the valve sleeve 90-32 and compresses the elastic member 90-34, so that the liquid can enter the first valve cavity 90-112, and then enter the intersecting cavity 90-111 to be squeezed to form a high-pressure liquid, and finally be discharged.

The specific working principle of the first valve component 90-3 can be referred to the relevant technology and will not be elaborated here.

In some embodiments, the elastic member support is the above-mentioned valve support 90-31, where the leg portion 90-312 is connected to the inner wall of the first valve cavity 90-112, and the protective portion 90-313 shields the connection area between the first valve cavity 90-112 and the intersecting cavity 90-111. Based on this, the stability of the valve support 90-31 in the first valve cavity 90-112 can be guaranteed, and the protection effect on the connection area can be achieved.

Figure 48:
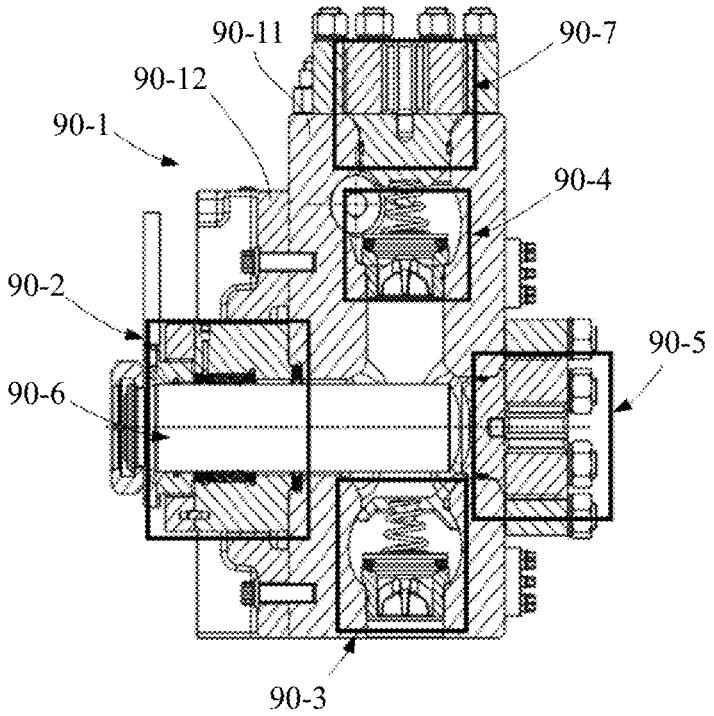
FIG. 48 is a cross-sectional schematic diagram of a first type (split type) of a hydraulic end according to an embodiment of the present disclosure.
Figure 49:
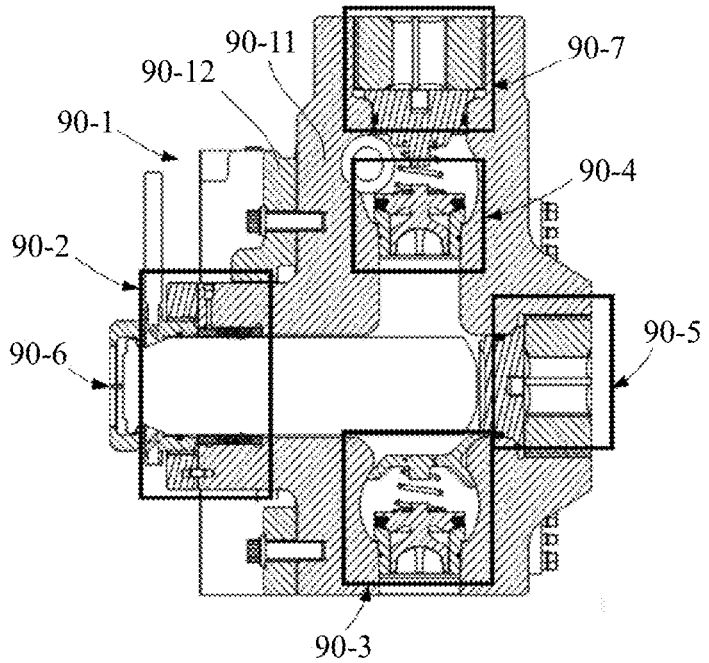
FIG. 49 is a cross-sectional schematic diagram of a second type (integrated) of a hydraulic end according to an embodiment of the present disclosure.

With reference to FIG. 48 and FIG. 49, in some embodiments, the hydraulic end body 90-1 may further be provided with an end cover opening 90-113 communicating with the intersecting cavity 90-111, and the hydraulic end 90-01 further includes an end cover assembly 90-5, which is sealed at the end cover opening 90-113, and at least a portion of the protective portion 90-313 is connected to the end cover assembly 90-5. Through the connection between the protective portion 90-313 and the end cover assembly 90-5, the connection area between the first valve cavity 90-112 and the intersecting cavity 90-111 can be fully shielded to prevent high-pressure liquid from contacting the connection area and causing cavitation.

The end cover assembly 90-5 may include an end cover body 90-51, and at least a portion of the end cover body 90-51 is disposed at the end cover opening 90-113 to seal the end cover opening 90-113.

In order to fix the end cover body 90-51, the end cover assembly 90-5 may further include an end cover pressing cap 90-52, which is detachably mounted to the end cover opening 90-113 and is located outside the end cover body 90-51 to limit the end cover body 90-51 and prevent the end cover body 90-51 from being separated from the end cover opening 90-113 and causing leakage of the hydraulic end 90-01. For example, the end cover pressing cap 90-52 is threadedly connected to the end cover opening 90-113 to facilitate disassembly, assembly, and maintenance.

Figure 62:
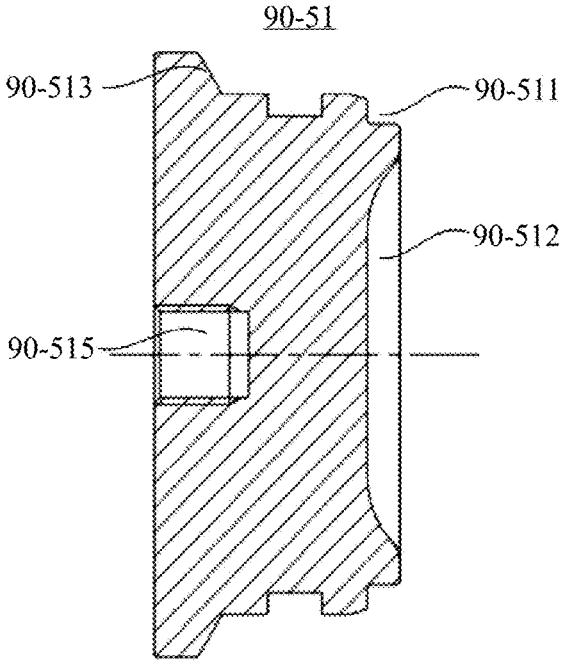
FIG. 62 is a schematic structural diagram of the end cover body according to an embodiment of the present disclosure.
Figure 63:
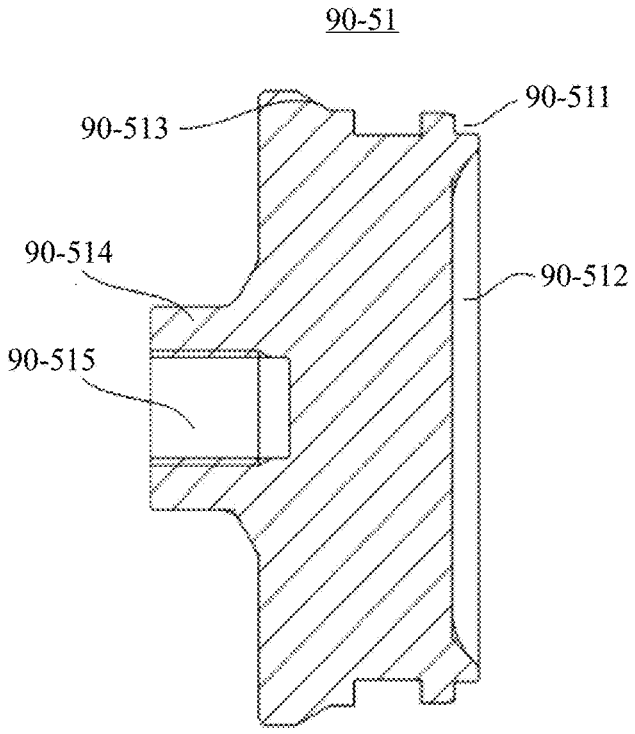
FIG. 63 is a schematic structural diagram of an end cover body with a protrusion according to an embodiment of the present disclosure.

With reference to FIG. 62 and FIG. 63, in some embodiments, the outer edge of the end of the end cover body 90-51 located in the end cover opening 90-113 may be provided with an annular groove 90-511. When the end cover body 90-51 is installed at the end cover opening 90-113, the annular groove 90-511 and the inner wall of the end cover opening 90-113 together form a limiting space, and the end of the protective portion 90-313 that is away from the support body 90-311 is located in the limiting space. In addition, the end of the protective portion 90-313 that is away from the support body 90-311 may be provided with an inner concave arc surface (i.e., a first contact surface 90-31311), and the inner concave arc surface contacts the groove wall of the annular groove 90-511. Based on this arrangement, the cooperation between the protective portion 90-313 and the end cover body 90-51 can be achieved through the cooperation between the inner concave arc surface and the groove wall of the annular groove 90-511, so that the high-pressure liquid can be separated from the connection area to achieve the protection of the connection area.

It should be noted here that the groove wall of the arc groove 90-31212 is an outer convex arc surface, which cooperates with the inner concave arc surface at one end of the protective portion 90-313 away from the support body 90-311, thereby increasing the contact area and improving the sealing effect.

In some embodiments, there may be a certain gap between the inner concave arc surface and the groove wall of the annular groove 90-511, and the gap is greater than 0 and less than 10 mm, for example, including 1 mm, 3 mm, 5 mm, 8 mm, 10 mm, etc. Based on the existence of the gap, the disassembly and assembly of the end cover body 90-51 can be facilitated, and the protective portion 90-313 can be prevented from interfering with the disassembly and assembly of the end cover body 90-51.

In some embodiments, the hydraulic end body 90-1 may also be provided with a plunger cavity 90-114 connected to the intersecting cavity 90-111, and the plunger cavity 90-114 and the end cover opening 90-113 are respectively located on both sides of the intersecting cavity 90-111. Accordingly, the hydraulic end 90-01 may also include a plunger 90-6, which is movably disposed in the plunger cavity 90-114 to pressurize the liquid in the intersecting cavity 90-111, thereby forming a high-pressure liquid.

Considering that the plunger 90-6 and the end cover body 90-51 are pressed in a plane, when the plunger 90-6 squeezes the liquid, part of the high-pressure liquid will impact the intersection line of the intersecting cavity 90-111, which will cause fatigue and cracks at the intersection line in the long run.

Based on the above situation, the plunger 90-6 and the end cover body 90-51 are pressed in a non-planar manner, which can help reduce the impact of high-pressure liquid on the intersection line, and help increase the stability of the plunger 90-6 during movement, and reduce the risk of eccentricity.

Figure 68:
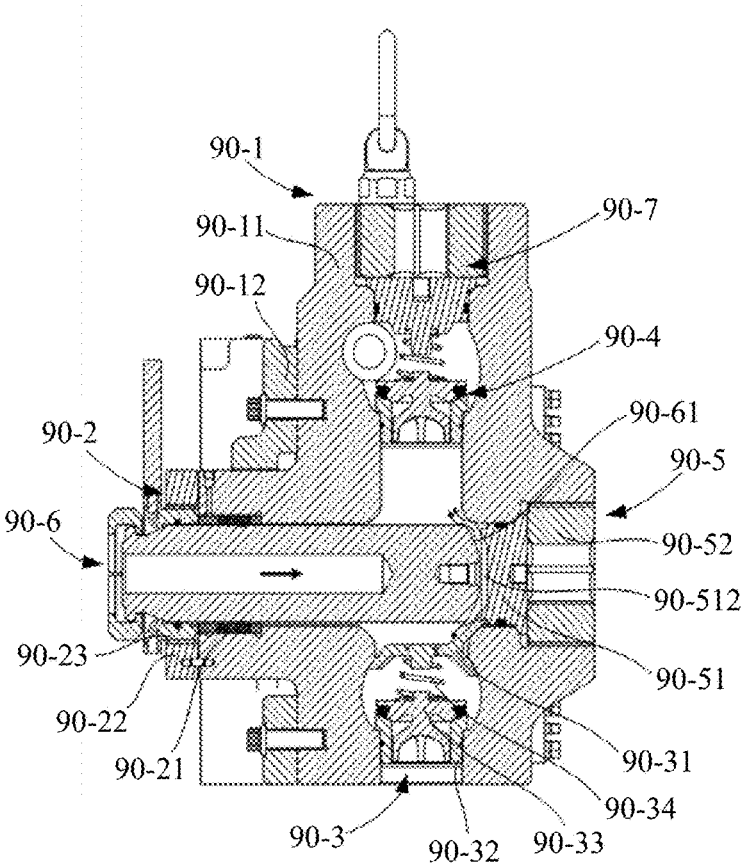
FIG. 68 is a cross-sectional schematic diagram of the hydraulic end with the plunger in the state of squeezing fluid according to an embodiment of the present disclosure.
Figure 69:
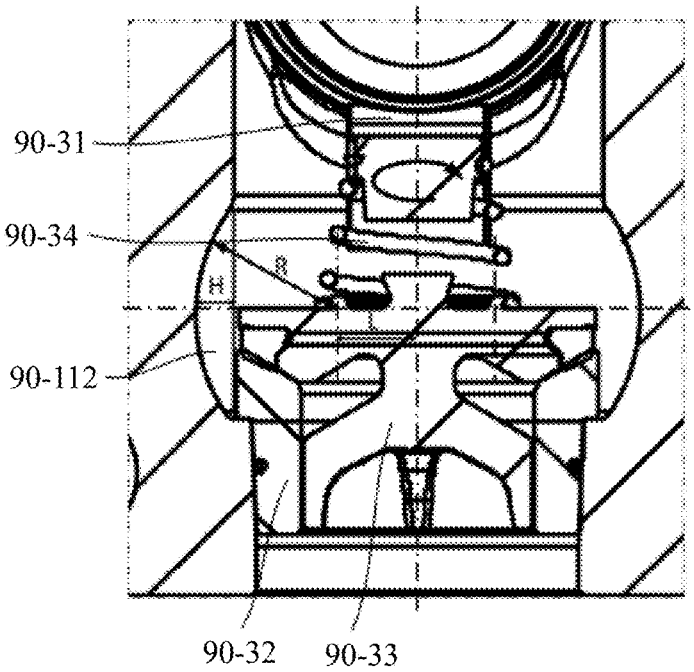
FIG. 69 is a partial schematic diagram of a first valve assembly positioned in a first valve cavity according to an embodiment of the present disclosure.

Optionally, as shown in FIG. 62, FIG. 63 and FIG. 68, the end of the plunger 90-6 facing the intersecting cavity 90-111 may be provided with a convex arc surface 90-61, and correspondingly, the end surface of the end cover body 90-51 facing the intersecting cavity 90-111 may be provided with a concave arc surface 90-512, and the convex arc surface 90-61 is adapted to the concave arc surface 90-512. Based on this arrangement, the high-pressure liquid squeezed by the plunger 90-6 can be diverted, thereby reducing the impact of the high-speed and high-pressure liquid on the intersection line, which is advantageous to extending the service life of the valve box 90-11.

Figure 64:
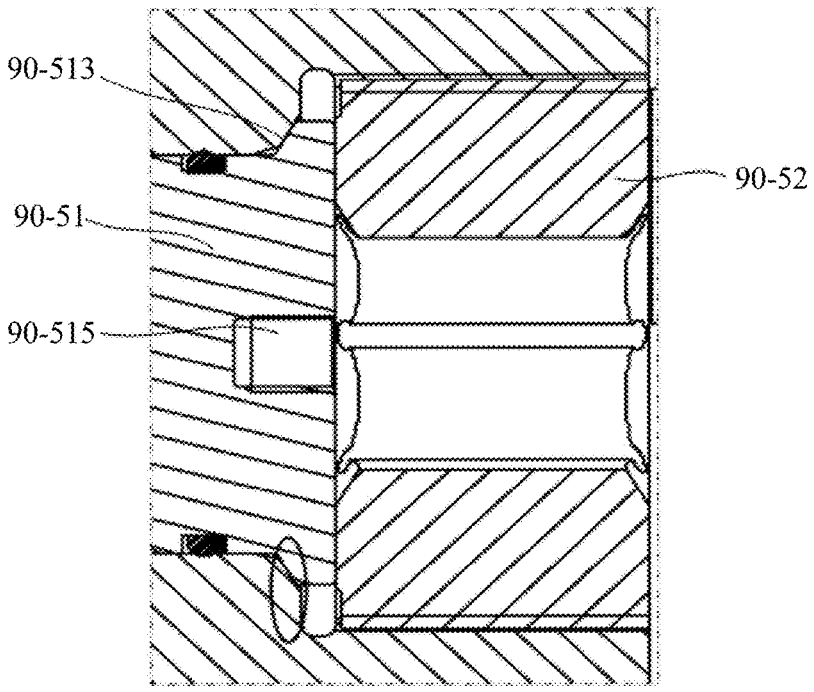
FIG. 64 is a partial schematic diagram of an end cover assembly according to an embodiment of the present disclosure.

Considering that the root of the end cover body 90-51 is prone to stress concentration under the action of high-pressure liquid, the end cover body 90-51 is easily damaged. Based on this situation, in some embodiments, the outer peripheral surface of the end cover body 90-51 in contact with the inner wall of the end cover opening 90-113 can be configured as a conical inclined surface 90-513 or an arc inclined surface, as shown in FIGS. 62 to 64, so that the stress concentration phenomenon at the root of the end cover body 90-51 can be alleviated, and the contact area is increased, and the surface pressure between the end cover body 90-51 and the inner wall of the end cover opening 90-113 is reduced.

As shown in FIG. 63, in some embodiments, the end surface of the end cover body 90-51 that is away from the end cover opening 90-113 may be provided with a protrusion 90-514, and the protrusion 90-514 may be provided with a threaded hole 90-515 along the protruding direction of the protrusion 90-514. Based on this, a puller with external threads may be installed to the threaded hole 90-515, thereby facilitating the disassembly and assembly of the end cover body 90-51 relative to end cover opening 90-113. It should be noted here that the end cover body 90-51 is installed to a certain depth in the end cover opening 90-113, and the disassembly and assembly of the end cover body 90-51 is facilitated by the assembly of the puller and the end cover body 90-51.

Of course, in the case of structural limitations, the end cover body 90-51 may not be provided with the protrusion 90-514, but a threaded hole 90-515 may be directly provided on the end surface of the end cover body 90-51 away from the end cover opening 90-113 to facilitate the installation of the puller.

In some embodiments, at least a portion of the protective portion 90-313 extends into the intersecting cavity 90-111, and the outer edge surface of the protective portion 90-313 that faces away from the support body 90-311 is limited by and fitted with the inner wall of the intersecting cavity 90-111. Based on this, the protective portion 90-313 and even the entire valve support 90-31 can be limited by the inner wall of the intersecting cavity 90-111 to prevent the valve support 90-31 from rotating around the axis.

Optionally, the inner wall of the intersecting cavity 90-111 can be configured to be arc-shaped or U-shaped to limit the protective portion 90-313 and prevent the valve support 90-31 from rotating freely around the axis.

In some embodiments, the cross-section of the intersecting cavity 90-111 perpendicular to the axis of the valve support 90-31 can be elliptical, and the inner wall of the intersecting cavity 90-111 of this shape can limit the valve support 90-31.

Referring to FIGS. 65 and 66, in some embodiments, at least part of the inner wall of the first valve cavity 90-112 may be a spherical surface 90-1121 or a quasi-spherical surface. Based on this configuration, when a high-speed fluid flows from the first valve cavity 90-112 to the intersecting cavity 90-111, the spherical surface 90-1121 or the quasi-spherical surface can reduce the resistance to the liquid, which is advantageous to increasing the flow rate, and can also reduce the formation of local vortices and dead zones, thereby alleviating the sand settling problem.

It should be noted here that when at least part of the inner wall of the first valve cavity 90-112 is a spherical surface 90-1121, the radius of the spherical surface 90-1121 may be R, which is formed by rotating an arc with a radius of R around an axis.

In some embodiments, the hydraulic end body 90-1 may include a valve box 90-11 and a back plate 90-12, where the back plate 90-12 is detachably connected to the valve box 90-11, and the valve box 90-11 and the back plate 90-12 are made of different materials.

Based on the above arrangement, the back plate 90-12 can be made independent from the valve box 90-11, and the separation of materials can be achieved, which can achieve the purpose of saving materials and costs to a certain extent.

It should be noted that the valve box 90-11 needs to bear a large load and needs a high-strength material, while the back plate 90-12 plays a mounting role and does not bear a large load, so the back plate 90-12 can be made of a relatively low-strength material. In this way, the use of high-strength materials can be reduced, and the cost can be reduced.

For example, the valve box 90-11 may be made of a high-strength alloy material, and the back plate 90-12 may be made of inexpensive carbon structural steel, such as Q235, Q355, etc., and may also be made of gray iron, cast iron, stainless steel, and other materials.

In addition, the back plate 90-12 may also be manufactured by casting to reduce the manufacturing cost.

To prevent liquid leakage between the plunger 90-6 and the hydraulic end body 90-1, the hydraulic end 90-01 in the present disclosure may include a hydraulic end body 90-1, a plunger 90-6 and a packing assembly 90-2, as shown in FIGS. 48 to 56.

The hydraulic end body 90-1 is a basic component, which can provide an installation foundation for the plunger 90-6, the packing assembly 90-2, etc. In some embodiments, the hydraulic end body 90-1 is provided with a plunger cavity 90-114, and the plunger 90-6 is movably disposed in the plunger cavity 90-114. The reciprocating movement of the plunger 90-6 can pressurize the liquid in the hydraulic end body 90-1 to form a high-pressure liquid.

The packing assembly 90-2 is used to seal the gap between the plunger 90-6 and the plunger cavity 90-114 to prevent liquid leakage. As shown in FIGS. 50 to 55, the packing assembly 90-2 may include a packing body 90-21, a first pressing member 90-22, and a second pressing member 90-23, wherein the packing body 90-21 is arranged between the outer wall of the plunger 90-6 and the inner wall of the plunger cavity 90-114 to seal the gap between the outer wall of the plunger 90-6 and the inner wall of the plunger cavity 90-114, thereby preventing liquid leakage.

For example, the packing body 90-21 may be a cylindrical structure, which is sleeved on the outside of the plunger 90-6 and penetrated into the plunger cavity 90-114. This type of packing body 90-21 may increase the sealing area and improve the sealing effect.

The first pressing member 90-22 is detachably connected to the hydraulic end body 90-1 and is sleeved on the outside of the plunger 90-6; the second pressing member 90-23 is sleeved on the outside of the plunger 90-6 and is detachably connected to the first pressing member 90-22, and at least part of the second pressing member 90-23 is arranged between the outer wall of the plunger 90-6 and the first pressing member 90-22, and abuts against the packing body 90-21.

Based on the above arrangement, the second pressing member 90-23 is mounted to the first pressing member 90-22, and the first pressing member 90-22 is mounted to the hydraulic end body 90-1, thereby ensuring the installation stability of the first pressing member 90-22 and the second pressing member 90-23, and the packing body 90-21 can be limited by the second pressing member 90-23 to prevent the packing body 90-21 from falling off under the pressure of the high-pressure liquid; the plunger 90-6 can pass through the first pressing member 90-22 and the second pressing member 90-23 to ensure that the plunger 90-6 can move back and forth without hindrance; in addition, the first pressing member 90-22 is detachably connected to the hydraulic end body 90-1, and the second pressing member 90-23 is detachably connected to the first pressing member 90-22, which can be easily disassembled and assembled, thereby facilitating the maintenance of the packing body 90-21. It should be noted here that the first pressing member 90-22 can be regarded as a packing pressing cap box, and the second pressing member 90-23 can be regarded as a packing pressing cap.

Compared with the method of directly connecting the packing pressing cap to the hydraulic end body 90-1, in the present disclosure, the second pressing member 90-23 used to limit the packing body 90-21 is not directly connected to the hydraulic end body 90-1, but is indirectly connected to the hydraulic end body 90-1 through the first pressing member 90-22. In this way, during the maintenance of the packing body 90-21, there is no need to disassemble the first pressing member 90-22, but only need to remove the second pressing member 90-23 from the first pressing member 90-22. Even if the assembly area is damaged after multiple disassembly and assembly, the hydraulic end body 90-1 will not be damaged. Instead, only the first pressing member 90-22 needs to be replaced alone, and the hydraulic end body 90-1 is not involved. Therefore, the service life of the hydraulic end body 90-1 is extended.

Figure 52:
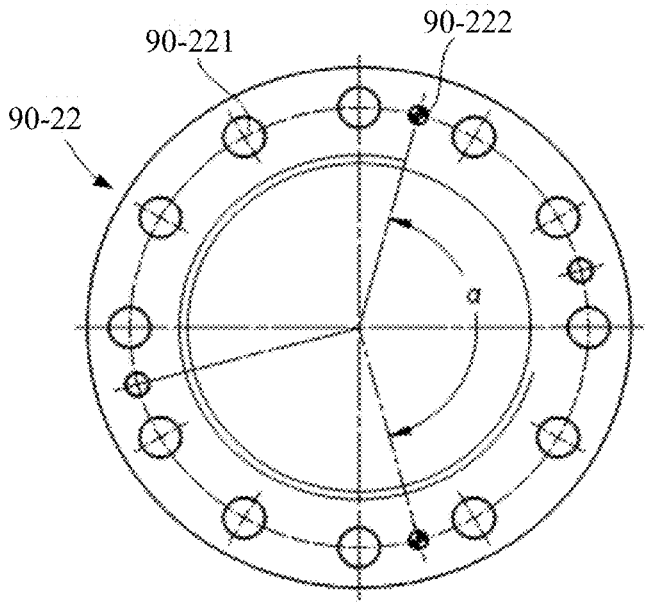
FIG. 52 is a schematic structural diagram of a first pressing member according to an embodiment of the present disclosure.

In some embodiments, the end surface of the hydraulic end body 90-1 may be provided with at least two first fixing holes, and the at least two first fixing holes are arranged along the circumference of the plunger cavity 90-114. Correspondingly, the first pressing member 90-22 may be provided with at least two second fixing holes 90-221. As shown in FIG. 52, the at least two second fixing holes 90-221 are respectively provided corresponding to the at least two first fixing holes, and fasteners are provided in the correspondingly provided first fixing holes and the second fixing holes 90-221.

Based on the above arrangement, the first pressing member 90-22 can be installed to the hydraulic end body 90-1 by fasteners, and can be easily disassembled and assembled to facilitate maintenance of the packing body 90-21; and, by fastening at least two groups of correspondingly arranged first fixing holes and second fixing holes 90-221 together by at least two fasteners, the stability of the connection between the first pressing member 90-22 and the hydraulic end body 1 can be further improved.

For example, the fastener may be a structural member with external threads, such as a bolt, a screw, a stud, etc. Correspondingly, the first fixing hole may have internal threads, thereby facilitating assembly and disassembly through threaded connection.

In some embodiments, the first pressing member 90-22 and the hydraulic end body 90-1 may also be connected in other detachable ways, such as snap connection, plug connection, hook connection, etc., which are not specifically limited here.

Figure 50:
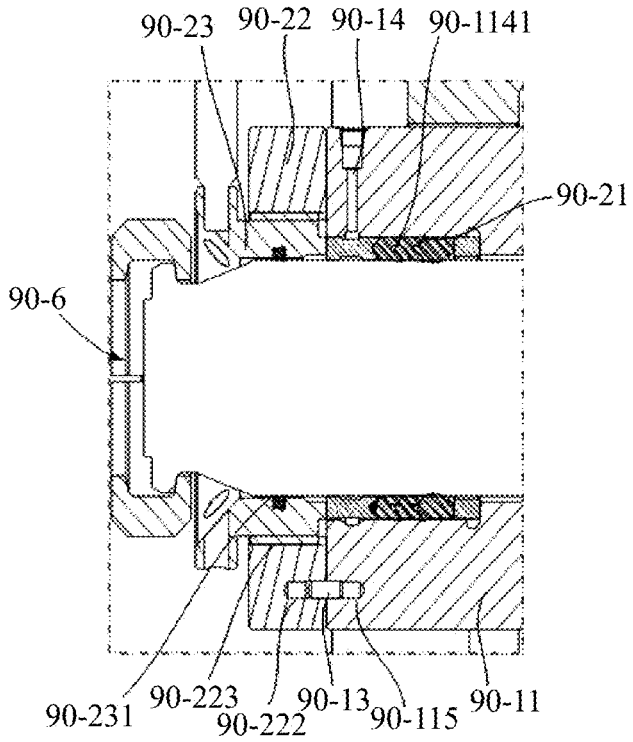
FIG. 50 is a first partial schematic diagram of the packing assembly according to an embodiment of the present disclosure.

Referring to FIGS. 50 and 52, in some embodiments, the end surface of the hydraulic end body 90-1 can also be provided with at least two first positioning holes 90-115, and the at least two first positioning holes 90-115 are arranged along the circumference of the plunger cavity 90-114; correspondingly, the first pressing member 90-22 can also be provided with at least two second positioning holes 90-222, and the at least two second positioning holes 90-222 are respectively arranged corresponding to the at least two first positioning holes 90-115, and positioning members 90-13 are provided in the corresponding first positioning holes 90-115 and the second positioning holes 90-222.

Based on the above arrangement, the first pressing member 90-22 can be positioned by the positioning member 90-13 to ensure the coaxiality of the first pressing member 90-22 and the plunger cavity 90-114 and prevent the first pressing member 90-22 from being eccentric; in addition, the second pressing member 90-23 is sleeved on the outside of the plunger 90-6 and is arranged on the first pressing member 90-22. Therefore, when the first pressing member 90-22 is not eccentric, the coaxiality of the second pressing member 90-23, the plunger 90-6 and the plunger cavity 90-114 can be ensured, thereby reducing or avoiding eccentricity between the plunger 90-6 and the second pressing member 90-23 and causing wear.

For example, the positioning member 90-13 may be a positioning pin, a positioning shaft or other structures. Of course, it may also be in other forms, which are not specifically limited here.

Optionally, the end surface of the hydraulic end body 90-1 may be provided with two first positioning holes 90-115, and the central angle between the two first positioning holes 90-115 may range from 90° to 180°, for example, including 90°, 120°, 135°, 150°, 180°, etc. Correspondingly, the first pressing member 90-22 may be provided with two second positioning holes 90-222, and the central angle between the second positioning holes 90-222 may also range from 90° to 180°, so as to be arranged correspondingly to the two first positioning holes 90-115.

Referring to FIGS. 50, 51, 53 to 55, in order to achieve assembly between the first pressing member 90-22 and the second pressing member 90-23, the first pressing member 90-22 can be provided with a first mounting hole 90-223, the plunger 90-6 is passed through the first mounting hole 90-223, and there is an annular space between the outer wall of the plunger 90-6 and the inner wall of the first mounting hole 90-223, one end of the second pressing member 90-23 is arranged in the annular space, and the outer wall of the second pressing member 90-23 is threadedly connected to the inner wall of the first mounting hole 90-223.

Based on the above arrangement, the second pressing member 90-23 can guide and limit the plunger 90-6 to ensure smooth movement of the plunger 90-6, and can also facilitate assembly and disassembly of the second pressing member 90-23 and the first pressing member 90-22, thereby facilitating maintenance of the packing body 90-21.

It should be noted here that before the first pressing member 90-22 with internal threads is separated from the hydraulic end body 90-1, a certain width of the undercut groove needs to be reserved when processing the internal threads. In the case of limited space, the length of the internal threads is reduced, which is not good to the stability of thread matching. After the first pressing member 90-22 with internal threads is separated from the hydraulic end body 90-1, there is no need to reserve the undercut groove, so that the part originally processed with the undercut groove can be set as the internal thread, so that the length of the internal thread can be increased, and the number of meshing threads within the same specification and length range is increased, so that the fatigue safety factor of the internal thread is improved, and then the service life is improved.

Of course, the second pressing member 90-23 may be provided with a second mounting hole 90-231 to facilitate the passage of the plunger 90-6.

Figure 51:
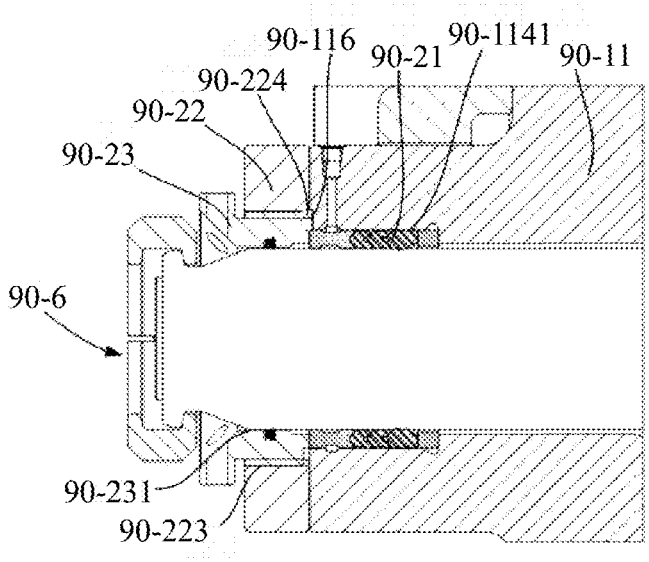
FIG. 51 is a second partial schematic diagram of the packing assembly according to an embodiment of the present disclosure.

Referring to FIG. 51, in some embodiments, one of the end surface of the hydraulic end body 90-1 and the end surface of the first pressing member 90-22 may be provided with a positioning protrusion 90-224, and the other may be provided with a positioning groove 90-116, and the positioning protrusion 90-224 is matched and connected with the positioning groove 90-116. Based on this arrangement, the coaxiality between the first pressing member 90-22 and the plunger cavity 90-114 can be further improved, thereby improving the coaxiality of the first pressing member 90-22, the second pressing member 90-23, the plunger 90-6 and the plunger cavity 90-114 as a whole, so as to prevent eccentricity and wear.

Figure 53:
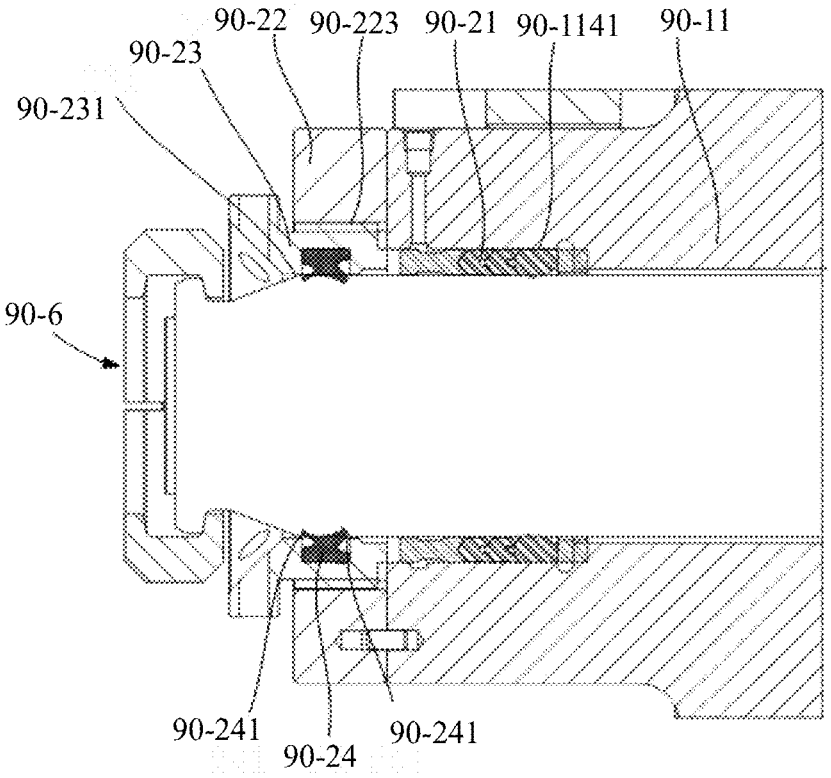
FIG. 53 is a third partial schematic diagram of the packing assembly according to an embodiment of the present disclosure.

Referring to FIG. 53, in some embodiments, a first oil ring 90-24 is provided between the plunger 90-6 and the second pressing member 90-23, and the first oil ring 90-24 includes two first lips 90-241, and the two first lips 90-241 are arranged opposite to each other along the axial direction of the plunger 90-6. Based on this arrangement, the first oil ring 90-24 with a double-lip structure can effectively prevent external impurities such as sand from entering the interior of the hydraulic end body 90-1, and can also prevent the leakage of liquid, grease, etc. inside the hydraulic end body 1, thereby effectively reducing the probability of liquid leakage, grease consumption, and packing damage.

Of course, when the thickness of the first oil ring 90-24 is relatively large, more first lips 90-241 may be provided and arranged along the axial direction of the plunger 90-6 to enhance the blocking effect.

Figure 54:
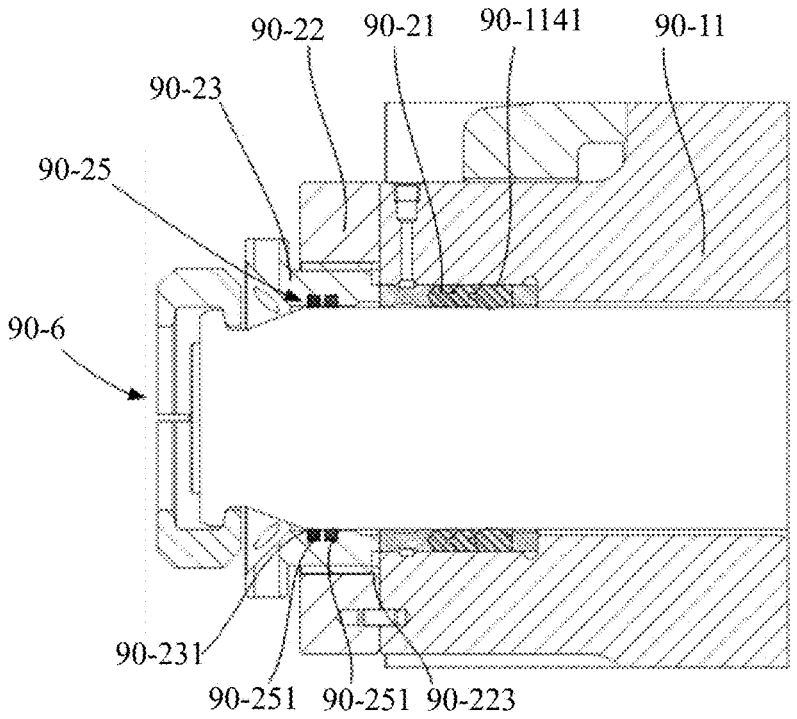
FIG. 54 is a fourth partial schematic diagram of the packing assembly according to an embodiment of the present disclosure.

Referring to FIG. 54, in other embodiments, at least two second oil rings 90-25 may be provided between the plunger 90-6 and the second pressing member 90-23, each second oil ring 90-25 includes a second lip 90-251, and the second lips 90-251 of two adjacent second oil rings 90-25 are arranged opposite to each other along the axial direction of the plunger 90-6. Based on this arrangement, the second lips 90-251 of at least two second oil rings 90-25 can be used to seal the plunger 90-6 and the second pressing member 90-23, so as to prevent impurities such as sand from entering the interior of the hydraulic end body 90-1, and also to prevent the leakage of liquid, grease, etc. inside the hydraulic end body 90-1, thereby effectively reducing the probability of liquid leakage, grease usage, and packing damage.

Furthermore, a spacer ring may be provided between the plunger 90-6 and the second pressing member 90-23, and the spacer ring is provided between two adjacent second oil rings 90-25. Based on this, the second lips 90-251 of two adjacent second oil rings 90-25 may be separated by the spacer ring to increase the sealing area in the axial direction of the plunger 90-6, and to a certain extent, the sealing effect may be improved.

Of course, the spacer ring may not be provided between the plunger 90-6 and the second pressing member 90-23, but two adjacent second oil rings 90-25 may be provided at intervals along the axial direction of the plunger 90-6. This method can also separate the second lips 90-251 of the two adjacent second oil rings 90-25 to increase the sealing area in the axial direction of the plunger 90-6, which can improve the sealing effect to a certain extent.

Referring to FIG. 50, FIG. 51, FIG. 53 to FIG. 55, in some embodiments, the inner wall of the plunger cavity 90-114 adjacent to one end of the first pressing member 90-22 may be provided with a receiving groove 90-1141, and the packing body 90-21 is sleeved on the outside of the plunger 90-6 and disposed in the receiving groove 90-1141. Based on this arrangement, a setting space can be provided for the packing body 90-21. In addition, the gap between the outer wall of the plunger 90-6 and the inner wall of the plunger cavity 90-114 can be blocked to ensure a sealing effect. In addition, the side wall of the receiving groove 90-1141 and the second pressing member 90-23 block the packing body 90-21 from both ends, so that the packing body 90-21 will not move with the plunger 90-6, thereby ensuring the stability of the packing body 90-21.

Figure 55:
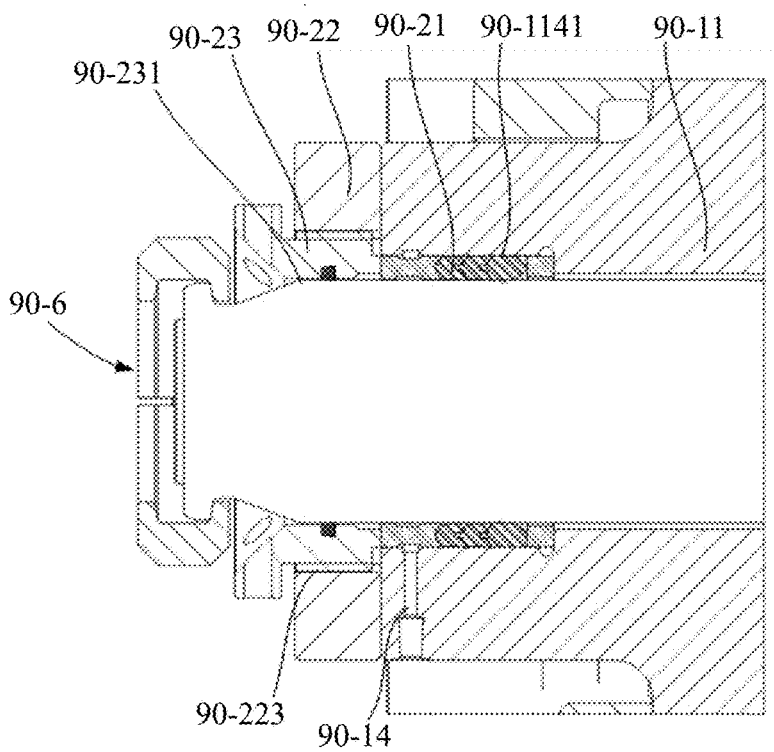
FIG. 55 is a fifth partial schematic diagram of the packing assembly according to an embodiment of the present disclosure.
Figure 56:
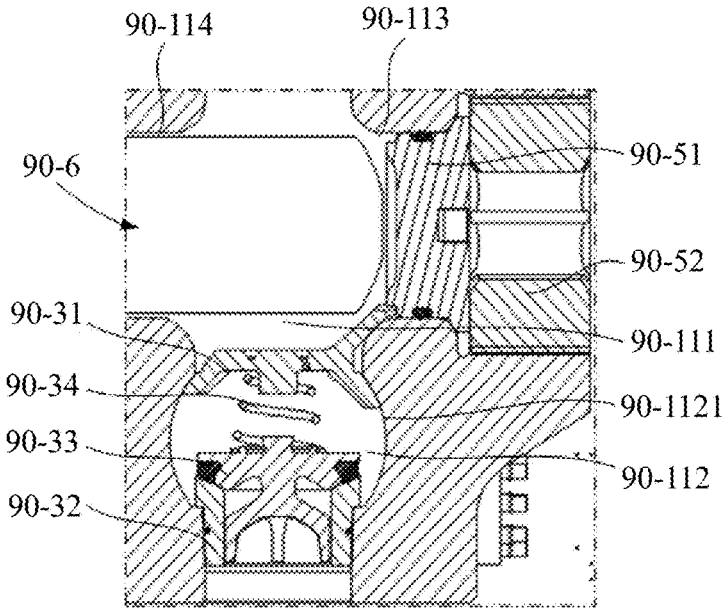
FIG. 56 is a partial schematic diagram of the first valve assembly and the end cover assembly according to an embodiment of the present disclosure.

Referring to FIG. 55, in some embodiments, the bottom wall of the hydraulic end body 90-1 may be provided with a lubrication channel 90-14, which is in communication with the plunger cavity 90-114 and is arranged corresponding to the packing body 90-21. Based on this arrangement, lubricating oil or grease can be added from the bottom of the hydraulic end body 90-1 to the packing body 90-21, so that the bottom of the plunger cavity 90-114 (e.g., the receiving groove 90-1141) at the packing body 90-21 can be first filled with lubricating oil or grease, and gradually increased upwards. In this process, the air in the plunger cavity 90-114 at the packing body 90-21 is gradually squeezed out, thereby achieving a thorough exhaust effect and preventing the presence of gas from affecting the storage of lubricating oil or grease.

In addition, the hydraulic end 90-01 may also include a second valve assembly 90-4 and an upper cover assembly 90-7, etc. Correspondingly, the hydraulic end body 1 may be provided with a second valve cavity, an upper cover cavity, etc. The second valve assembly 90-4 is provided in the second valve cavity, and the upper cover assembly is provided in the upper cover cavity.

Figure 70:
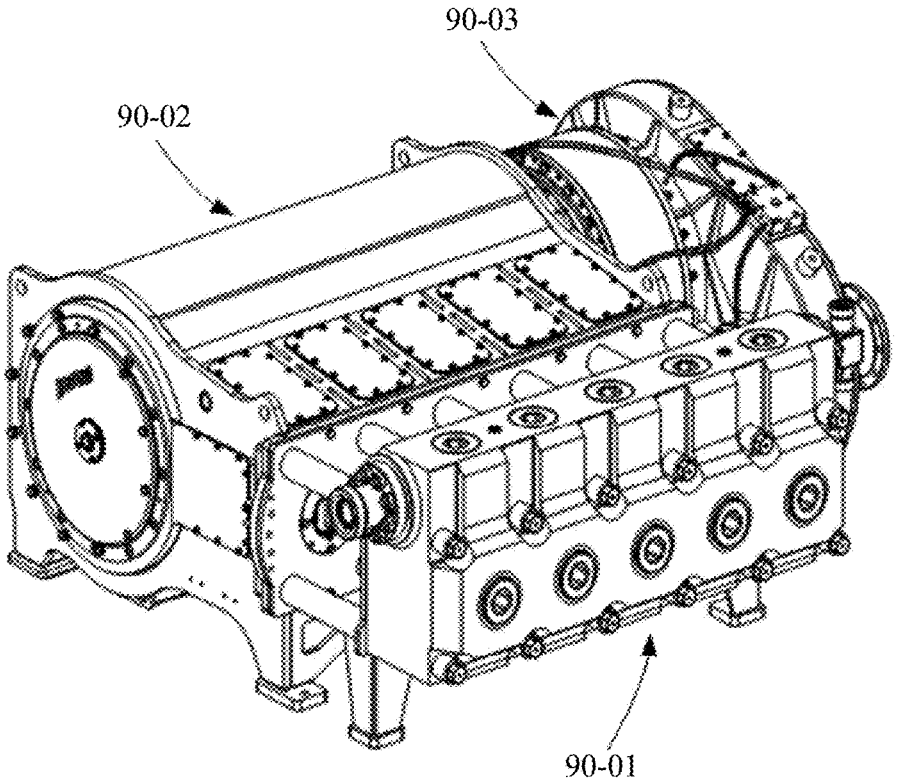
FIG. 70 is a schematic structural diagram of a fracturing pump according to an embodiment of the present disclosure.
Figure 71:
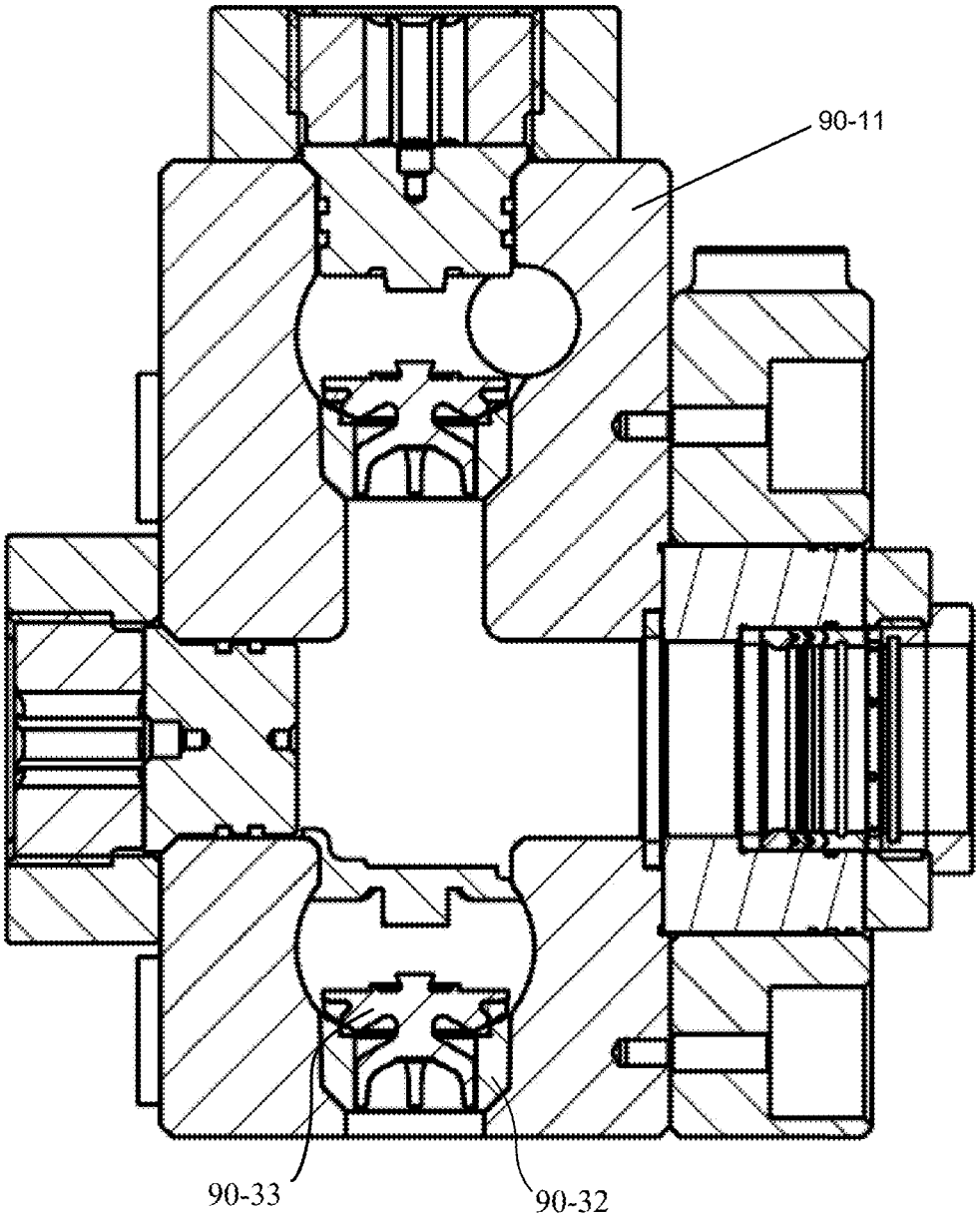
FIG. 71 is an illustration showing valve assemblies disposed in the valve cavities of a valve box according to an embodiment of the present disclosure.

Based on the above-mentioned hydraulic end 90-01, the present disclosure further includes a fracturing pump, and with reference to FIG. 70, the disclosed fracturing pump includes the above-mentioned hydraulic end 90-01. In addition, the fracturing pump may also include a power end 90-02 and a reduction device 90-03, the power end 90-02 is transmission-connected to the hydraulic end 90-01, and the reduction device 90-03 is transmission-connected to the power end 90-02, so as to reduce the speed of the motion output by the power source and transmit it to the power end 90-02, so as to drive the hydraulic end 90-01 to operate through the power end 90-02, thereby pressurizing the liquid, forming a high-pressure liquid, and finally supplying it to the fracturing position.

Figure 72:
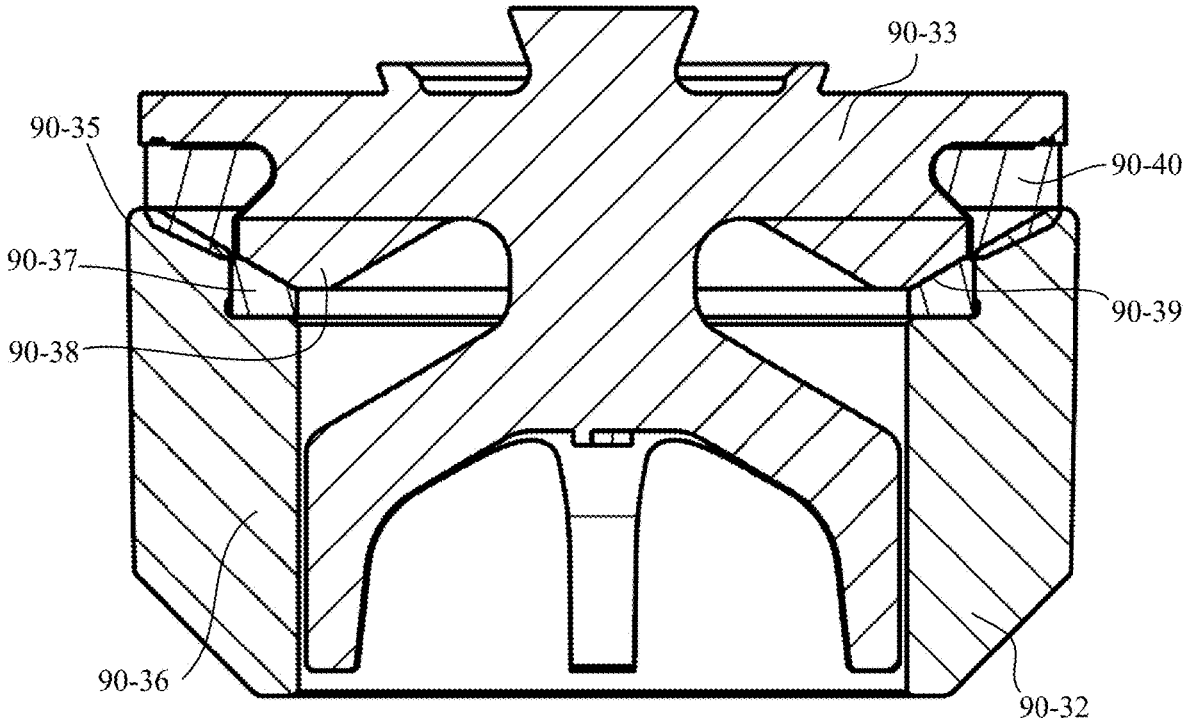
FIGS. 72 and 73 are illustrations showing a valve assembly including a valve seat and a valve member according to an embodiment of the present disclosure.
Figure 73:
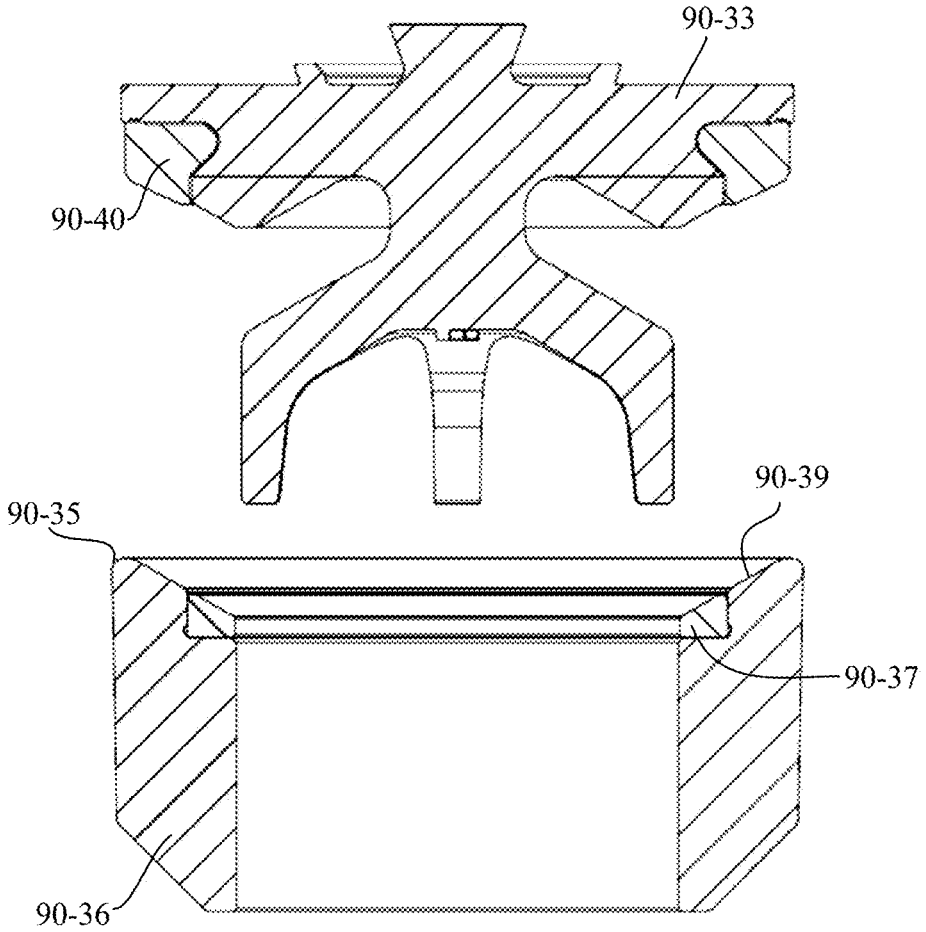
Figure 74:
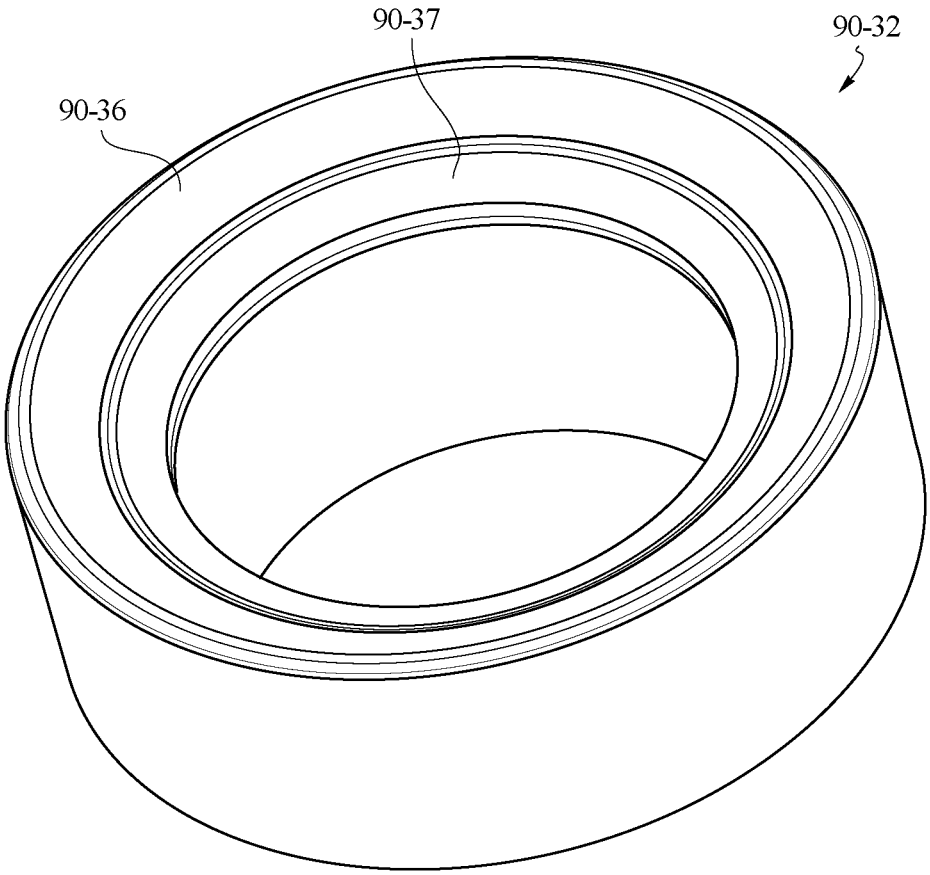
FIG. 74 is an illustration showing a valve seat according to an embodiment of the present disclosure.

Referring to FIGS. 71-74, in some embodiments, the valve sleeve/seat 90-32 and the valve box 90-11 adopt an embedded (e.g., fully embedded) configuration. In some embodiments, the valve seat 90-32 adopts a split structure, which is divided into the seat body 90-36 and gasket 90-37 (e.g., a reinforcement gasket). The gasket 90-37 is configured to cooperate with the metal segment seal 90-38 of the valve member 90-33, and the gasket may be strengthened with tungsten carbide or other similar hardening layers. The valve seat surface that matches with the valve member 90-33 has a continuous transition configuration. In some embodiments, as shown in FIGS. 72 and 74, the seat body 90-36 and the gasket 90-37 are assembled via an interference fit method, so that the gasket 90-37 is embedded in the cylindrical cavity of the seat body 90-36, and the upper parts of the seat body 90-36 and the gasket 90-37 cooperate to form a continuous, stepless conical surface 90-39 (transition surface). This conical surface ensures that it cooperates with the lower rubber 90-40 of the valve member 90-33, thereby achieving a sealing effect. In some embodiments, as shown in FIG. 72, the valve seat edge 90-35 has a rounded corner, which can reduce stress concentration, prevent cracking and damage, and the force applied on it is very uniform.

It should be noted here that the specific working principle of the fracturing pump can refer to the relevant technology and will not be elaborated here.

The subject matter of the disclosure may also relate, among others, to the following aspects:

In some embodiments:

A first aspect relates to a hydraulic end of a fracturing pump, comprising: a valve box and a packing assembly, wherein the packing assembly comprises a packing box, a packing box pressing cap, a packing, and a packing pressing cap, wherein the packing box is accommodated in an accommodating chamber of the valve box, wherein the packing box comprises a packing chamber and the packing chamber is configured to accommodate the packing, wherein the packing box pressing cap is detachably fixedly connected to the valve box, such that the packing box is limited in the accommodating chamber in an axial direction of the accommodating chamber, and wherein the packing pressing cap is detachably fixedly connected to the packing box pressing cap without contacting the valve box such that the packing is limited in the packing chamber in the axial direction of the accommodating chamber.

A second aspect relates to the hydraulic end of aspect 1, wherein the packing box pressing cap is configured with an internal thread, wherein the packing pressing cap is configured with an external thread, and wherein the packing pressing cap is in threaded connection with the packing box pressing cap.

A third aspect relates to the hydraulic end of any preceding aspect, wherein the packing box and the packing box pressing cap are combined as a single contiguous component.

A fourth aspect relates to the hydraulic end of any preceding aspect, wherein the packing box pressing cap is detachably fixedly connected to the valve box through a bolt, such that the packing box is detachably fixedly connected to the valve box.

A fifth aspect relates to the hydraulic end of any preceding aspect, further comprising a metal rigid sealing gasket ring, wherein the metal rigid sealing gasket ring is positioned between the packing box and the valve box, and wherein the metal rigid sealing gasket ring is clamped and sealed between the packing box and the valve box in the axial direction of the accommodating chamber.

A sixth aspect relates to the hydraulic end of any preceding aspect, furthering comprising a base plate abutted against the valve box with a lubrication channel, wherein the packing assembly passes through the base plate, and wherein a through hole is provided in the packing box, wherein the lubrication channel is communicated to the packing chamber of the packing box through the through hole, such that a lubrication grease or oil can be conveyed to a position of the packing in the packing chamber.

A seventh aspect relates to the hydraulic end of any preceding aspect, further comprising: a metal rigid sealing gasket ring, wherein the metal rigid sealing gasket ring is positioned between the packing box and the valve box, and wherein the metal rigid sealing gasket ring is clamped and sealed between the packing box and the valve box in an axial direction of the accommodating chamber.

An eighth aspect relates to the hydraulic end of any preceding aspect, wherein the metal rigid sealing gasket ring is made of corrosion-resistant metal material, and its hardness is less than that of the valve box and the packing box.

A ninth aspect relates to the hydraulic end of any preceding aspect, wherein a ring-shaped protrusion is arranged on an end surface of the packing box facing the metal rigid sealing gasket ring, and the ring-shaped protrusion is in annular sealing fit with the metal rigid sealing gasket ring.

A tenth aspect relates to the hydraulic end of any preceding aspect, wherein a cross-sectional shape of an inner side surface and an outer side surface of the metal rigid sealing gasket ring is a straight line or arc structure, wherein a cross-sectional shape of a left end surface of the metal rigid sealing gasket ring has at least one arc-shaped protrusion, and wherein a cross-sectional shape of a right end surface of the metal rigid sealing gasket ring has at least one arc-shaped protrusion.

An eleventh aspect relates to a hydraulic end of a fracturing pump, comprising: a valve box and a packing assembly, wherein the packing assembly comprises a packing box, a packing box pressing cap, a packing, and a packing pressing cap, wherein the packing box is accommodated in an accommodating chamber of the valve box, and wherein the packing box pressing cap is detachably fixedly connected to the valve box via a bolt, such that the packing box is detachably fixedly connected to the valve box.

A twelfth aspect relates to the hydraulic end of aspect 11, wherein the packing pressing cap is detachably fixedly connected to the packing box pressing cap.

A thirteenth aspect relates to the hydraulic end of any one of aspects 11 or 12, wherein the packing box pressing cap is configured with an internal thread, wherein the packing pressing cap is configured with an external thread, and wherein the packing pressing cap is in threaded connection with the packing box pressing cap.

A fourteenth aspect relates to the hydraulic end of any one of aspects 11 to 13, further comprising a metal rigid sealing gasket ring, wherein the metal rigid sealing gasket ring is positioned between the packing box and the valve box, and wherein the metal rigid sealing gasket ring is clamped and sealed between the packing box and the valve box in an axial direction of the accommodating chamber.

A fifteenth aspect relates to the hydraulic end of any one of aspects 11 to 14, furthering comprising a base plate abutted against the valve box with a lubrication channel, wherein the packing assembly passes through the base plate, and wherein a through hole is provided in the packing box, wherein the lubrication channel is communicated to a packing chamber of the packing box through the through hole, such that a lubrication grease or oil can be conveyed to a position of the packing in the packing chamber.

A sixteenth aspect relates to a hydraulic end of a fracturing pump, comprising: a valve box and a packing assembly, wherein the packing assembly comprises a packing box pressing cap, a packing, and a packing pressing cap, wherein the packing is accommodated in an accommodating chamber of the valve box, wherein the packing box pressing cap is detachably fixedly connected to the valve box, wherein one of an end surface of the valve box and an end surface of the packing box pressing cap is configured with a positioning protrusion, and the other one of the end surfaces of the valve box and the packing box pressing cap is configured with a positioning groove, and wherein the positioning protrusion is matched and connected with the positioning groove.

A seventeenth aspect relates to the hydraulic end of aspect 16, wherein the packing pressing cap is detachably fixedly connected to the packing box pressing cap.

An eighteenth aspect relates to the hydraulic end of any one of aspects 16 or 17, wherein the packing box pressing cap is configured with an internal thread, wherein the packing pressing cap is configured with an external thread, and wherein the packing pressing cap is in threaded connection with the packing box pressing cap.

A nineteenth aspect relates to the hydraulic end of any one of aspects 16 to 18, wherein the packing box pressing cap is detachably fixedly connected to the valve box through a bolt.

A twentieth aspect relates to the hydraulic end of any one of aspects 16 to 19, wherein the valve box further comprises a lubrication channel, which is communicated to the accommodating chamber such that a lubrication grease can be conveyed to a position of the packing in the accommodating chamber.

In some embodiments:

A first aspect relates to a hydraulic end of a fracturing pump, comprising: a valve box and a functional device, wherein the functional device comprises at least one of a base plate, an end cover assembly, and a packing assembly, and wherein the functional device is replaceable and is detachably fixedly connected to the valve box.

A second aspect relates to the hydraulic end of aspect 1, wherein the base plate includes a lubrication channel configured to allow lubrication grease or oil to be conveyed to a position of the packing assembly.

A third aspect relates to the hydraulic end of any preceding aspect, wherein the lubrication channel is provided on a bottom wall of the base plate.

A fourth aspect relates to the hydraulic end of any preceding aspect, wherein a through hole is provided in a packing box of the packing assembly, wherein the lubrication channel is communicated to a packing chamber of the packing box through the through hole, such that the lubrication grease or oil can be conveyed to a position of a packing in the packing chamber.

A fifth aspect relates to the hydraulic end of any preceding aspect, wherein a plurality of through holes are uniformly spaced apart on the packing box around an axial direction of an accommodating chamber configured to accommodate the packing assembly, and wherein the lubrication channel is communicated to the packing chamber through the plurality of through holes.

A sixth aspect relates to the hydraulic end of any preceding aspect, further comprising corresponding positioning pin holes between the base plate and the valve box, wherein positioning pins are installed in the corresponding positioning pin holes to ensure that a center line of a cavity of the base plate and a center line of a corresponding cavity of the valve box are coaxial.

A seventh aspect relates to the hydraulic end of any preceding aspect, wherein the valve box and the base plate are made of different materials.

An eighth aspect relates to a hydraulic end of a fracturing pump, comprising: a valve box, a base plate, a packing, a packing box, and a spacer frame; wherein the base plate is detachably fixedly connected to the valve box through a bolt, wherein the base plate is configured to support the packing box and the spacer frame, and wherein the base plate includes a lubrication channel configured to allow lubrication grease or oil to be conveyed to a position of the packing.

A ninth aspect relates to the hydraulic end of aspect 8, wherein the lubrication channel is provided on a bottom wall of the base plate.

A tenth aspect relates to the hydraulic end of any one of aspects 8 or 9, wherein a through hole is provided in the packing box, wherein the lubrication channel is communicated to a packing chamber of the packing box through the through hole, such that the lubrication grease or oil can be conveyed to a position of the packing in the packing chamber.

An eleventh aspect relates to the hydraulic end of any one of aspects 8 to 10, wherein a plurality of through holes are uniformly spaced apart on the packing box around an axial direction of an accommodating chamber configured to accommodate the packing box, and wherein the lubrication channel is communicated to a packing chamber of the packing box through the plurality of through holes.

A twelfth aspect relates to the hydraulic end of any one of aspects 8 to 11, further comprising corresponding positioning pin holes between the base plate and the valve box, wherein positioning pins are installed in the corresponding positioning pin holes to ensure that a center line of a cavity of the base plate and a center line of a corresponding cavity of the valve box are coaxial.

A thirteenth aspect relates to the hydraulic end of any one of aspects 8 to 12, wherein the valve box and the base plate are made of different materials.

A fourteenth aspect relates to the hydraulic end of any one of aspects 8 to 13, wherein the spacer frame and the base plate are combined into a new spacer frame as a single part, and wherein an end surface of the new spacer frame facing the hydraulic end is fitted with the valve box.

A fifteenth aspect relates to a hydraulic end of a fracturing pump, comprising: a valve box, a base plate, and a packing assembly, wherein the base plate is detachably fixedly connected to the valve box, and wherein the packing assembly is detachably fixedly connected to the valve box.

A sixteenth aspect relates to the hydraulic end of aspect 15, wherein the base plate is detachably fixedly connected to the valve box through a bolt.

A seventeenth aspect relates to the hydraulic end of any one of aspects 15 or 16, further comprising corresponding positioning pin holes between the base plate and the valve box, wherein positioning pins are installed in the corresponding positioning pin holes to ensure that a center line of a cavity of the base plate and a center line of a corresponding cavity of the valve box are coaxial.

An eighteenth aspect relates to the hydraulic end of any one of aspects 15 to 17, wherein the base plate includes a lubrication channel configured to allow lubrication grease or oil to be conveyed to a position of the packing assembly.

A nineteenth aspect relates to the hydraulic end of any one of aspects 15 to 18, wherein a through hole is provided in a packing box of the packing assembly, wherein the lubrication channel is communicated to a packing chamber of the packing box through the through hole, such that the lubrication grease or oil can be conveyed to a position of a packing in the packing chamber.

A twentieth aspect relates to the hydraulic end of any one of aspects 15 to 19, wherein a plurality of through holes are uniformly spaced apart on a packing box of the packing assembly around an axial direction of an accommodating chamber configured to accommodate the packing assembly, and wherein the lubrication channel is communicated to a packing chamber of the packing box through the plurality of through holes.

In some embodiments:

A first aspect relates to a hydraulic end of a fracturing pump, comprising: a valve box, a plunger, and an end cover assembly, wherein the valve box comprises a plunger cavity and the plunger cavity is configured to accommodate the plunger and is provided with an end cover opening, wherein the end cover assembly is detachably fixedly connected to the valve box at the end cover opening, and comprises an end cover, an end cover pressing cap, and an end cover pressing cap box, wherein at least a portion of the end cover is accommodated in the end cover opening, and wherein an end surface of the end cover facing the plunger cavity of the valve box is provided with a concave arc surface curved away from the plunger cavity which is configured to divert a high-pressure liquid squeezed by a plunger.

A second aspect relates to the hydraulic end of aspect 1, wherein an end of the plunger facing the end cover opening of the plunger cavity of the valve box is provided with a convex arc surface.

A third aspect relates to the hydraulic end of any preceding aspect, wherein the end cover pressing cap box is detachably fixedly connected to the valve box via a bolt.

A fourth aspect relates to the hydraulic end of any preceding aspect, wherein the end cover pressing cap box is detachably fixedly connected to the valve box, wherein the end cover pressing cap is detachably fixedly connected to the end cover pressing cap box, and wherein the end cover is pressingly restricted in the end cover opening in an axial direction of the end cover opening.

A fifth aspect relates to the hydraulic end of any preceding aspect, wherein an outer wall surface of the end cover around an axial direction of the end cover opening and an inner wall surface of the end cover opening around the axial direction of the end cover opening each comprise a matching surface, and the matching surfaces are both of circular-truncated side surface structures.

A sixth aspect relates to the hydraulic end of any preceding aspect, wherein the end cover pressing cap forms a detachably fixed connection relationship with the end cover pressing cap box via a threaded connection.

A seventh aspect relates to the hydraulic end of any preceding aspect, wherein the end cover pressing cap box includes a plurality of through holes on a circumference, and wherein the valve box includes threaded holes that correspond one by one to the through holes of the end cover pressing cap box, the plurality of through holes and the threaded holes being configured to insert studs or screws or bolts to fix the end cover pressing cap box to the valve box.

An eighth aspect relates to the hydraulic end of any preceding aspect, wherein the plurality of through holes on the circumference of the end cover pressing cap box are not uniformly distributed along the circumference.

A ninth aspect relates to a hydraulic end of a fracturing pump, comprising: a valve box, a plunger, and an end cover assembly, wherein the valve box is provided with a plunger cavity to accommodate the plunger, and the end cover opening is located on one end of the plunger cavity away from the plunger, wherein the end cover assembly is detachably fixedly connected to the valve box at the end cover opening, and comprises an end cover, an end cover pressing cap, and an end cover pressing cap box, wherein at least a portion of the end cover is accommodated in the end cover opening, wherein the plunger is movably disposed in the plunger cavity; and wherein an end of the plunger facing the end cover opening of the plunger cavity is provided with a convex arc surface.

A tenth aspect relates to the hydraulic end of aspect 9, wherein an end surface of the end cover facing the plunger is provided with a cancave arc surface curved away from the plunger cavity.

An eleventh aspect relates to the hydraulic end of any one of aspects 9 or 10, wherein the end cover pressing cap box is detachably fixedly connected to the valve box via a bolt.

A twelfth aspect relates to the hydraulic end of any one of aspects 9 to 11, wherein an outer wall surface of the end cover around an axial direction of the end cover opening and an inner wall surface of the end cover opening around the axial direction of the end cover opening each comprise a matching surface, and the matching surfaces are both of circular-truncated side surface structures.

A thirteenth aspect relates to the hydraulic end of any one of aspects 9 to 12, wherein the end cover pressing cap forms a detachably fixed connection relationship with the end cover pressing cap box via a threaded connection.

A fourteenth aspect relates to the hydraulic end of any one of aspects 9 to 13, wherein the end cover pressing cap box includes a plurality of through holes on a circumference, and wherein the valve box includes threaded holes that correspond one by one to the through holes of the end cover pressing cap box, the plurality of through holes and the threaded holes being configured to insert studs or screws or bolts to fix the end cover pressing cap box to the valve box.

A fifteenth aspect relates to the hydraulic end of any one of aspects 9 to 14, wherein the plurality of through holes on the circumference of the end cover pressing cap box are not circumferentially uniformly distributed.

A sixteenth aspect relates to the hydraulic end of any one of aspects 9 to 15, wherein an end surface of the end cover that is away from the end cover opening is provided with a threaded hole configured to connect with a puller with external threads.

A seventeenth aspect relates to a hydraulic end of a fracturing pump, comprising: a valve box and an end cover assembly, wherein the end cover assembly is detachably fixedly connected to the valve box, wherein the valve box is provided with an end cover opening, wherein the end cover assembly comprises an end cover, an end cover pressing cap, and an end cover pressing cap box, and wherein at least a portion of the end cover is accommodated in the end cover opening.

An eighteenth aspect relates to the hydraulic end of aspect 17, wherein the end cover pressing cap box is detachably fixedly connected to the valve box via a bolt.

A nineteenth aspect relates to the hydraulic end of any one of aspects 17 or 18, wherein the end cover pressing cap box is detachably fixedly connected to the valve box via a double-ended stud with different thread specifications at both ends.

A twentieth aspect relates to the hydraulic end of any one of aspects 17 to 19, wherein the valve box includes a front boss, and the front boss has a plurality of threaded holes corresponding to a plurality of through holes of the end cover pressing cap box, which are configured to insert studs or bolts to fix the end cover pressing cap box to the valve box.

In some embodiments:

A first aspect relates to a hydraulic end of a fracturing pump, comprising: a valve box and a first valve assembly, wherein the valve box comprises a first valve cavity, wherein the first valve assembly comprises a valve seat, a valve member, an elastic member, and a valve support, wherein the valve seat is embedded into the first valve cavity, the valve member is movably disposed relative to the valve seat, wherein a valve seat surface that seals and stop the valve member comprises two portions with a continuous transition, wherein the valve support is fixedly disposed at a port of the first valve cavity adjacent to an intersecting plunger cavity of the valve box, and wherein the elastic member is elastically connected between the valve member and the valve support.

A second aspect relates to the hydraulic end of aspect 1, wherein the valve seat has a split configuration, comprising a seat body and a gasket.

A third aspect relates to the hydraulic end of any preceding aspect, wherein the gasket is formed using a metal material with high hardness or strengthened with a hardened layer.

A fourth aspect relates to a hydraulic end of a fracturing pump, comprising: a valve box and a first valve assembly, wherein the valve box comprises a first valve cavity, wherein the first valve assembly comprises a valve support, the valve support comprising a support body, a leg portion, and a protective portion, and wherein the leg portion is connected to an inner wall of the first valve cavity, and the protective portion shields a connection area between the first valve cavity and an intersecting plunger cavity of the valve box.

A fifth aspect relates to the hydraulic end of aspect 4, wherein the support body comprises a first end surface and a second end surface, wherein the first end surface and the second end surface are arranged opposite to each other along an axis of the valve support, wherein the protective portion extends obliquely from the first end surface in a direction away from the axis, and wherein the leg portion extends obliquely from the second end surface in a direction away from the axis of the valve support.

A sixth aspect relates to the hydraulic end of any one of aspects 4 or 5, wherein the protective portion includes a first protective segment and a second protective segment, wherein the second protective segment is connected between the first protective segment and the support body, and wherein the first protective segment and the second protective segment have different extension directions, so that a certain angle is formed between the first and second protective segments.

A seventh aspect relates to the hydraulic end of any one of aspects 4 to 6, wherein the first protective segment includes a first contact surface and a second contact surface disposed opposite to each other along an axial direction of the valve support, wherein the first contact surface is configured for a sealing connection with an end cover assembly, and the second contact surface is configured for contact with the connection area.

An eighth aspect relates to the hydraulic end of any one of aspects 4 to 7, wherein the first contact surface is a concave arc surface, which cooperates well with the end cover assembly, and wherein the second contact surface is a convex arc surface, which contacts well with the connection area through the convex arc surface.

A ninth aspect relates to the hydraulic end of any one of aspects 4 to 8, wherein the second protective segment includes a third contact surface facing away from the support body, and wherein the third contact surface is an outer convex arc surface, which forms a good contact with the connection area through the outer convex arc surface.

A tenth aspect relates to the hydraulic end of any one of aspects 4 to 9, wherein a fourth contact surface is provided on a side of the leg portion facing away from the support body, and wherein the fourth contact surface is an outer convex arc surface so as to adapt to a shape of the inner wall of the first valve cavity, thereby forming a good contact with the inner wall of the first valve cavity.

An eleventh aspect relates to the hydraulic end of any one of aspects 4 to 10, wherein at least a portion of the inner wall of the first valve cavity is a spherical surface or a spherical-like surface, and wherein the fourth contact surface of the leg portion is also a spherical surface or a spherical-like surface to adapt to the shape of the inner wall of the first valve cavity.

A twelfth aspect relates to the hydraulic end of any one of aspects 4 to 11, wherein at least a portion of the protective portion extends into the intersecting plunger cavity, and an outer edge surface of the protective portion that faces away from the support body is limited by and fitted with the inner wall of the intersecting plunger cavity, such that the protective portion is limited by the inner wall of the intersecting plunger cavity to prevent the valve support from rotating around an axis of the valve support.

A thirteenth aspect relates to the hydraulic end of any one of aspects 4 to 12, wherein a cross-section of the intersecting plunger cavity perpendicular to the axis of the valve support is elliptical to limit the protective portion and prevent the valve support from rotating freely around the axis of the valve support.

A fourteenth aspect relates to the hydraulic end of any one of aspects 4 to 13, wherein a width dimension of a part or all of the protective portion in a first direction is greater than a width dimension of the support body in the first direction.

A fifteenth aspect relates to the hydraulic end of any one of aspects 4 to 14, wherein along an extension direction of the protective portion, the width dimension of the protective portion in the first direction gradually increases.

A sixteenth aspect relates to a valve support, used for a hydraulic end of a fracturing pump, comprising: a support body, a leg portion, and a protective portion, wherein the support body comprises a first end surface and a second end surface, wherein the first end surface and the second end surface are arranged opposite to each other along an axis of the valve support, wherein the protective portion extends obliquely from the first end surface in a direction away from the axis of the valve support, and wherein the leg portion extends obliquely from the second end surface in a direction away from the axis of the valve support.

A seventeenth aspect relates to the valve support of aspect 16, wherein the protective portion includes a first protective segment and a second protective segment, wherein the second protective segment is connected between the first protective segment and the support body, and wherein the first protective segment and the second protective segment have different extension directions, so that a certain angle is formed between the first and second protective segments.

An eighteenth aspect relates to the valve support of any one of aspects 16 or 17, wherein the first protective segment includes a first contact surface and a second contact surface disposed opposite to each other along an axial direction of the valve support, wherein the first contact surface is a concave arc surface, and wherein the second contact surface is a convex arc surface.

A nineteenth aspect relates to the valve support of any one of aspects 16 to 18, wherein a fourth contact surface is provided on a side of the leg portion facing away from the support body, and wherein the fourth contact surface is an outer convex arc surface.

A twentieth aspect relates to the valve support of any one of aspects 16 to 19, wherein a width dimension of a part or all of the protective portion in a first direction is greater than a width dimension of the support body in the first direction, and wherein along an extension direction of the protective portion, the width dimension of the protective portion in the first direction gradually increases.

It should be noted that the terms "include", "comprise", or any other variations thereof herein are intended to cover a non-exclusive inclusion, so that a processor, method, object, or apparatus including a series of elements not only includes those elements, but also includes other elements not specifically listed, or includes inherent elements of this process, method, object, or apparatus. Without more limitations, elements defined by the sentence "including one" does not exclude that there are still other same elements in the process, method, object, or apparatus including these elements. In addition, it should be noted that the scope of the methods and devices in the embodiments of the present application is not limited to executing functions in the order shown or discussed, but may alternatively include executing functions in a substantially simultaneous manner or in an opposite order according to the functions involved. For example, the methods described may be executed in a different order than that described, and steps may alternatively be added, omitted, or combined. In addition, features described with reference to some examples may alternatively be combined in other examples.

The embodiments of the present application have been described above with reference to the accompanying drawings. The present application is not limited to the specific implementations described above, and the specific implementations described above are merely examples and not limitative. Those of ordinary skill in the art may make many forms under the teaching of the present application without departing from the spirit of the present application and the protection scope of the claims, and these forms shall all fall within the protection of the present application.

The invention claimed is:

1. A hydraulic end of a fracturing pump, comprising:

a valve box and a packing assembly, wherein the packing assembly comprises a packing box, a packing box pressing cap, a packing, and a packing pressing cap, wherein the packing box is accommodated in an accommodating chamber of the valve box, wherein the packing box comprises a packing chamber and the packing chamber is configured to accommodate the packing, wherein the packing box pressing cap is detachably fixedly connected to the valve box, such that the packing box is limited in the accommodating chamber in an axial direction of the accommodating chamber, wherein the packing pressing cap is detachably fixedly connected to the packing box pressing cap without contacting the valve box such that the packing is limited in the packing chamber in the axial direction of the accommodating chamber, wherein the hydraulic end further comprises a metal rigid sealing gasket ring, wherein the metal rigid sealing gasket ring is positioned between the packing box and the valve box, wherein the metal rigid sealing gasket ring is clamped and sealed between the packing box and the valve box in the axial direction of the accommodating chamber, wherein a ring-shaped protrusion is arranged on an end surface of the packing box facing the metal rigid sealing gasket ring, and the ring-shaped protrusion is in annular sealing fit with the metal rigid sealing gasket ring, and wherein the packing box is outside of the valve box except the ring-shaped protrusion.

2. The hydraulic end of claim 1, wherein the packing box pressing cap is configured with an internal thread, wherein the packing pressing cap is configured with an external thread, and wherein the packing pressing cap is in threaded connection with the packing box pressing cap.

3. The hydraulic end of claim 1, wherein the packing box and the packing box pressing cap are combined as a single contiguous component.

4. The hydraulic end of claim 1, wherein the packing box pressing cap is detachably fixedly connected to the valve box through a bolt, such that the packing box is detachably fixedly connected to the valve box.

5. The hydraulic end of claim 1, furthering comprising a base plate abutted against the valve box with a lubrication channel, wherein the packing assembly passes through the base plate, and wherein a through hole is provided in the packing box, wherein the lubrication channel is communicated to the packing chamber of the packing box through the through hole, such that a lubrication grease or oil can be conveyed to a position of the packing in the packing chamber.

6. The hydraulic end of claim 1, wherein the metal rigid sealing gasket ring is made of corrosion-resistant metal material, and its hardness is less than that of the valve box and the packing box.

7. The hydraulic end of claim 1, wherein a cross-sectional shape of an inner side surface and an outer side surface of the metal rigid sealing gasket ring is a straight line or arc structure, wherein a cross-sectional shape of a left end surface of the metal rigid sealing gasket ring has at least one arc-shaped protrusion, and wherein a cross-sectional shape of a right end surface of the metal rigid sealing gasket ring has at least one arc-shaped protrusion.

8. A hydraulic end of a fracturing pump, comprising:

a valve box and a packing assembly, wherein the packing assembly comprises a packing box, a packing box pressing cap, a packing, and a packing pressing cap, wherein at least a portion of the packing box is accommodated in an accommodating chamber of the valve box, wherein the packing box pressing cap is detachably fixedly connected to the valve box via a bolt, such that the packing box is detachably fixedly connected to the valve box, wherein the hydraulic end further comprises a metal rigid sealing gasket ring, wherein the metal rigid sealing gasket ring is positioned between the packing box and the valve box, wherein the metal rigid sealing gasket ring is clamped and sealed between the packing box and the valve box in an axial direction of the accommodating chamber, wherein a ring-shaped protrusion is arranged on an end surface of the packing box facing the metal rigid sealing gasket ring, and the ring-shaped protrusion is in annular sealing fit with the metal rigid sealing gasket ring, and wherein the packing box is outside of the valve box except the ring-shaped protrusion.

9. The hydraulic end of claim 8, wherein the packing pressing cap is detachably fixedly connected to the packing box pressing cap.

10. The hydraulic end of claim 8, wherein the packing box pressing cap is configured with an internal thread, wherein the packing pressing cap is configured with an external thread, and wherein the packing pressing cap is in threaded connection with the packing box pressing cap.

11. The hydraulic end of claim 8, furthering comprising a base plate abutted against the valve box with a lubrication channel, wherein the packing assembly passes through the base plate, and wherein a through hole is provided in the packing box, wherein the lubrication channel is communicated to a packing chamber of the packing box through the through hole, such that a lubrication grease or oil can be conveyed to a position of the packing in the packing chamber.

12. A hydraulic end of a fracturing pump, comprising:

a valve box and a packing assembly, wherein the packing assembly comprises a pressing cap, a packing, and a packing pressing cap, wherein the packing is accommodated in an accommodating chamber of the valve box, and the packing pressing cap presses the packing and extends through the pressing cap, wherein the pressing cap is detachably fixedly connected to the valve box, wherein one of an end surface of the valve box and an end surface of the pressing cap is configured with a positioning protrusion, and the other one of the end surfaces of the valve box and the pressing cap is configured with a positioning groove, and wherein the positioning protrusion is matched and connected with the positioning groove.

13. The hydraulic end of claim 12, wherein the packing pressing cap is detachably fixedly connected to the pressing cap.

14. The hydraulic end of claim 12, wherein the pressing cap is configured with an internal thread, wherein the packing pressing cap is configured with an external thread, and wherein the packing pressing cap is in threaded connection with the pressing cap.

15. The hydraulic end of claim 12, wherein the pressing cap is detachably fixedly connected to the valve box through a bolt.

16. The hydraulic end of claim 12, wherein the valve box further comprises a lubrication channel, which is communicated to the accommodating chamber such that a lubrication grease can be conveyed to a position of the packing in the accommodating chamber.

* * * * *